US005650024A

United States Patent [19]

Hasegawa et al.

[11] Patent Number: 5,650,024

[45] Date of Patent: Jul. 22, 1997

[54] MARTENSITIC HEAT-RESISTING STEEL EXCELLENT IN HAZ-SOFTENING RESISTANCE AND PROCESS FOR PRODUCING THE SAME

[75] Inventors: Yasushi Hasegawa; Masahiro Ohgami; Nobuo Mizuhashi; Hisashi Naoi, all of Futtsu; Toshio Fujita, 14-4, Mukogaoka 1-chome, Bunkyo-ku, Tokyo, all of Japan

[73] Assignees: Nippon Steel Corporation; Toshio Fujita, both of Tokyo, Japan

[21] Appl. No.: 513,999

[22] PCT Filed: Dec. 28, 1994

[86] PCT No.: PCT/JP94/02302

§ 371 Date: Aug. 25, 1995

§ 102(e) Date: Aug. 25, 1995

[87] PCT Pub. No.: WO95/18242

PCT Pub. Date: Jul. 6, 1995

[30] Foreign Application Priority Data

Dec. 28, 1993 [JP] Japan ..... 5-353145

[51] Int. Cl.[6] ..... C21D 8/00; C22C 38/22; C22C 38/26; C22C 38/28

[52] U.S. Cl. ..... 148/326; 148/328; 148/542; 148/548

[58] Field of Search ..... 148/326, 328, 148/542, 548

[56] References Cited

U.S. PATENT DOCUMENTS 3,389,991 6/1968 Tanczyn ..... 148/326

FOREIGN PATENT DOCUMENTS 1588817 3/1970 European Pat. Off. .
4212965 10/1993 European Pat. Off. .
626463 11/1994 European Pat. Off. .
53-104522 9/1978 Japan .
56-35752 4/1981 Japan .
61-231139 10/1986 Japan .
62-297435 12/1987 Japan .
63-89644 4/1988 Japan .
3-75355 3/1991 Japan .
3-75337 3/1991 Japan .
1070103 5/1967 United Kingdom ..... 148/326

OTHER PUBLICATIONS

Patent Abstracts of Japan, vol. 15, No. 282 (C-850), Jul. 17, 1991 & JP-A-03 097832 (Sumitomo Metal Ind. Ltd.), Apr. 23, 1991.

*Primary Examiner*—Deborah Yee
*Attorney, Agent, or Firm*—Kenyon & Kenyon

[57] ABSTRACT

A martensitic heat-resisting steel comprises, in terms of % by mass, 0.01 to 0.30% of C, 0.02 of 0.80% of Si, 0.20 to 1.00% of Mn, 5.00 to 18.00% of Cr, 0.005 to 1.00% of Mo, 0.20 to 3.50% of W, 0.02 to 1.00% of V, 0.01 to 0.50% of Nb, 0.01 to 0.25% of N, and at least one element selected from the group consisting of Ti, Zr, Ta and Hf in an amount of 0.005 to 2.0% for each of the elements, the volume of (Ti %+Zr %+Ta %+Hf %) in the metal component M of $M_{23}C_6$ type carbides therein being from 5 to 65%. The heat-resisting steel is produced by a process comprising the steps of adding Ti, Zr, Ta and Hf to a molten steel having chemical components as mentioned above, during the period from 10 minutes before completion of refining to completion of refining, casting said molten steel, working the resulting casting, solution treating said worked product, subjecting said worked product to temporary cooling stop at a temperature from 950° to 1,000° C. in the course of cooling said hot worked product, and holding said worked product at the temperature for 5 to 60 minutes. The heat-resisting steel is excellent in HAZ-softening resistance, and exhibits a high creep strength at high temperature of at least 550° C.

6 Claims, 10 Drawing Sheets

MARTENSITIC HEAT-RESISTING STEEL EXCELLENT IN HAZ-SOFTENING RESISTANCE AND PROCESS FOR PRODUCING THE SAME

FIELD OF THE INVENTION

The present invention relates to a martensitic heat-resisting steel, and more in detail, to a martensitic heat-resisting steel excellent in HAZ-softening resistance and used in a high temperature and high pressure environment.

BACKGROUND OF THE INVENTION

Boilers of thermal power plants have been operated under conditions of markedly high temperature and high pressure in recent years. Part of them are planned to be operated at 566° C. and 316 bar. It is estimated that some of them will operate at 649° C. and 352 bar in the future. Accordingly, materials for such boilers will be used under extremely harsh conditions.

When the operation temperature exceeds 550° C., materials used in the boilers will be changed, for example, from ferritic 2¼% Cr-1% Mo steel to an austenitic steel of high grade such as 18-8 stainless steel in view of oxidation resistance and high temperature strength. Thus, materials of very high grade and high cost are currently used.

Steel materials having an intermediate grade between 2¼% Cr-1% Mo steel and austenitic stainless steel have been searched for in the past several decades. Boiler tube steels containing an intermediate amount of Cr such as 9% Cr steel or 12% Cr steel have been developed on the basis of the demands described above. Some of the steels have attained a high temperature strength and a creep strength comparable to austenitic steels by precipitation strengthening or solid solution strengthening effected by adding a variety of alloying elements as base material components.

The creep strength of heat-resisting steels is governed by solid solution strengthening when the steels have been aged for a short period of time and by precipitation strengthening when they have been aged over a long period of time. This is because solid solution strengthening elements dissolved in the steels are precipitated at first as stable carbides such as $M_{23}C_6$ by aging in many cases. However, when the steels are aged for a still longer period of time, the precipitates are coalescence coarsened, and as a result the creep strength is lowered. Many studies have, therefore, been performed on maintaining the solid solution strengthening elements in a solution state in the steels over a long period of time without precipitation in order to maintain the high creep strength of the heat-resisting steels.

For example, Japanese Patent Unexamined Publication (Kokai) Nos. 63-89644, 61-231139 and 62-297435 disclose ferritic heat-resisting steels which can achieve a creep strength far higher than a conventional Mo-added type ferritic heat-resisting steel by the use of W as a solid solution strengthening element. Many of these steels have a tempered martensite single phase as their structure, and are expected to become the next generation of materials for use in high temperature and high pressure environments due to their advantage as ferritic steels excellent in steam oxidation resistance and due to their high strength properties.

On the other hand, ferritic heat-resisting materials utilize the high strength of a martensite structure containing a large amount of dislocations or its tempered structure formed by the supercooling phenomenon of phase transformation from an austenite single phase region to (ferrite+carbide precipitate) the phase to be produced as a result of cooling during heat treatment. Accordingly, when the structure is subjected to a heat cycle of being reheated to the austenite single region, for example, when the structure is subjected to weld heat affection, the dislocations of high density are relieved again, and the strength is sometimes locally decreased in the weld HAZ (heat-affected zone).

Particularly among those portions which are reheated to a temperature of at least a ferrite-austenite transformation point, portions which has been heated to a temperature near the transformation point, for example, about from 900° to 1,000° C. in the case of 9% Cr steel, and recooled in a short period of time are subjected to martensite transformation while austenite grains do not grow sufficiently to become a fine grain structure. In addition, $M_{23}C_6$ type carbides which are a principal factor in improving the materials strength by precipitation strengthening do not redissolve, and mechanisms for inducing a decrease in the high temperature strength such as alteration of the constituent components of the carbides, or carbide coarsening, may compositely act on the portion to locally become a softened zone. The softening zone-forming phenomenon is termed "HAZ-softening" for convenience.

DISCLOSURE OF THE INVENTION

The present inventors have carried out detailed studies on the softening zone, and found that the decrease in strength is caused mainly by a change of the constituent elements in $M_{23}C_6$ type carbides. As the result of further investigation, they discovered that when high strength martensitic heat-resisting steel is being subjected to the weld heat affection, Mo or W particularly essential to solid solution strengthening thereof is dissolved in the constituent element M of $M_{23}C_6$ in a large amount and precipitates at grain boundaries of the fine grain structure, and that as a result, a Mo- or W-depleted zone is formed near the austenite grain boundaries, resulting in a local decrease in the creep strength.

Accordingly, the decrease in the creep strength caused by weld heat affection is critically disadvantageous to heat-resisting materials. It is obvious that the prior art aiming at optimization of heat treatment and welding cannot solve the problems. In addition, it is evident that a countermeasure of completely austenitizing a welded portion again which had been recognized as the sole solution cannot be practiced when the process of construction and execution of works in power plant is taken into consideration. Accordingly, it is clear that manifestation of the "HAZ-softening" phenomenon is inevitable in a conventional heat-resisting martensitic or ferritic steel.

An object of the present invention is to overcome the disadvantage of the conventional steel, namely to avoid the formation of a local softening zone in a weld HAZ caused by alteration and coarsening of $M_{23}C_6$ type carbides.

A further object of the present invention is to prevent Mo or W from being dissolved in $M_{23}C_6$ in a large amount while the steel material is being subjected to weld heat affection.

To achieve the objects as mentioned above in the present invention, the composition and the precipitation size of $M_{23}C_6$ type carbides in a weld HAZ are controlled.

As the result of intensively investigating the "HAZ-softening" phenomenon to achieve the objects as mentioned above, the present inventors have discovered that Ti, Zr, Ta and Hf each have an extremely strong affinity with C in the component system of the steel according to the present invention, that carbides of these elements become precipitation nuclei of $M_{23}C_6$ carbides to be precipitated in the tempered martensite structure of the steel according to the present invention, and these elements dissolve in solid solution state at the same time in the metal component M in the carbides, that when the solid solution amount in the metal component M is within a specific range, the creep rupture strength of the weld HAZ falls down to only an extremely small value within the deviation of the creep rupture strength of the base material compared with the rupture strength thereof, and that as a result, the weld HAZ does not exhibit the "HAZ-softening" phenomenon any more.

The following process has been developed to realize the discovery.

First, since the precipitates of Ti, Zr, Ta and Hf are each required to become fine and appropriate, that is, since all of the precipitates must become carbides and carbonitrides, these elements are each added to the molten steel in a state of a low oxygen concentration immediately before completion of refining. Second, since these precipitates of Ti, etc. are required to become precipitation nuclei of $M_{23}C_6$ to be precipitated within the tempered martensite structure and to be dissolved in solid solution state in the resultant carbides in suitable amounts, the steel slab is processed as follows: the steel slab having been subjected to a solid solution heat treatment is subjected to cooling stop at a temperature of 950° to 1,000° C. in the course of cooling; and the steel slab is held at the temperature for a predetermined period of time to sufficiently precipitate fine carbides of Ti, etc.

As described above, when a steel material having a martensite structure in which fine carbides of Ti, etc. are precipitated is tempered, $M_{23}C_6$ type carbides are precipitated while the carbides of Ti, etc. are utilized as the precipitation nuclei. $M_{23}C_6$ carbides and the fine carbides of Ti, Zr, Ta and Hf are mutually dissolved in each other, and finally $M_{23}C_6$ type carbides in which Ti, Zr, Ta and Hf are solid solubled in the prescribed range in the metal component M, are formed in the tempered martensite structure. As a result, the creep rupture strength of the weld HAZ is significantly improved.

That is, the present invention provides a martensitic heat-resisting steel which comprises, in terms of % by mass, 0.01 to 0.30% of C, 0.02 to 0.80% of Si, 0.20 to 1.00% of Mn, 5.00 to 18.00% of Cr, 0.005 to 1.00% of Mo, 0.20 to 3.50% of W, 0.02 to 1.00% of V, 0.01 to 0.50% of Nb, 0.01 to 0.25% of N, up to 0.030% of P, up to 0.010% of S, up to 0.020% of O, at least one element selected from the group consisting of Ti, Zr, Ta and Hf in an amount of 0.005 to 2.0% for each of the elements, if necessary at least one element selected from the group consisting of Co, Ni and Cr in an amount of 0.2 to 5.0% for each of Co and Ni and 0.2 to 2.0% for Cu, and the balance Fe and unavoidable impurities, and which has in the tempered martensite structure precipitated $M_{23}C_6$ type carbides, the value of (Ti %+Zr %+Ta %+Hf %) in the metal component M thereof being from 5 to 65%. The present invention provides a process for producing said heat-resisting steel comprising the steps of adding at least one element selected from the group consisting of Ti, Zr, Ta and Hf to a molten steel during the period from 10 minutes before completion of refining to completion thereof, subjecting the steel to temporary cooling stop at a temperature of 950° to 1,000° C. in the course of cooling the steel after solution heat treatment, holding the steel at that temperature for 5 to 60 minutes, and tempering it.

DESCRIPTION OF THE PREFERRED EMBODIMENTS

Figure 1:
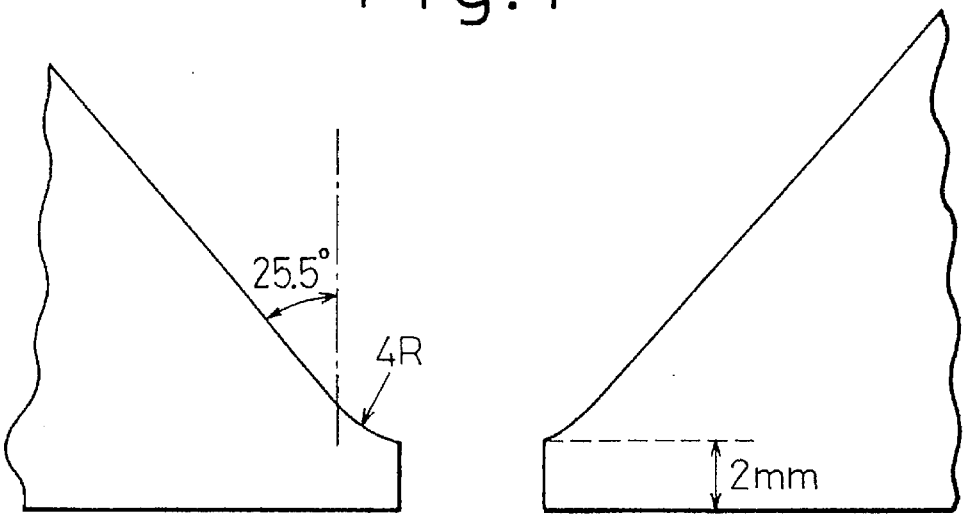
FIG. 1 is a view showing a butt groove shape of a welded joint.

Preferred embodiments of the present invention will be explained.

First, the reasons for restricting the contents of components in the molten steel in the present invention as mentioned above are described below. A content expressed in terms of % signifies a content in terms of % by mass.

Though C is necessary for maintaining the strength of the steel, C in a content of less than 0.01% is insufficient for ensuring the strength of the steel. When the content of C exceeds 0.30%, the weld HAZ is markedly hardened, and as a result cold cracking is formed at the time of welding. Accordingly, the content range of C is defined to be from 0.01 to 0.30%.

Si is important in ensuring the oxidation resistance of the steel, and it is also a necessary element as a deoxidizing agent. Si in a content of less than 0.02% is insufficient, and Si in a content exceeding 0.80% lowers the creep strength of the steel. Accordingly, the content range of Si is defined to be from 0.02 to 0.80%.

Mn is a component necessary not only for deoxidization but also for maintaining the strength of the steel. Addition of Mn in a content of at least 0.20% is necessary for obtaining a sufficient effect. Mn in a content exceeding 1.00% may sometimes lower the creep strength of the steel. Accordingly, the content range of Mn is defined to be from 0.20 to 1.00%.

Cr is an element essential to the oxidation resistance of the steel. Cr combines with C at the same time in forms of $Cr_{23}C_6$·$Cr_7C_3$, etc. to form fine precipitates in the base steel matrix, and thus contributes to an increase in the creep strength of the steel. From the standpoint of oxidation resistance, the lower limit of the Cr content is defined to be 5.0%. The upper limit thereof is defined to be 18.0% from the standpoint of ensuring a high temperature strength of the steel and in view of the limit for achieving a martensite single phase.

W is an element significantly enhancing the creep strength of the steel through solution hardening. W particularly increases the long term creep strength at high temperatures of at least 550° C. When K is added in a content exceeding 3.5%, it precipitates mainly at grain boundaries as intermetallic compounds in a large amount. As a result, the toughness and the creep strength of the base steel are markedly lowered. The upper limit of the W content is, therefore, defined to be 3.5%. Moreover, W in a content of less than 0.20% is insufficient for achieving the effect of solid solution strengthening. Accordingly, the lower limit of the W content is defined to be 0.20%.

Mo also enhances the high temperature strength of the steel through solid solution strengthening. Mo in a content of less than 0.005% is insufficient for achieving the effect. Since $Mo_2C$ type carbide is precipitated in a large amount or $Mo_2Fe$ type intermetallic compound is precipitated when the content of Mo exceeds 1.00%, simultaneous addition of Mo and W may considerably lower the toughness of the base steel. Accordingly, the upper limit of the Mo content is defined to be 1.00%.

V is an element which significantly enhances the high temperature creep rupture strength of the steel when it is precipitated as precipitates or when it is dissolved in the matrix in the same manner as W. In the present invention, V in a content of less than 0.02% is insufficient for precipitation strengthening the steel with V precipitates, and on the other hand V in a content exceeding 1.00% forms clusters of V type carbides or carbonitrides which lower the toughness of the steel. Accordingly, the V content is defined to be from 0.02 to 1.00%.

Nb precipitates as NX type carbides or carbonitrides to increase the high temperature strength of the steel and contribute to solid solution strengthening. When the Nb content is less than 0.01%, the addition effects are not noticeable. When the Nb content exceeds 0.50%, coarse precipitates are formed to lower the toughness. Accordingly, the addition content range of Nb is defined to be from 0.01 to 0.50%.

N is dissolved in the matrix or precipitates as nitrides and carbonitrides. N contributes to solution hardening and precipitation hardening of the steel principally in the forms of VN, NbN or their carbonitrides. N in an addition content of less than 0.01% exhibits almost no contribution to strengthening of the steel. Moreover, the upper limit of the addition content thereof is defined to be 0.25% while the upper limit of the addition content thereof in molten steel in accordance with the Cr addition content of up to the maximum value of 18% is taken into consideration.

The addition of Ti, Zr, Ta and Hf constitutes the foundation of the present invention. The addition of these elements and the process according to the present invention realizes prevention of the "HAZ-softening" in the steel of the invention. Ti, Zr, Ta and Hf have an extremely strong affinity with C in the component system of the steel of the invention, and dissolve in M of $M_{23}C_6$ as constituent elements to raise the decomposition temperature thereof. Accordingly, these elements are effective in preventing $M_{23}C_6$ from coarsening in the "HAZ-softening" zone. In addition, these elements prevent W and Mo from dissolving in $M_{23}C_6$, and, therefore, a zone depleted in W and Mo is not formed around the precipitates. These elements may be added singly or compositely in a mixture of at least two of them. These elements each in a content of at least 0.005% already show the effects. Since any one of these elements in a content of at least 2.0% forms coarse MX type carbides and deteriorates the toughness of the steel, the addition content range of each of them is defined to be from 0.005 to 2.0%.

P, S and O are mixed into the steel of the invention as impurities. However, in view of displaying the effect of the invention, P and S lower the strength, and O precipitates as an oxide and lowers the toughness of the steel. Accordingly, the upper limits of P, S and O are defined to be 0.03, 0.01 and 0.02%, respectively.

Though the fundamental components of the steel of the present invention are as described above, the steel of the invention may optionally contain one or at least two elements selected from the group consisting of Ni, Co and Cu. The steel of the invention may contain from 0.1 to 5.0% of Ni, from 0.1 to 5.0% of Co and from 0.1 to 2.0% of Cu.

Ni, Co and Cu are all potent elements for stabilizing austenite structure. Particularly when large amounts of ferrite-stabilizing elements, namely Cr, W, Mo, Ti, Zr, Ta, Hf, Si, etc., are added, Ni, Co, Cu are necessary for obtaining complete martensite or its tempered structure, and these elements are useful. At the same time, Ni and Co are effective in improving the toughness and the strength of the steel, respectively, and Cu is effective in improving the strength and corrosion resistance thereof. A content of each of these elements of less than 0.1% is insufficient for achieving these effects. When Ni or Co are each added in a content exceeding 5.0% or when Cu is added in a content exceeding 2.0%, it is inevitable that coarse intermetallic compounds are precipitated in the case of adding Ni or Co, and that intermetallic compounds are formed in a film form along grain boundaries in the case of adding Cu.

These elements are, therefore, added in the content ranges as mentioned above. However, since the above-mentioned effects of adding these elements become significant when they are each added in a content of at least 0.2%, the lower limit of the addition content of each of these elements is desirably 0.2%.

To obtain appropriate effects of adding Ti, Zr, Ta and Hf, the value of (Ti %+Zr %+Ta %+Hf %) in the metal component M of $M_{23}C_6$ type carbides existing in the weld HAZ is required to be from 5 to 65%. To satisfy the requirement through precipitation of these elements in the form of appropriate carbides in the steel, the steel production process is carried out as follows: Ti, Zr, Ta and Hf are added during the period from 10 minutes before completion of refining to completion of refining; cooling the steel subsequent to solution treatment which is usually performed by holding the steel at temperature of 900° to 1,350° C. for a period of 10 minutes to 24 hours is temporarily stopped at a temperature from 950° to 1,000° C., and the steel is held at the temperature for a period of 5 to 60 minutes to control the precipitated forms of the carbides. The precipitates thus obtained can be utilized as precipitation nuclei of $M_{23}C_6$ mainly containing Cr to be precipitated subsequent tempering, which is usually carried out by holding the steel at a temperature of 300° to 850° C. for a period of 10 minutes to 24 hours. The effects of adding Ti, Zr, Ta and Hf can be appropriately manifested and the object of the invention can be achieved only by applying the process as mentioned above. The intended effects of the present invention cannot be achieved even if a steel is produced merely by a conventional process using materials having the adjusted chemical composition of the invention. That is, the value of (Ti %+Zr %+Ta %+Hf %) in the metal component M of $M_{23}C_6$ type carbides existing in the weld HAZ cannot be controlled to be from 5 to 65%.

The production process and the composition range of carbides as mentioned above have been determined by experiments as described below.

A molten steel having a chemical composition as claimed in the claims of the present invention except for Ti, Zr, Ta and Hf was prepared by using a VIM (vacuum induction heating furnace) or EF (electric furnace), and selecting and using an AOD (argon-oxygen blowing decarbonization refining unit), a VOD (vacuum exhausting oxygen blowing decarbonization unit) or LF (molten steel ladle refining unit), and cast into a slab having a cross section of 210×1,600 mm by a continuous casting unit. The influence of the addition time of Ti, Zr, Ta and Hf on the composition and the shape of precipitates after casting was investigated by adding these elements at any of the following times: at the start of melting, during melting or 5 minutes before completion of melting in a VIM or EF; at the start of refining process or 10 minutes before completion thereof in an AOD, a VOD or LF. Each of the slabs thus cast was sectioned so that each piece thus obtained had a length of 2 to 5 m and plates each having a thickness of 25.4 mm were formed. The plates were then solution treated under the conditions of the maximum heating temperature of 1,100° C. and a holding time of 1 hour. In the course of cooling the plates, cooling was stopped at a temperature of 1,050°, 1,000°, 950°, 900°, 850° or 800° C., and the plates were held at the temperature for up to 24 hours in the furnace and air cooled. Precipitates in the plates were then subjected to residue-extraction analysis, and the precipitation forms of carbides in the plates were examined using a transmission electron microscope with a micro X-ray analysis apparatus.

Furthermore, each of the steel plates thus obtained was tempered at 780° C. for 1 hour, subjected to edge preparation for V-shaped butt welding with a groove angle of 45 degrees, and used for welding experiments. The experiments were carried out by using TIG arc welding under a selected heat input condition of 15,000 J/cm which is a general heat input for martensitic heat-resisting materials.

Figure 2:
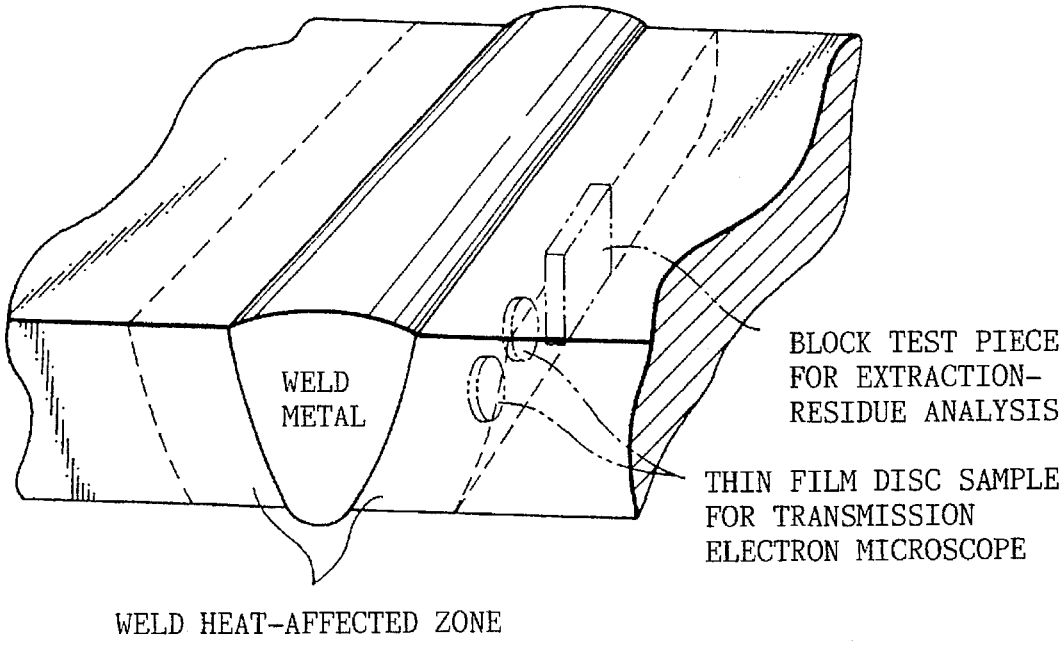
FIG. 2 is a view showing a procedure for sampling test pieces for analyzing precipitates in a weld HAZ.

The welded joint samples thus obtained were subjected to post weld heat treatment at 740° C. for 6 hours, and thin film disc samples for transmission electron microscopic observation and block test pieces for extraction-residue analysis were sampled from the HAZ portions of the samples by procedures as shown in FIG. 2.

Figure 3:
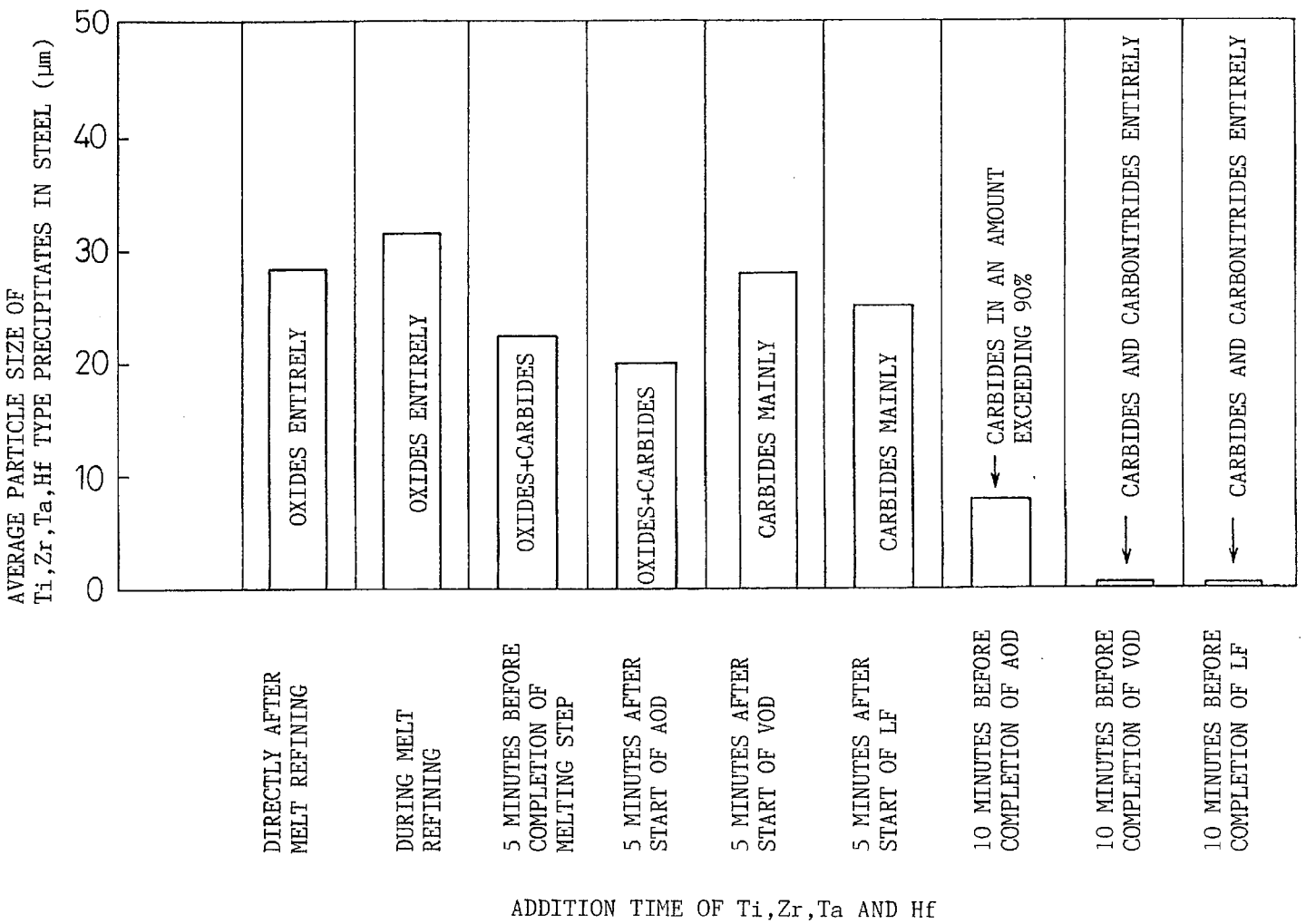
FIG. 3 is a diagram showing the relationship between the addition time of Ti, Zr, Ta and Hf, and the form and the average particle size of precipitates of Ti, Zr, Ta and Hf in the steel.
Figure 4:
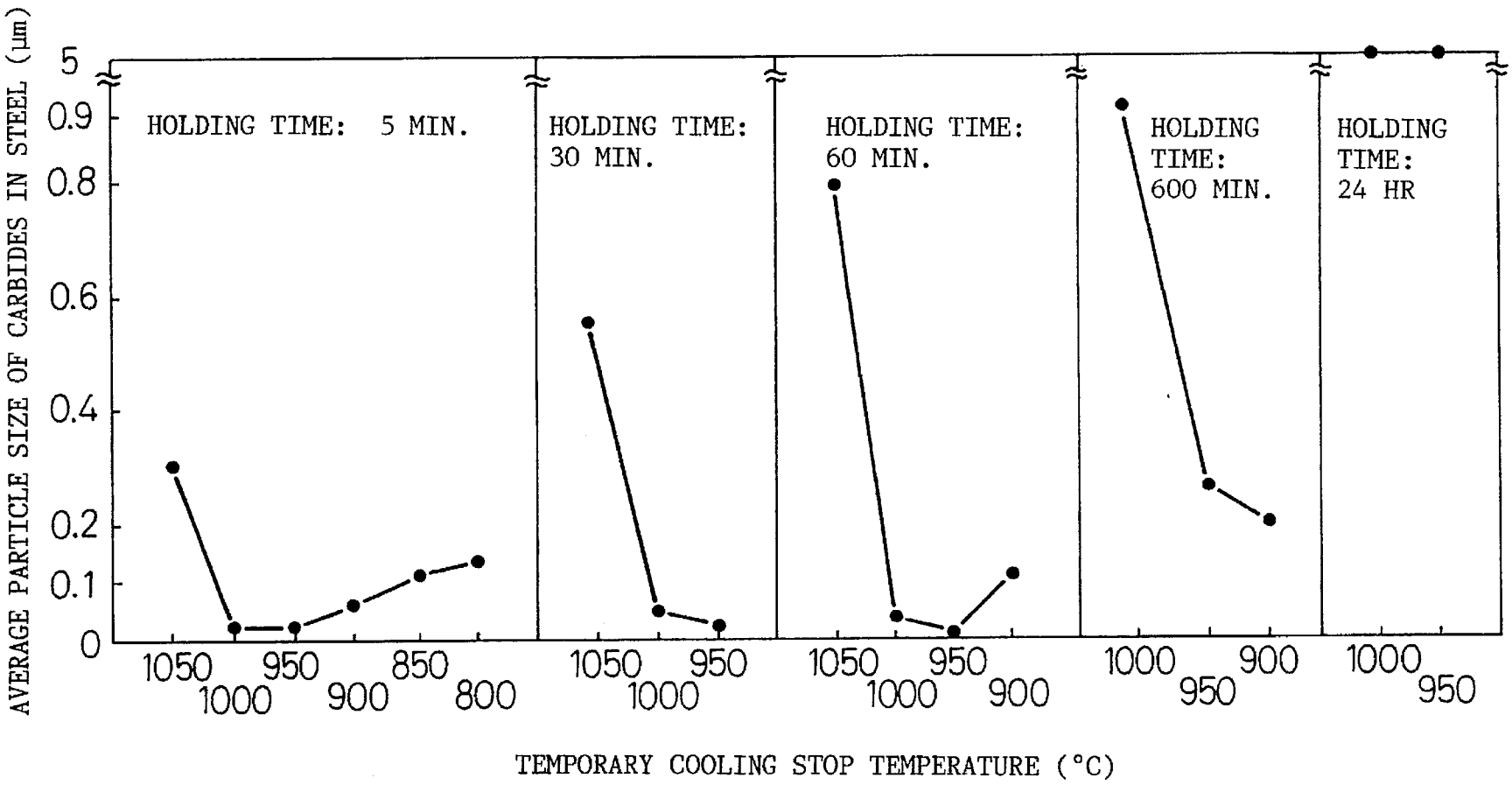
FIG. 4 shows graphs each showing the relationship between a temporary cooling stop temperature after solution treatment and a holding time thereat, and the particle size of the precipitated carbides.

FIG. 3 shows the relationship between the addition time of Ti, Zr, Ta and Hf, and the form and the average particle size of precipitates of Ti, Zr, Ta and Hf in the steel. In order that the precipitates of Ti, Zr, Ta and Hf may become precipitation nuclei of $M_{23}C_6$ and solid soluble in the constituent metal element M of $M_{23}C_6$, these elements must exist as fine carbides (including carbonitrides) in advance in the molten metal. It is understood that to satisfy the requirement, these elements are required to be added to molten steel having a low oxygen concentration, that is, these elements must be added to molten steel during the period from 10 minutes before completion of refining in a VOD or LF to at the time of completion thereof. The average particle size of carbides at this time, namely carbides in steels produced by casting the molten steels or ingot-making thereof has been found to be approximately 0.15 μm by electron microscopic observation of the carbides.

The particle size of the precipitates should desirably be made as small as possible in view of the precipitation strengthening mechanism.

When the cast slab, etc. thus obtained is subjected to hot working, solution treatment, cooling (air cooling) to room temperature, working and tempering, carbides of Ti, etc. precipitated in the tempered worked product become fine. However, the amount of the carbides thus formed is only about half as much as that of carbides of Ti, etc. having been precipitated in the slab at the time of its production. In addition, the carbides are precipitated as MC type carbides other than $M_{23}C_6$ type carbides. As a result, the "HAZ-softening" phenomenon takes place in the tempered worked product.

As a result of investigating the relationship between cooling conditions after solution treatment and precipitated carbides using cast slabs (having chemical components the contents of which are in the range as claimed in the claims of the present invention) produced by the process of EF-LF-CC, the present inventors have clarified that the cooling stop temperature subsequent to solution treatment and the holding time at the temperature have an extremely important relationship with the particle size of the precipitated carbides.

That is, it has been confirmed that the average particle size of carbides precipitated in the steels becomes smallest when the cooling stop temperature and the holding temperature are from 950° to 1,000° C. and that most of the carbides having been precipitated in the cast slabs are reprecipitated when the slabs are held for a holding time of 5 to 60 minutes.

Figure 5:
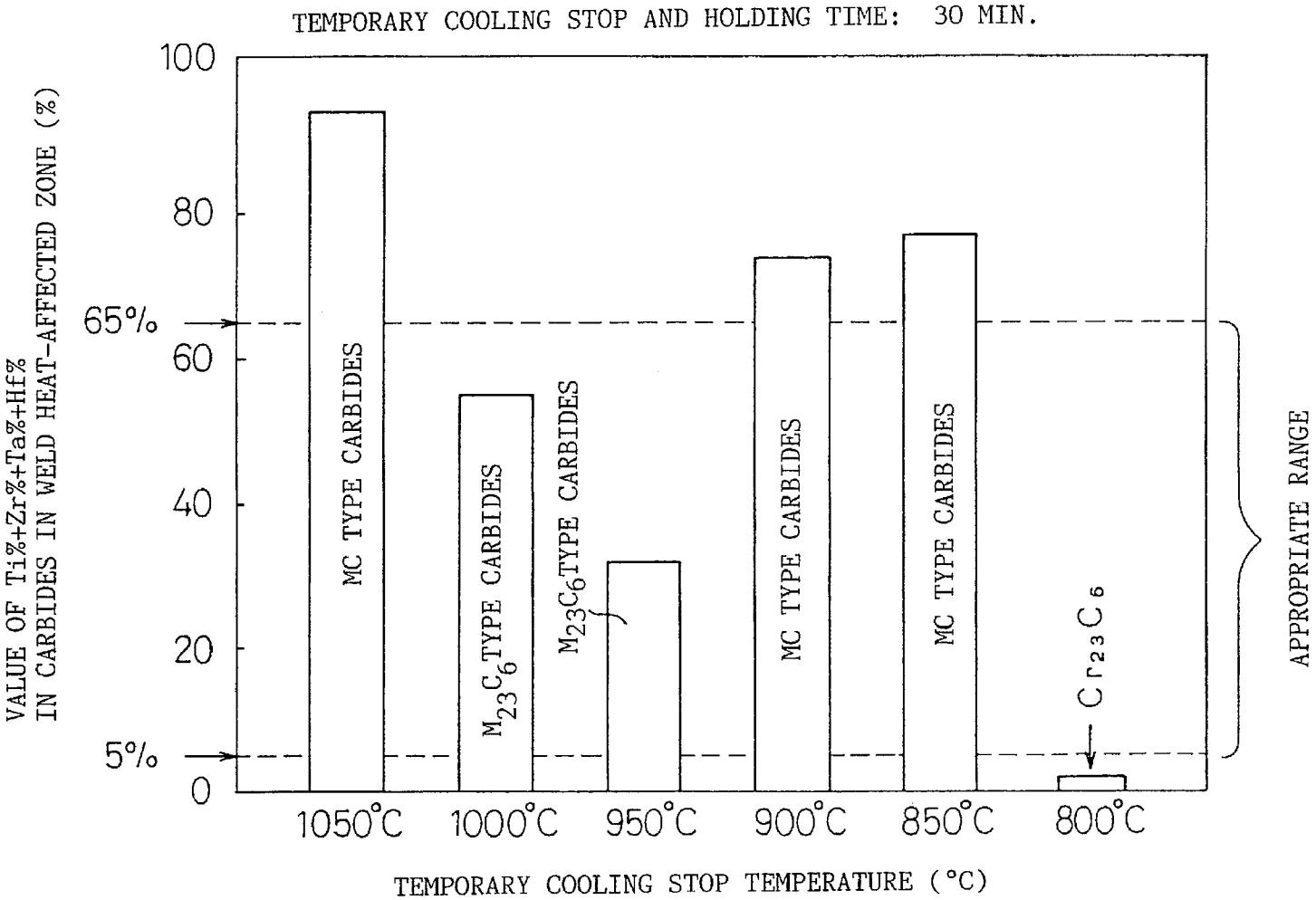
FIG. 5 is a diagram showing the relationship between a temporary cooling stop temperature after solution treatment, and the form and the structure of the precipitates in a weld HAZ.

Taking the research results as described above into consideration, the present inventors carried out the following experiments: cast slabs, etc. used in FIG. 3 were worked, solution treated, subjected to air cooling which was stopped at a variety of temperatures including 950° C. and 1,000° C., held at respective cooling stop temperatures for 30 minutes, and further air cooled to room temperature; the samples thus obtained were tempered at 780° C. for 1 hour; the samples were welded, and heat treated; and the relationship between the forms and compositions of the principal precipitates in the weld HAZ, and the cooling stop temperature was investigated. The results thus obtained are shown in FIG. 5. It is seen from FIG. 5 that the carbides which take the finest precipitation forms prior to tempering (carbides in the steels which have been subjected to cooling stop at a temperature of 950° C. or 1,000° C.) become precipitation nuclei of $M_{23}C_6$, that the carbides and $M_{23}C_6$ precipitated during tempering mutually dissolve in each other to finally form $M_{23}C_6$ type carbides, and that Ti, Zr, Ta and Hf are dissolved in the constituent metal element M in a proportion of 5 to 65% in total.

Furthermore, it has been found that the weld HAZ as mentioned above has a very high creep rupture strength at high temperature.

Figure 6:
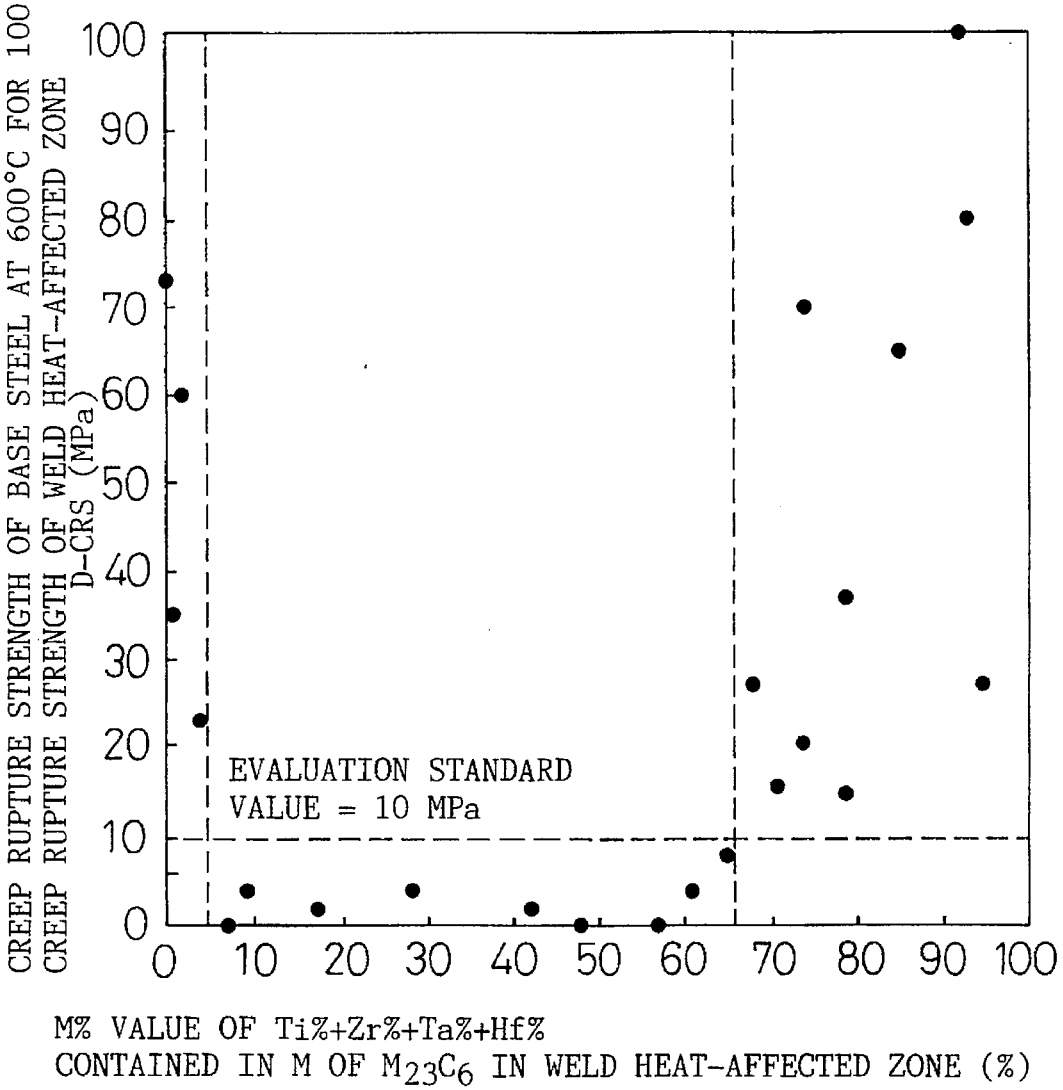
FIG. 6 is a graph showing the relationship between a difference (D–CRS) between the creep rupture strength at 600° C. for 100,000 hours estimated by linear extrapolation of a base steel and that of a weld HAZ, and the value of M % (Ti %+Zr %+Ta %+Hf %) in M of $M_{23}C_6$ type carbides in the weld HAZ.

FIG. 6 shows the relationship between a difference (D−CRS (MPa)) between the creep rupture strength of the base steels at 600° C. for 100,000 hours and that of the weld HAZ, and the value of M % (Ti %+Zr %+Ta %+Hf %) in $M_{23}C_6$ type carbides in the weld HAZ. When M % is from 5 to 65, the creep rupture strength of the weld HAZ decreases by only up to 7 MPa compared with that of the base steels. Since the difference is within the deviation of the creep rupture strength data of the base steels (10 MPa), it is understood that the weld HAZ no longer exhibits HAZ-softening. It can be concluded that the experimental results are brought about for the following reasons: $M_{23}C_6$ type carbides containing from 5 to 65% of Ti, Zr, Ta and Hf in the constituent element M have a high decomposition temperature compared with ordinary $M_{23}C_6$ type carbides containing mainly Cr in M, and are not subject to be coalescence coarsening even after weld heat affection; moreover, W and Mo are extremely difficult to dissolve in place of or in addition to Ti, Zr, Ta and Hf due to their chemical affinities and phase diagrams.

In addition, each of the elements Ti, Zr, Ta and Hf influences the creep strength of the base steels.

Figure 7:
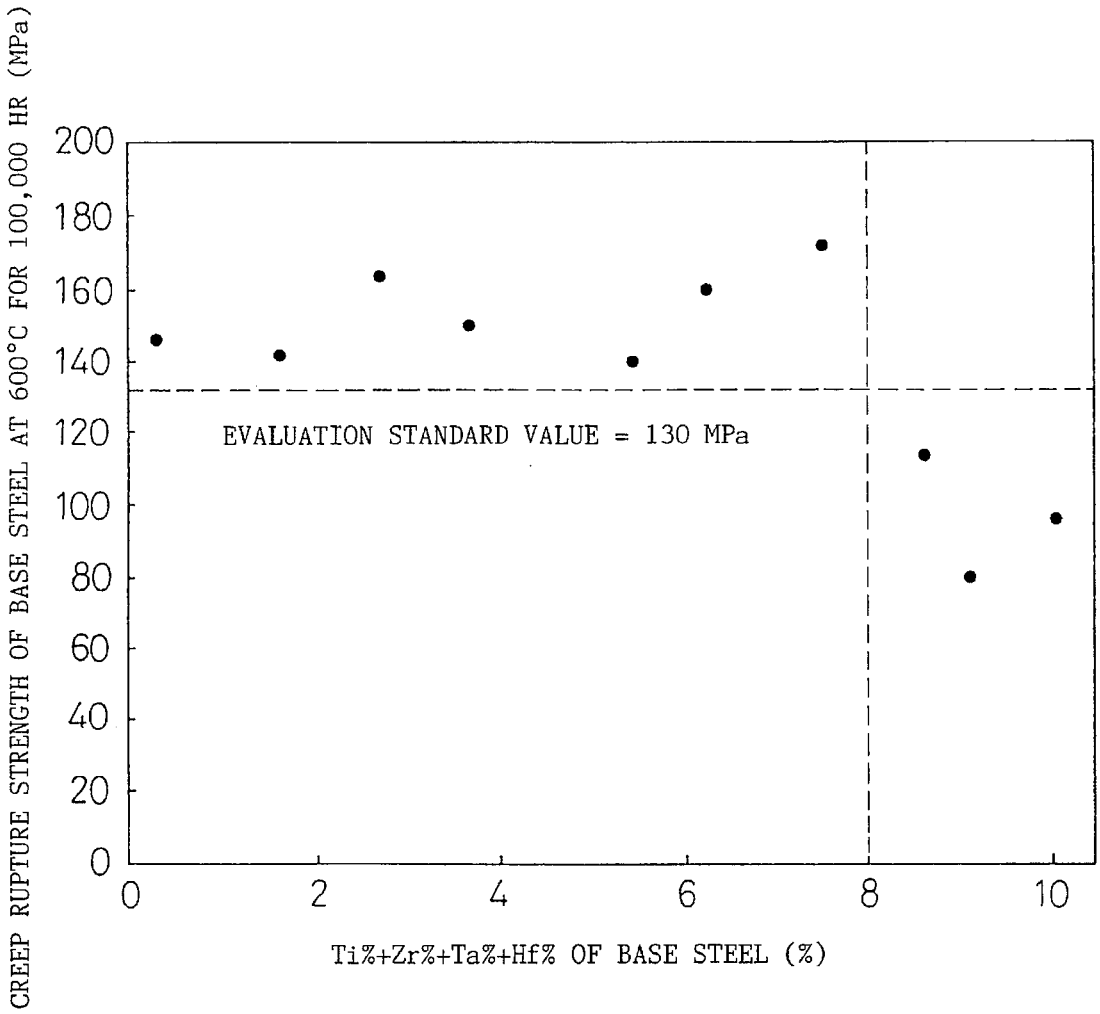
FIG. 7 is a graph showing the relationship between the creep rupture strength at 600° C. for 100,000 hours estimated by linear extrapolation of a base steel and the value of Ti %+Zr %+Ta %+Hf % in the base steel.

FIG. 7 shows the relationship between the creep rupture strength of the base steels at 600° C. for 100,000 hours and the value of Ti %+Zr %+Ta %+Hf % in the base steels. It is evident from FIG. 7 that excessive addition of Ti, Zr, Ta and Hf causes precipitate coarsening, and that as a result the creep rupture strength of the base steels themselves decreases. When the total amount of Ti %+Zr %+Ta %+Hf % in the base steels is up to 8%, the creep rupture strength thereof becomes at least the evaluation standard value of 130 MPa and causes no problem. When the upper limit of the total amount of Ti, etc. is 8%, the content of each of the elements Ti, Zr, Ta and Hf does not exceed 2%, and is within the content range as claimed in the present invention.

Figure 8:
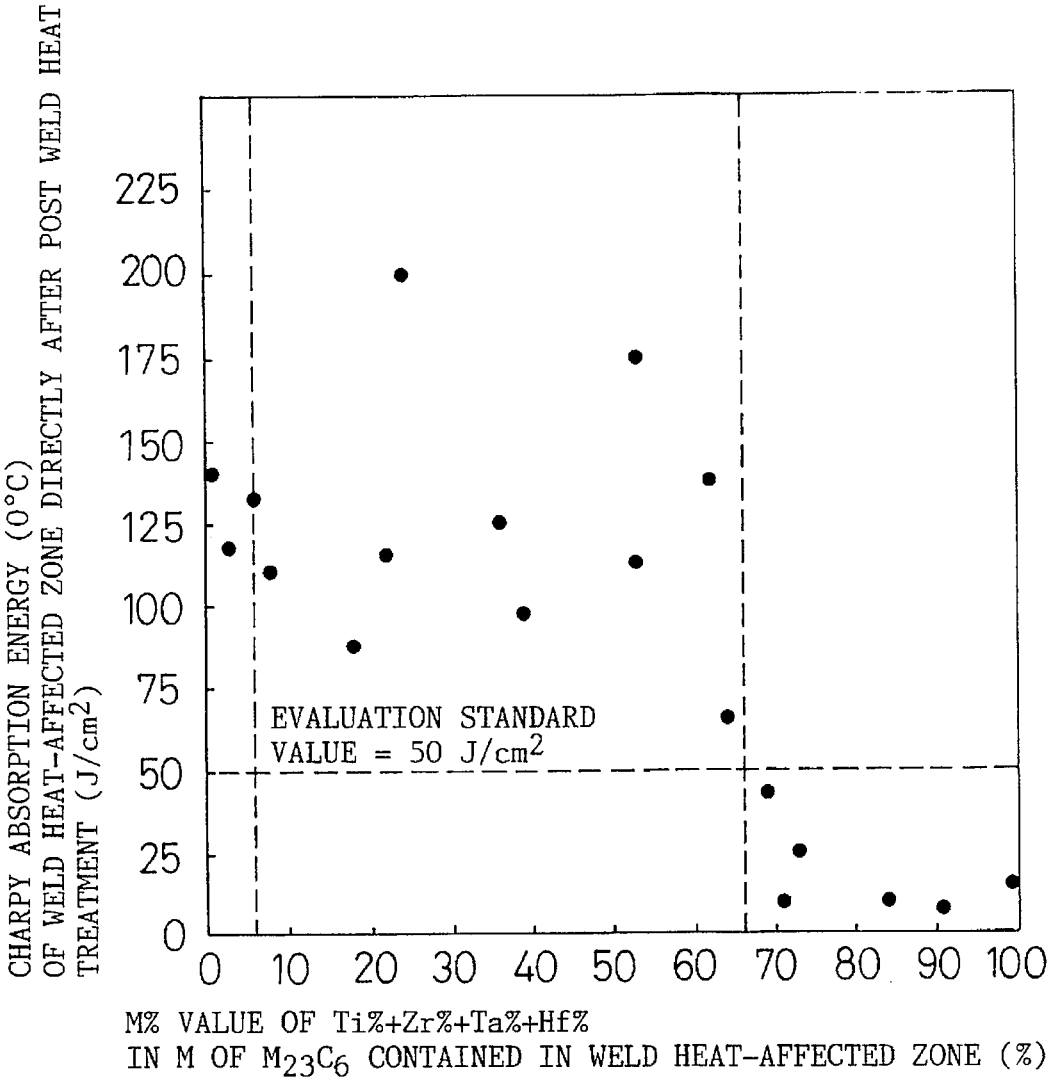
FIG. 8 is a graph showing the relationship between the value of M % (Ti %+Zr %+Ta %+Hf %) in M of $M_{23}C_6$ type carbides in the weld HAZ and the toughness thereof.

Next, the toughness of the weld HAZ of the steel according to the present invention will be explained. FIG. 8 shows the relationship between the value of Ti %+Zr %+Ta %+Hf %, namely M % in $M_{23}C_6$ in the weld HAZ and the toughness of the weld HAZ. It is understood from FIG. 8 that when M % exceeds 65%, the precipitates are coarsened and the toughness of the weld HAZ decreases, and that the toughness falls below the evaluation standard value of 50 J.

Figure 11A:
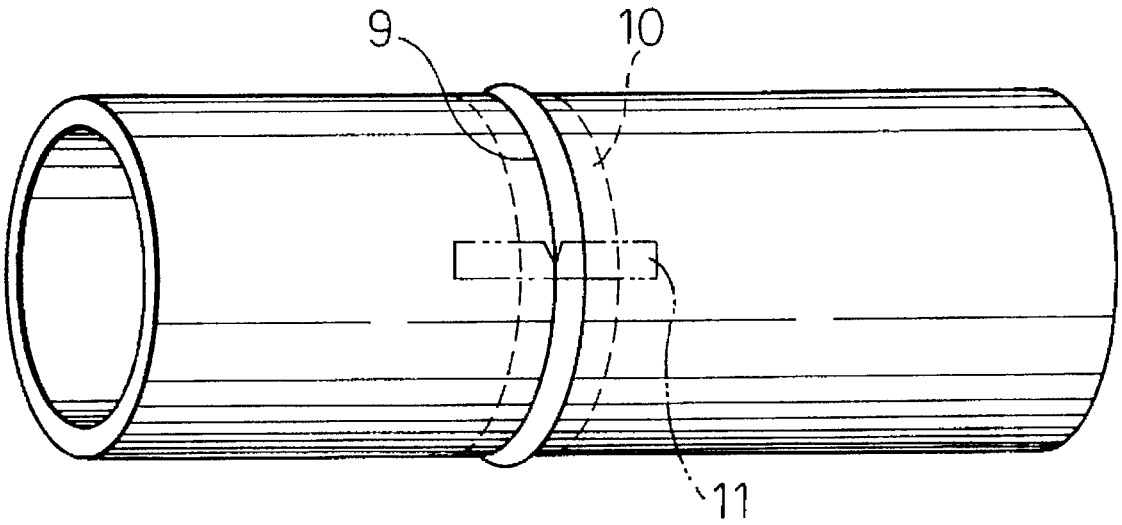
FIG. 11(*a*) and FIG. 11(*b*) are views showing a procedure for sampling a Charpy impact test piece from a weld zone of a steel tube and a procedure therefor from a weld zone of a plate or sheet, respectively.
Figure 11B:
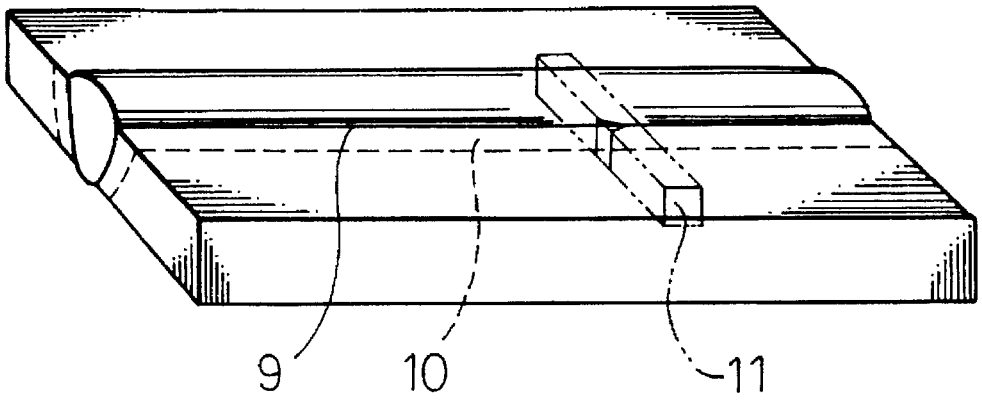

In addition, in the toughness test, a 2 mmV-notched Charpy impact test piece 11 in accordance with JIS No.4 was cut out of a portion containing a weld zone and located in the direction normal to the weld line as shown in FIG. 11(*a*) and FIG. 11(*b*). The notch was formed at a weld bond 9, which was represented by the hardest portion and shown. The evaluation standard value was defined to be 50 J at 0° C. while the construction conditions of heat-resisting materials were taken into consideration. The reference numeral 10 designates a weld HAZ.

As described above, the steel of the invention having a value of 5 to 65% as M % is also excellent in toughness.

The process of the present invention has been determined as claimed in the claims on the basis of the results as mentioned above. When a steel having a chemical composition according to the present invention is produced without applying the process of the present invention, it is impossible to obtain in the weld HAZ $M_{23}C_6$ carbides having the same composition as mentioned in the present invention.

There is no limitation on the method for melting the steel of the invention. The process can be determined in a satisfactory way taking into consideration converters, induction heating furnaces, arc melting furnaces, electric furnaces, etc., and chemical components and the cost of the steel. The unit used in the refining step is required to be equipped with a hopper which can add Ti, Zr, Ta and Hf and which is capable of controlling the oxygen concentration in the molten steel at a sufficiently low one so that at least 90% of these added elements can be precipitated as carbides. Accordingly, an LF equipped with an Ar-blowing unit, an arc heating unit or plasma heating unit, or a vacuum degassing unit is advantageously used. The use of them will enhance the effects of the invention.

Furthermore, in the subsequent rolling step or tube milling step in the case of producing a steel tube, solution treatment is essential for the purpose of uniformly redissolving the precipitates. There is required an installation capable of stopping the cooling of the steel at a given temperature in the course of cooling after solution treatment, and holding at that temperature, and a furnace which can heat the steel up to 1,350° C. is required. There can be applied production steps other than those mentioned above, concretely, all production steps recognized as necessary or useful for producing a steel or a steel product by the present invention, for example, forging, rolling, heat treatment, tubing, welding, sectioning, inspection, and the like. Their application by no means impairs the effects of the present invention.

Particularly in the production of steel tubes, the following production processes of steel tubes can be applied to the present invention under the condition that the processes comprise the production steps of the present invention without fail: a process for producing a seamless pipe or tube comprising the steps of working a steel to form a round or square billet, and hot extruding or seamless rolling the billet in various ways; a process for producing an electric welded tube comprising the steps of hot rolling and cold rolling a steel sheet, and resistance welding the rolled sheet; and a process for producing a welded steel tube comprising carrying out TIG arc welding, MIG welding, SAW, LASER welding and EB welding singly or in combination. Furthermore, there can be additionally practiced after carrying out each of the processes as mentioned above any of hot or warm SR (squeeze rolling), sizing rolling, and a variety of levelling steps. The applicable size of the steel of the invention can thus be expanded.

The steel of the present invention may further be provided in the form of a plate or sheet. The plate or sheet having been subjected to necessary heat treatment may be used as a heat-resisting material with various shapes, and exerts no adverse effects in the present invention.

Still furthermore, there may be applied to the process of the present invention powder metallurgy processes such as HIP (hot isostatic press sintering unit), CIP (cold isostatic pressing unit) and sintering. Products having a variety of shapes can be obtained by subjecting the resultant compacted products to indispensable heat treatment.

The steel tubes, steel plates and heat-resisting steel materials of various shapes thus obtained may be subjected to respective heat treatments depending on the object and application. These heat treatments are important to obtain sufficient effects of the present invention.

Usually, the products of the invention are obtained through the steps of normalizing (solution treatment) and tempering. The products may further be retempered and/or normalized, and the step is useful. In addition, cooling stop at a temperature of the steel and holding it at the temperature after solution treatment are essential to the process of the invention.

When the steel of the invention has a relatively high content of nitrogen or carbon, when the steel contains austenite-stabilizing elements such as Co, Ni and Cu in a large amount or when the steel has a low Cr equivalent, the so-called sub-zero treatment wherein the steel is cooled to up to 0° C. may be applied thereto to avoid retained austenite phase formation. The treatment is effective in sufficiently manifesting the mechanical properties of the steel of the invention.

Each of the steps mentioned above may also be applied at least twice so long as the repetition of the steps is necessary for sufficiently manifesting the material properties, and the repetition exerts no adverse effects in the present invention.

The steps as mentioned above may suitably be selected and applied to the process for producing the steel of the present invention.

EXAMPLES

A molten steel having components except for Ti, Zr, Ta and Hf as shown in some of Table 1-1 to Table 25-3 was prepared in an amount of 300 ton, 120 ton or 60 ton by the blast furnace pig iron-converter blowing process, using a VIM or EF, and refined in an LF unit having an arc reheating unit and capable of blowing Ar. At least one of the elements Ti, Zr, Ta and Hf was added to the molten steel in amounts as shown in the table 10 minutes before completion of refining, and the molten steel was continuously cast to obtain a slab. The slab thus obtained was hot rolled to give a plate 50 mm thick and a sheet 12 mm thick, or the slab was worked to give a round billet which was hot extruded to give a tube having an outer diameter of 74 mm and a thickness of 10 mm or which was seamless rolled to give a pipe having an outer diameter of 380 mm and a thickness of 50 mm. The sheet was formed, and electric welded to give an electric welded steel tube having an outer diameter of 280 mm and a thickness of 12 mm.

All the plates, sheets and tubes thus obtained were solution treated at 1,100° C. for 1 hour, subjected to a temporary cooling stop at a temperature of 950° to 1,000° C. and held at that temperature for 5 to 60 minutes in the furnace, air cooled, and tempered at 780° C. for 1 hour.

The plates and sheets thus obtained were subjected to edge preparation exactly in the same manner as shown in FIG. 1. A groove which was the same as in FIG. 1 was formed in each of the tubes thus obtained at the edge in the circumferential direction. The worked plates and sheets were welded and the worked tubes were subjected to circular joint welding, by TIG arc welding or SAW welding. All the welded portions were locally subjected to softening annealing (PWHT) by heating them at 740° C. for 6 hours.

Figure 9A:
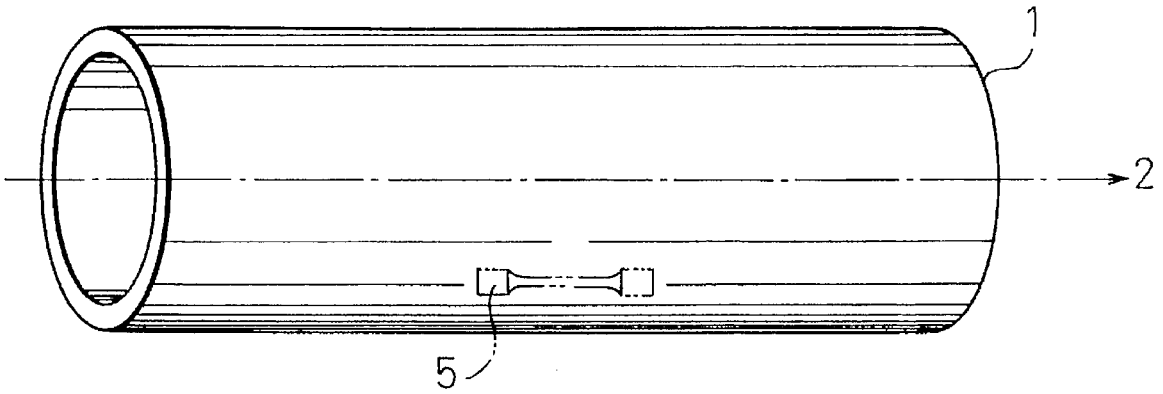
FIG. 9(*a*) and FIG. 9(*b*) are views showing a procedure for sampling a creep rupture strength test piece from a steel tube and a procedure therefor from a plate or sheet, respectively.
Figure 9B:
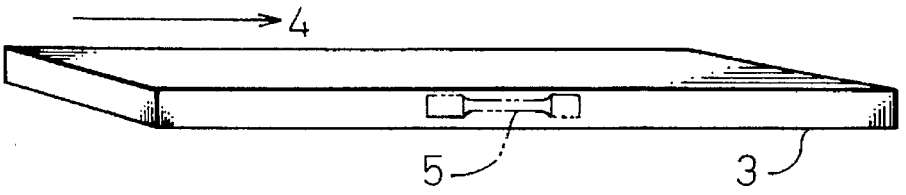
Figure 10A:
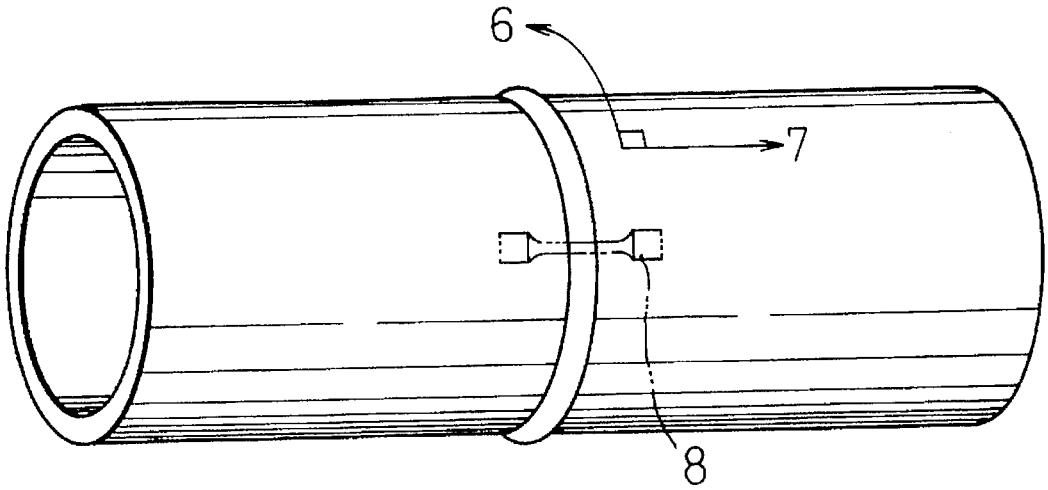
FIG. 10(*a*) and FIG. 10(*b*) are views showing a procedure for sampling a creep rupture test piece from a weld zone of a steel tube and a procedure therefor from a weld zone of a plate or sheet, respectively.
Figure 10B:
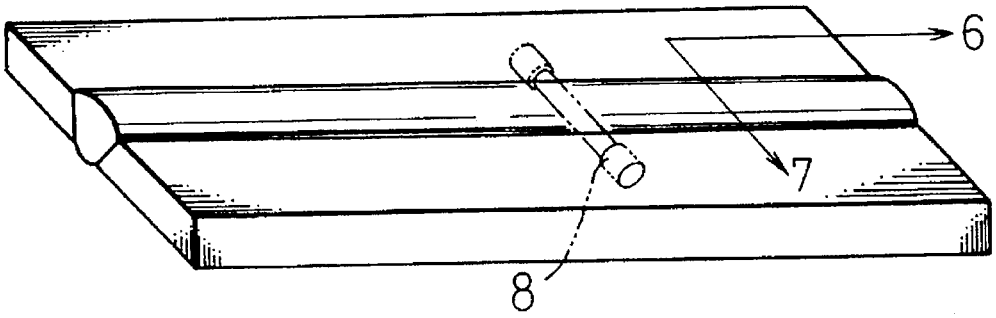

The creep characteristics of the base steels were obtained as follows: a creep test piece 5 having a diameter of 6 mm was cut out of a portion other than a weld zone and a weld HAZ in a steel tube 1 in the direction parallel to the tube axis direction 2 as shown in FIG. 9(*a*), or a creep test piece 5 of the same size was cut out of the same portion as mentioned above in a plate 3 in the direction parallel to the rolling direction 4 as shown in FIG. 9(*b*); a creep rupture strength was measured at 600° C. on the test piece, and the data thus obtained were linearly extrapolated to obtain a creep rupture strength for 100,000 hours. The creep characteristics of a weld zone was obtained as follows: a creep rupture test piece 8 having a diameter of 6 mm was cut out of each of the welded tubes or plates in a direction 7 normal to a weld line 6 as shown in FIG. 10(*a*) or FIG. 10(*b*); the results of measuring creep rupture strength at 600° C. were linearly extrapolated to 100,000 hours. The creep characteristics thus obtained were compared with those of the base steels and evaluated. For convenience of description in the present invention, a "creep rupture strength" (HAZCRS (MPa)) signifies a creep rupture strength at 600° C. for 100,000 hours estimated by linear extrapolation. A difference between the creep rupture strength of a base steel and that of a weld HAZ (D–CRS (MPa)) was used as an index of the "HAZ-softening" resistance of a weld zone. Although the value of D–CRS is somewhat influenced by the method of sampling a creep rupture test piece in the rolling direction of a sample, it has been empirically found by a preliminary experiment that the influence is within 5 MPa. Accordingly, a D–CRS value of up to 10 MPa signifies that the HAZ-softening resistance of the steel material is extremely good.

Test pieces for precipitates of a HAZ portion were sampled by the procedure as shown in FIG. 2, and subjected to extraction-residue analysis by acid dissolution to identify $M_{23}C_6$, followed by determining the composition in M by a scanning type micro X-ray analysis apparatus. Ti %+Zr %+Ta %+Hf % thus obtained were represented by M %, and the precipitates were evaluated. The standard reference based on the experimental results is defined to be from 5 to 65%.

The values of D–CRS, HAZCRS and M % were shown in Table 1-3, Table 2-3 to Table 25-3 in the form of numerical data together with chemical components.

It is evident from the tables that the steels of the present invention No. 1 to No. 381 exhibited the maximum value of D–CRS of 7 MPa, the maximum value of HAZCRS of 180 MPa and the minimum value of HAZCRS of 130 MPa. Accordingly, the HAZ-softening resistance of the steels of the invention was extremely good.

For comparison, steels which did not correspond to any of the claims of the present invention were evaluated in the same manner. The chemical components and the values of D–CRS, HAZCRS and M % among the evaluation results are shown in Table 26-1 to Table 26-2.

Experimental results about comparative steels in Table 26-1 to Table 26-2 are as described below. Though No. 721 steel and No. 722 steel had the same chemical components as the steel of the invention, Ti and Zr were added at the time of melting. As a result, the value of M % became up to 5%, and the HAZ-softening resistance deteriorated. In No. 723 steel and No. 724 steel, Ti, Zr, Ta and Hf were not sufficiently added. As a result, M % became low, and the HAZ-softening resistance deteriorated. No. 725 steel, No. 726 steel, No. 727 steel and No. 728 steel were instances wherein a number of coarse MX type carbides were precipitated, composition control of $M_{23}C_6$ in the weld HAZ could not be achieved, and as a result the HAZ-softening resistance deteriorated, due to excessive addition of Ti in the case of No. 725 steel, excessive addition of Zr in the case of No. 726 steel, excessive addition of Ta in the case of No. 727 steel and excessive addition of Hf in the case of No. 728 steel. Since a temporary cooling stop was not practiced after solution treatment in the production of No. 729 steel, composition control of $M_{23}C_6$ therein could not be achieved, and the HAZ-softening resistance deteriorated. In the production of No. 730 steel, since the holding time was 240 minutes which was overly long after solution treatment and the temporary cooling stop, the precipitates therein were coarsened, and composition control of $M_{23}C_6$ could not be achieved. As a result, the HAZ-softening resistance deteriorated.

TABLE 1-1

STEEL OF INVENTION

| No. | C | Si | Mn | Cr | Mo | W | V | Nb | (Mass. %) N |
|---|---|---|---|---|---|---|---|---|---|
| 1 | 0.26 | 0.24 | 0.46 | 16.73 | 0.753 | 1.88 | 0.69 | 0.33 | 0.17 |
| 2 | 0.24 | 0.63 | 0.68 | 16.40 | 0.126 | 0.92 | 0.44 | 0.44 | 0.03 |
| 3 | 0.05 | 0.30 | 0.69 | 15.19 | 0.120 | 2.65 | 0.68 | 0.40 | 0.21 |
| 4 | 0.06 | 0.29 | 0.79 | 11.23 | 0.082 | 1.57 | 0.26 | 0.11 | 0.20 |
| 5 | 0.10 | 0.48 | 0.84 | 8.84 | 0.841 | 2.08 | 0.50 | 0.49 | 0.08 |
| 6 | 0.25 | 0.74 | 0.70 | 12.33 | 0.250 | 0.38 | 0.26 | 0.48 | 0.05 |
| 7 | 0.18 | 0.16 | 0.25 | 13.11 | 0.128 | 2.48 | 0.35 | 0.47 | 0.07 |
| 8 | 0.14 | 0.56 | 0.55 | 15.41 | 0.301 | 2.87 | 0.60 | 0.15 | 0.10 |
| 9 | 0.06 | 0.24 | 0.67 | 17.20 | 0.625 | 2.72 | 0.87 | 0.41 | 0.10 |
| 10 | 0.20 | 0.27 | 0.47 | 9.83 | 0.427 | 1.44 | 0.50 | 0.44 | 0.15 |

TABLE 1-2

STEEL OF INVENTION

| No. | Ti | Zr | Ta | Hf | Co | Ni | (Mass. %) Cu |
|---|---|---|---|---|---|---|---|
| 1 | 1.790 | — | — | — | — | — | — |
| 2 | 1.816 | — | — | — | — | — | — |
| 3 | 0.952 | — | — | — | — | — | — |
| 4 | 0.843 | — | — | — | — | — | — |
| 5 | 1.168 | — | — | — | — | — | — |
| 6 | 1.617 | — | — | — | — | — | — |
| 7 | — | 1.597 | — | — | — | — | — |
| 8 | — | 1.940 | — | — | — | — | — |
| 9 | — | 0.310 | — | — | — | — | — |
| 10 | — | 1.352 | — | — | — | — | — |

TABLE 1-3

STEEL OF INVENTION

| No. | P | S | O | D-CRS | HAZCRS | (Mass. %) M % |
|---|---|---|---|---|---|---|
| 1 | 0.0259 | 0.002 | 0.012 | 2 | 170 | 19 |
| 2 | 0.0013 | 0.002 | 0.003 | 2 | 135 | 26 |
| 3 | 0.0239 | 0.005 | 0.003 | 3 | 164 | 18 |
| 4 | 0.0151 | 0.004 | 0.018 | 4 | 133 | 15 |
| 5 | 0.0287 | 0.003 | 0.007 | 0 | 172 | 19 |
| 6 | 0.0155 | 0.008 | 0.015 | 1 | 158 | 24 |
| 7 | 0.0003 | 0.002 | 0.019 | 2 | 168 | 20 |
| 8 | 0.0229 | 0.003 | 0.006 | 1 | 180 | 20 |
| 9 | 0.0190 | 0.003 | 0.012 | 1 | 171 | 16 |
| 10 | 0.0280 | 0.004 | 0.014 | 2 | 171 | 20 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 2-1

STEEL OF INVENTION

| No. | C | Si | Mn | Cr | Mo | W | V | Nb | (Mass. %) N |
|---|---|---|---|---|---|---|---|---|---|
| 11 | 0.22 | 0.49 | 0.64 | 17.23 | 0.050 | 3.46 | 0.30 | 0.41 | 0.21 |
| 12 | 0.22 | 0.41 | 0.63 | 17.66 | 0.814 | 3.30 | 0.13 | 0.48 | 0.24 |
| 13 | 0.15 | 0.28 | 0.32 | 15.59 | 0.078 | 2.05 | 0.79 | 0.07 | 0.09 |
| 14 | 0.10 | 0.75 | 0.78 | 8.84 | 0.157 | 0.82 | 0.17 | 0.09 | 0.19 |
| 15 | 0.17 | 0.52 | 0.67 | 14.68 | 0.395 | 2.36 | 0.55 | 0.47 | 0.15 |
| 16 | 0.18 | 0.26 | 0.26 | 5.12 | 0.130 | 1.20 | 0.31 | 0.37 | 0.04 |

TABLE 2-1-continued

STEEL OF INVENTION

| No. | C | Si | Mn | Cr | Mo | W | V | Nb | (Mass. %) N |
|---|---|---|---|---|---|---|---|---|---|
| 17 | 0.07 | 0.21 | 0.22 | 10.58 | 0.199 | 1.75 | 0.27 | 0.46 | 0.19 |
| 18 | 0.22 | 0.64 | 0.42 | 9.12 | 0.924 | 3.43 | 0.74 | 0.17 | 0.19 |
| 19 | 0.17 | 0.64 | 0.73 | 11.97 | 0.665 | 0.80 | 0.11 | 0.15 | 0.13 |
| 20 | 0.15 | 0.10 | 0.63 | 16.90 | 0.246 | 3.19 | 0.18 | 0.32 | 0.09 |
| 21 | 0.25 | 0.03 | 0.36 | 15.00 | 0.487 | 1.78 | 0.76 | 0.35 | 0.15 |
| 22 | 0.15 | 0.32 | 0.21 | 17.52 | 0.755 | 2.72 | 0.26 | 0.18 | 0.02 |
| 23 | 0.07 | 0.46 | 0.84 | 15.56 | 0.858 | 0.42 | 0.45 | 0.44 | 0.04 |
| 24 | 0.13 | 0.31 | 0.93 | 7.19 | 0.653 | 2.65 | 0.21 | 0.33 | 0.15 |
| 25 | 0.13 | 0.53 | 0.34 | 16.17 | 0.961 | 0.58 | 0.34 | 0.24 | 0.09 |
| 26 | 0.15 | 0.57 | 0.92 | 14.13 | 0.114 | 0.25 | 0.18 | 0.35 | 0.16 |
| 27 | 0.02 | 0.74 | 0.08 | 12.43 | 0.972 | 1.21 | 0.10 | 0.35 | 0.22 |
| 28 | 0.13 | 0.50 | 0.76 | 8.64 | 0.356 | 2.86 | 0.41 | 0.38 | 0.22 |
| 29 | 0.12 | 0.51 | 0.94 | 7.18 | 0.102 | 1.35 | 0.44 | 0.36 | 0.25 |
| 30 | 0.10 | 0.24 | 0.59 | 12.46 | 0.044 | 2.76 | 0.54 | 0.23 | 0.02 |
| 31 | 0.03 | 0.73 | 0.37 | 15.70 | 0.017 | 1.57 | 0.54 | 0.13 | 0.09 |
| 32 | 0.28 | 0.31 | 0.95 | 8.42 | 0.864 | 2.23 | 0.29 | 0.25 | 0.19 |
| 33 | 0.24 | 0.40 | 0.20 | 7.98 | 0.920 | 2.52 | 0.60 | 0.24 | 0.15 |
| 34 | 0.14 | 0.09 | 0.79 | 5.65 | 0.518 | 1.92 | 0.34 | 0.04 | 0.18 |
| 35 | 0.23 | 0.43 | 1.00 | 12.41 | 0.496 | 3.17 | 0.80 | 0.04 | 0.12 |
| 36 | 0.17 | 0.50 | 0.68 | 13.01 | 0.682 | 2.41 | 0.85 | 0.17 | 0.17 |
| 37 | 0.05 | 0.57 | 0.50 | 11.87 | 0.915 | 2.43 | 0.81 | 0.36 | 0.16 |
| 38 | 0.27 | 0.13 | 0.34 | 13.42 | 0.051 | 2.69 | 0.55 | 0.02 | 0.06 |
| 39 | 0.05 | 0.21 | 0.87 | 8.96 | 0.896 | 2.65 | 0.86 | 0.06 | 0.07 |
| 40 | 0.21 | 0.29 | 0.75 | 9.27 | 0.298 | 3.37 | 0.10 | 0.16 | 0.04 |

TABLE 2-2

STEEL OF INVENTION

| No. | Ti | Zr | Ta | Hf | Co | Ni | (Mass. %) Cu |
|---|---|---|---|---|---|---|---|
| 11 | — | 1.738 | — | — | — | — | — |
| 12 | — | 1.155 | — | — | — | — | — |
| 13 | 0.139 | 1.257 | — | — | — | — | — |
| 14 | 1.612 | 1.716 | — | — | — | — | — |
| 15 | 1.252 | 0.233 | — | — | — | — | — |
| 16 | 1.732 | 0.455 | — | — | — | — | — |
| 17 | 1.697 | 0.052 | — | — | — | — | — |
| 18 | 0.825 | 1.705 | — | — | — | — | — |
| 19 | — | — | 0.095 | — | — | — | — |
| 20 | — | — | 0.340 | — | — | — | — |
| 21 | — | — | 0.989 | — | — | — | — |
| 22 | — | — | 0.779 | — | — | — | — |
| 23 | — | — | 1.339 | — | — | — | — |
| 24 | — | — | 0.354 | — | — | — | — |
| 25 | 0.981 | — | 0.498 | — | — | — | — |
| 26 | 1.649 | — | 1.420 | — | — | — | — |
| 27 | 0.561 | — | 1.818 | — | — | — | — |
| 28 | 1.351 | — | 1.373 | — | — | — | — |
| 29 | 1.702 | — | 1.729 | — | — | — | — |
| 30 | 1.288 | — | 1.569 | — | — | — | — |
| 31 | — | 0.689 | 0.535 | — | — | — | — |
| 32 | — | 1.635 | 1.354 | — | — | — | — |
| 33 | — | 0.709 | 0.668 | — | — | — | — |
| 34 | — | 1.582 | 1.156 | — | — | — | — |
| 35 | — | 1.931 | 0.482 | — | — | — | — |
| 36 | — | 1.429 | 0.321 | — | — | — | — |
| 37 | 1.355 | 1.736 | 1.335 | — | — | — | — |
| 38 | 1.996 | 1.543 | 0.220 | — | — | — | — |
| 39 | 0.922 | 0.512 | 0.631 | — | — | — | — |
| 40 | 1.786 | 1.310 | 0.238 | — | — | — | — |

TABLE 2-3

STEEL OF INVENTION

| No. | P | S | O | D-CRS | HAZCRS | (Mass. %) M % |
|---|---|---|---|---|---|---|
| 11 | 0.0156 | 0.009 | 0.009 | 1 | 156 | 25 |
| 12 | 0.0214 | 0.008 | 0.014 | 5 | 154 | 16 |
| 13 | 0.0106 | 0.008 | 0.015 | 5 | 143 | 22 |
| 14 | 0.0232 | 0.003 | 0.019 | 4 | 175 | 34 |
| 15 | 0.0246 | 0.001 | 0.013 | 1 | 179 | 18 |
| 16 | 0.0248 | 0.005 | 0.004 | 2 | 156 | 31 |
| 17 | 0.0037 | 0.004 | 0.016 | 5 | 135 | 20 |
| 18 | 0.0163 | 0.001 | 0.010 | 5 | 144 | 26 |
| 19 | 0.0278 | 0.005 | 0.020 | 2 | 135 | 8 |
| 20 | 0.0183 | 0.003 | 0.004 | 5 | 136 | 8 |
| 21 | 0.0129 | 0.009 | 0.007 | 6 | 150 | 14 |
| 22 | 0.0218 | 0.007 | 0.007 | 4 | 154 | 12 |
| 23 | 0.0247 | 0.010 | 0.001 | 4 | 177 | 20 |
| 24 | 0.0023 | 0.002 | 0.014 | 2 | 170 | 10 |
| 25 | 0.0090 | 0.004 | 0.006 | 0 | 162 | 17 |
| 26 | 0.0251 | 0.007 | 0.010 | 4 | 155 | 37 |
| 27 | 0.0161 | 0.004 | 0.015 | 3 | 152 | 26 |
| 28 | 0.0067 | 0.006 | 0.007 | 6 | 131 | 35 |
| 29 | 0.0219 | 0.009 | 0.013 | 0 | 145 | 38 |
| 30 | 0.0264 | 0.001 | 0.009 | 7 | 146 | 30 |
| 31 | 0.0163 | 0.004 | 0.012 | 6 | 162 | 17 |
| 32 | 0.0160 | 0.003 | 0.019 | 2 | 146 | 28 |
| 33 | 0.0207 | 0.009 | 0.008 | 2 | 175 | 24 |
| 34 | 0.0255 | 0.008 | 0.014 | 3 | 178 | 26 |
| 35 | 0.0107 | 0.007 | 0.004 | 0 | 131 | 27 |
| 36 | 0.0157 | 0.005 | 0.004 | 2 | 164 | 21 |
| 37 | 0.0061 | 0.009 | 0.012 | 4 | 177 | 41 |
| 38 | 0.0221 | 0.008 | 0.014 | 2 | 150 | 34 |
| 39 | 0.0284 | 0.002 | 0.008 | 1 | 135 | 29 |
| 40 | 0.0056 | 0.003 | 0.019 | 5 | 159 | 32 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M % : Value of (Ti % + Zr % + Ta % + Hf %) in M of $M_{23}C_6$ type carbides in a weld heat-affected zone

TABLE 3-1

STEEL OF INVENTION

| No. | C | Si | Mn | Cr | Mo | W | V | Nb | (Mass. %) N |
|---|---|---|---|---|---|---|---|---|---|
| 41 | 0.27 | 0.25 | 0.24 | 12.41 | 0.100 | 1.06 | 0.10 | 0.22 | 0.03 |
| 42 | 0.05 | 0.35 | 0.43 | 16.05 | 0.123 | 1.77 | 0.19 | 0.18 | 0.01 |
| 43 | 0.06 | 0.46 | 0.38 | 11.75 | 0.713 | 1.63 | 0.70 | 0.44 | 0.07 |
| 44 | 0.26 | 0.45 | 0.74 | 10.09 | 0.699 | 1.78 | 0.50 | 0.19 | 0.15 |
| 45 | 0.18 | 0.20 | 0.21 | 15.83 | 0.436 | 1.69 | 0.40 | 0.08 | 0.12 |
| 46 | 0.05 | 0.36 | 0.65 | 13.54 | 0.736 | 2.41 | 0.24 | 0.26 | 0.15 |
| 47 | 0.26 | 0.40 | 0.31 | 7.68 | 0.945 | 1.81 | 0.84 | 0.20 | 0.10 |
| 48 | 0.04 | 0.60 | 0.69 | 15.73 | 0.411 | 0.98 | 0.58 | 0.27 | 0.17 |
| 49 | 0.21 | 0.05 | 0.43 | 9.45 | 0.950 | 1.03 | 0.26 | 0.41 | 0.19 |
| 50 | 0.15 | 0.17 | 0.21 | 12.60 | 0.411 | 3.05 | 0.23 | 0.30 | 0.25 |
| 51 | 0.09 | 0.45 | 0.71 | 16.81 | 0.629 | 3.25 | 0.81 | 0.08 | 0.06 |
| 52 | 0.13 | 0.37 | 0.58 | 13.24 | 0.932 | 1.02 | 0.36 | 0.43 | 0.08 |
| 53 | 0.09 | 0.19 | 0.50 | 6.30 | 0.161 | 2.45 | 0.68 | 0.02 | 0.24 |
| 54 | 0.19 | 0.17 | 0.72 | 13.28 | 0.645 | 0.39 | 0.15 | 0.01 | 0.17 |
| 55 | 0.26 | 0.59 | 0.34 | 6.17 | 0.724 | 0.89 | 0.07 | 0.08 | 0.06 |
| 56 | 0.23 | 0.12 | 0.41 | 8.81 | 0.740 | 1.79 | 0.78 | 0.13 | 0.23 |
| 57 | 0.22 | 0.21 | 0.89 | 12.55 | 0.029 | 2.54 | 0.64 | 0.10 | 0.16 |
| 58 | 0.17 | 0.74 | 0.97 | 15.27 | 0.420 | 0.94 | 0.48 | 0.15 | 0.17 |
| 59 | 0.18 | 0.79 | 0.41 | 8.33 | 0.251 | 1.40 | 0.61 | 0.19 | 0.22 |
| 60 | 0.20 | 0.64 | 0.57 | 9.10 | 0.855 | 3.36 | 0.89 | 0.39 | 0.04 |
| 61 | 0.19 | 0.52 | 0.93 | 8.94 | 0.576 | 1.37 | 0.17 | 0.18 | 0.06 |
| 62 | 0.09 | 0.72 | 0.55 | 5.73 | 0.246 | 1.46 | 0.74 | 0.22 | 0.12 |
| 63 | 0.01 | 0.32 | 0.91 | 10.33 | 0.696 | 3.09 | 0.96 | 0.42 | 0.07 |
| 64 | 0.04 | 0.37 | 0.28 | 7.70 | 0.776 | 2.45 | 0.69 | 0.22 | 0.10 |
| 65 | 0.14 | 0.73 | 0.52 | 8.57 | 0.808 | 2.26 | 0.24 | 0.26 | 0.06 |
| 66 | 0.11 | 0.50 | 0.29 | 10.86 | 0.136 | 1.99 | 0.94 | 0.23 | 0.03 |
| 67 | 0.04 | 0.33 | 0.68 | 5.87 | 0.583 | 2.73 | 0.64 | 0.04 | 0.20 |

TABLE 3-1-continued

STEEL OF INVENTION

| No. | C | Si | Mn | Cr | Mo | W | V | Nb | (Mass. %) N |
|---|---|---|---|---|---|---|---|---|---|
| 68 | 0.19 | 0.49 | 0.74 | 17.63 | 0.505 | 0.69 | 0.67 | 0.34 | 0.18 |
| 69 | 0.07 | 0.06 | 0.75 | 17.85 | 0.223 | 1.86 | 0.86 | 0.08 | 0.05 |
| 70 | 0.20 | 0.46 | 0.56 | 17.30 | 0.563 | 2.43 | 0.56 | 0.16 | 0.24 |

TABLE 3-2

STEEL OF INVENTION

| No. | Ti | Zr | Ta | Hf | Co | Ni | (Mass. %) Cu |
|---|---|---|---|---|---|---|---|
| 41 | 1.270 | 0.627 | 0.732 | — | — | — | — |
| 42 | 1.055 | 0.131 | 0.780 | — | — | — | — |
| 43 | — | — | — | 1.282 | — | — | — |
| 44 | — | — | — | 1.087 | — | — | — |
| 45 | — | — | — | 1.833 | — | — | — |
| 46 | — | — | — | 1.168 | — | — | — |
| 47 | — | — | — | 1.763 | — | — | — |
| 48 | — | — | — | 0.323 | — | — | — |
| 49 | 0.239 | — | — | 0.471 | — | — | — |
| 50 | 0.589 | — | — | 0.930 | — | — | — |
| 51 | 0.276 | — | — | 0.342 | — | — | — |
| 52 | 1.979 | — | — | 1.398 | — | — | — |
| 53 | 0.346 | — | — | 1.758 | — | — | — |
| 54 | 0.098 | — | — | 0.098 | — | — | — |
| 55 | — | 1.453 | — | 1.079 | — | — | — |
| 56 | — | 1.997 | — | 0.375 | — | — | — |
| 57 | — | 1.774 | — | 0.651 | — | — | — |
| 58 | — | 0.499 | — | 0.599 | — | — | — |
| 59 | — | 1.816 | — | 1.869 | — | — | — |
| 60 | — | 1.395 | — | 1.144 | — | — | — |
| 61 | — | — | 1.682 | 1.102 | — | — | — |
| 62 | — | — | 1.723 | 0.420 | — | — | — |
| 63 | — | — | 1.419 | 1.755 | — | — | — |
| 64 | — | — | 1.434 | 0.781 | — | — | — |
| 65 | — | — | 0.457 | 0.180 | — | — | — |
| 66 | — | — | 1.131 | 1.596 | — | — | — |
| 67 | — | 1.565 | 0.174 | 0.751 | — | — | — |
| 68 | — | 0.516 | 1.211 | 0.262 | — | — | — |
| 69 | — | 1.779 | 1.935 | 1.829 | — | — | — |
| 70 | — | 0.041 | 1.021 | 0.130 | — | — | — |

TABLE 3-3

STEEL OF INVENTION

| No. | P | S | O | D-CRS | HAZCRS | (Mass. %) M % |
|---|---|---|---|---|---|---|
| 41 | 0.0084 | 0.008 | 0.004 | 4 | 176 | 26 |
| 42 | 0.0168 | 0.003 | 0.002 | 2 | 163 | 23 |
| 43 | 0.0111 | 0.010 | 0.006 | 4 | 173 | 24 |
| 44 | 0.0161 | 0.002 | 0.006 | 1 | 133 | 19 |
| 45 | 0.0272 | 0.003 | 0.006 | 1 | 172 | 23 |
| 46 | 0.0091 | 0.002 | 0.005 | 0 | 142 | 22 |
| 47 | 0.0023 | 0.010 | 0.008 | 7 | 170 | 27 |
| 48 | 0.0016 | 0.007 | 0.003 | 1 | 160 | 10 |
| 49 | 0.0170 | 0.003 | 0.006 | 6 | 140 | 15 |
| 50 | 0.0142 | 0.003 | 0.004 | 4 | 136 | 17 |
| 51 | 0.0175 | 0.003 | 0.003 | 0 | 177 | 15 |
| 52 | 0.0076 | 0.005 | 0.011 | 0 | 166 | 35 |
| 53 | 0.0093 | 0.007 | 0.004 | 0 | 179 | 25 |
| 54 | 0.0026 | 0.004 | 0.009 | 2 | 171 | 7 |
| 55 | 0.0275 | 0.007 | 0.012 | 1 | 168 | 26 |
| 56 | 0.0193 | 0.003 | 0.011 | 3 | 149 | 29 |
| 57 | 0.0179 | 0.002 | 0.002 | 1 | 141 | 26 |
| 58 | 0.0034 | 0.003 | 0.020 | 2 | 171 | 16 |
| 59 | 0.0158 | 0.005 | 0.005 | 3 | 169 | 33 |
| 60 | 0.0205 | 0.002 | 0.001 | 6 | 160 | 32 |

TABLE 3-3-continued

STEEL OF INVENTION

| No. | P | S | O | D-CRS | HAZCRS | (Mass. %) M % |
|---|---|---|---|---|---|---|
| 61 | 0.0272 | 0.005 | 0.016 | 7 | 174 | 31 |
| 62 | 0.0167 | 0.005 | 0.017 | 4 | 162 | 28 |
| 63 | 0.0132 | 0.005 | 0.020 | 6 | 178 | 34 |
| 64 | 0.0122 | 0.002 | 0.003 | 6 | 149 | 31 |
| 65 | 0.0088 | 0.009 | 0.019 | 2 | 178 | 15 |
| 66 | 0.0128 | 0.002 | 0.020 | 7 | 168 | 30 |
| 67 | 0.0196 | 0.006 | 0.019 | 6 | 147 | 25 |
| 68 | 0.0090 | 0.003 | 0.005 | 5 | 142 | 26 |
| 69 | 0.0065 | 0.008 | 0.003 | 6 | 130 | 52 |
| 70 | 0.0216 | 0.002 | 0.009 | 1 | 141 | 23 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 4-1

STEEL OF INVENTION

| No. | C | Si | Mn | Cr | Mo | W | V | Nb | (Mass. %) N |
|---|---|---|---|---|---|---|---|---|---|
| 71 | 0.12 | 0.04 | 0.47 | 14.15 | 0.389 | 1.88 | 0.59 | 0.25 | 0.25 |
| 72 | 0.06 | 0.58 | 0.71 | 12.41 | 0.506 | 1.27 | 0.79 | 0.02 | 0.02 |
| 73 | 0.26 | 0.03 | 0.80 | 16.86 | 0.283 | 1.78 | 0.03 | 0.14 | 0.13 |
| 74 | 0.10 | 0.21 | 0.56 | 12.06 | 0.531 | 2.80 | 0.59 | 0.03 | 0.05 |
| 75 | 0.25 | 0.60 | 0.29 | 9.07 | 0.105 | 0.55 | 0.35 | 0.34 | 0.22 |
| 76 | 0.09 | 0.29 | 0.25 | 12.17 | 0.327 | 2.70 | 0.62 | 0.26 | 0.24 |
| 77 | 0.29 | 0.70 | 0.30 | 12.77 | 0.044 | 0.48 | 0.26 | 0.45 | 0.08 |
| 78 | 0.08 | 0.55 | 0.72 | 15.14 | 0.576 | 1.57 | 0.57 | 0.08 | 0.05 |
| 79 | 0.29 | 0.10 | 0.58 | 10.74 | 0.275 | 0.50 | 0.91 | 0.31 | 0.24 |
| 80 | 0.28 | 0.77 | 0.53 | 16.79 | 0.957 | 1.65 | 0.13 | 0.31 | 0.12 |
| 81 | 0.30 | 0.10 | 0.45 | 11.82 | 0.476 | 1.20 | 0.04 | 0.01 | 0.13 |
| 82 | 0.15 | 0.69 | 0.62 | 6.58 | 0.663 | 0.27 | 0.47 | 0.31 | 0.12 |
| 83 | 0.08 | 0.46 | 0.89 | 11.99 | 0.845 | 1.58 | 0.77 | 0.38 | 0.05 |
| 84 | 0.19 | 0.45 | 0.74 | 12.88 | 0.373 | 1.33 | 0.29 | 0.41 | 0.24 |
| 85 | 0.28 | 0.15 | 0.43 | 7.25 | 0.577 | 0.62 | 0.35 | 0.30 | 0.04 |
| 86 | 0.16 | 0.22 | 0.65 | 12.39 | 0.792 | 2.21 | 0.29 | 0.22 | 0.15 |
| 87 | 0.08 | 0.12 | 0.84 | 13.14 | 0.855 | 2.25 | 0.93 | 0.34 | 0.15 |
| 88 | 0.12 | 0.13 | 0.90 | 13.94 | 0.605 | 1.85 | 0.15 | 0.32 | 0.02 |
| 89 | 0.25 | 0.11 | 0.66 | 12.44 | 0.861 | 0.44 | 0.72 | 0.10 | 0.18 |
| 90 | 0.12 | 0.34 | 0.43 | 13.31 | 0.983 | 2.49 | 0.05 | 0.31 | 0.12 |
| 91 | 0.26 | 0.27 | 0.44 | 7.63 | 0.289 | 2.44 | 0.40 | 0.16 | 0.17 |
| 92 | 0.21 | 0.19 | 0.59 | 13.01 | 0.619 | 3.10 | 0.66 | 0.29 | 0.04 |
| 93 | 0.04 | 0.74 | 0.33 | 14.16 | 0.316 | 0.61 | 0.16 | 0.37 | 0.05 |
| 94 | 0.01 | 0.63 | 0.33 | 15.50 | 0.214 | 2.69 | 0.70 | 0.34 | 0.05 |
| 95 | 0.21 | 0.11 | 0.47 | 8.31 | 0.632 | 0.49 | 0.16 | 0.09 | 0.11 |
| 96 | 0.16 | 0.61 | 0.60 | 16.59 | 0.924 | 1.80 | 0.34 | 0.06 | 0.08 |
| 97 | 0.25 | 0.07 | 0.21 | 5.61 | 0.424 | 1.06 | 0.59 | 0.14 | 0.03 |
| 98 | 0.28 | 0.30 | 0.36 | 5.85 | 0.466 | 2.76 | 0.28 | 0.03 | 0.05 |
| 99 | 0.21 | 0.80 | 0.53 | 8.72 | 0.893 | 1.38 | 0.69 | 0.38 | 0.21 |
| 100 | 0.27 | 0.64 | 0.97 | 11.99 | 0.537 | 2.95 | 0.20 | 0.37 | 0.12 |

TABLE 4-2

STEEL OF INVENTION

| No. | Ti | Zr | Ta | Hf | Co | Ni | (Mass. %) Cu |
|---|---|---|---|---|---|---|---|
| 71 | — | 0.959 | 0.136 | 0.829 | — | — | — |
| 72 | — | 0.207 | 1.931 | 0.576 | — | — | — |
| 73 | 1.690 | — | 0.124 | 1.077 | — | — | — |
| 74 | 1.669 | — | 1.346 | 1.982 | — | — | — |
| 75 | 1.132 | — | 0.292 | 0.976 | — | — | — |
| 76 | 0.733 | — | 1.636 | 0.741 | — | — | — |

TABLE 4-2-continued

STEEL OF INVENTION

| No. | Ti | Zr | Ta | Hf | Co | Ni | (Mass. %) Cu |
|---|---|---|---|---|---|---|---|
| 77 | 1.144 | — | 1.047 | 0.932 | — | — | — |
| 78 | 1.047 | — | 0.175 | 1.207 | — | — | — |
| 79 | 1.103 | 1.777 | — | 0.273 | — | — | — |
| 80 | 1.962 | 1.910 | — | 1.785 | — | — | — |
| 81 | 1.337 | 1.417 | — | 0.404 | — | — | — |
| 82 | 0.868 | 0.962 | — | 0.806 | — | — | — |
| 83 | 1.253 | 0.256 | — | 0.676 | — | — | — |
| 84 | 1.139 | 0.928 | — | 1.675 | — | — | — |
| 85 | 0.236 | 0.671 | 0.100 | 0.467 | — | — | — |
| 86 | 1.171 | 0.156 | 0.291 | 0.738 | — | — | — |
| 87 | 0.654 | 0.051 | 0.247 | 1.156 | — | — | — |
| 88 | 1.329 | 1.029 | 0.669 | 0.394 | — | — | — |
| 89 | 0.872 | 1.763 | 0.209 | 0.132 | — | — | — |
| 90 | 1.956 | 1.935 | 1.548 | 1.028 | — | — | — |
| 91 | 1.262 | — | — | — | 0.63 | — | — |
| 92 | 1.455 | — | — | — | 4.01 | — | — |
| 93 | 1.218 | — | — | — | 3.88 | — | — |
| 94 | 0.200 | — | — | — | 1.89 | — | — |
| 95 | 0.077 | — | — | — | 2.04 | — | — |
| 96 | 1.534 | — | — | — | 1.15 | — | — |
| 97 | — | 1.537 | — | — | 3.24 | — | — |
| 98 | — | 0.293 | — | — | 2.57 | — | — |
| 99 | — | 0.537 | — | — | 3.35 | — | — |
| 100 | — | 0.912 | — | — | 2.34 | — | — |

TABLE 4-3

STEEL OF INVENTION

| No. | P | S | O | D-CRS | HAZCRS | (Mass. %) M % |
|---|---|---|---|---|---|---|
| 71 | 0.0049 | 0.001 | 0.012 | 7 | 150 | 23 |
| 72 | 0.0109 | 0.005 | 0.008 | 0 | 137 | 33 |
| 73 | 0.0202 | 0.006 | 0.013 | 6 | 179 | 35 |
| 74 | 0.0126 | 0.005 | 0.004 | 4 | 154 | 49 |
| 75 | 0.0286 | 0.003 | 0.008 | 4 | 138 | 30 |
| 76 | 0.0031 | 0.003 | 0.002 | 6 | 136 | 38 |
| 77 | 0.0058 | 0.010 | 0.002 | 1 | 149 | 29 |
| 78 | 0.0171 | 0.002 | 0.015 | 5 | 156 | 24 |
| 79 | 0.0022 | 0.002 | 0.017 | 7 | 160 | 35 |
| 80 | 0.0009 | 0.003 | 0.017 | 2 | 163 | 49 |
| 81 | 0.0081 | 0.004 | 0.019 | 2 | 142 | 30 |
| 82 | 0.0195 | 0.007 | 0.003 | 4 | 176 | 33 |
| 83 | 0.0295 | 0.008 | 0.002 | 3 | 142 | 28 |
| 84 | 0.0188 | 0.004 | 0.013 | 4 | 168 | 41 |
| 85 | 0.0119 | 0.007 | 0.006 | 3 | 131 | 22 |
| 86 | 0.0194 | 0.002 | 0.005 | 2 | 160 | 31 |
| 87 | 0.0208 | 0.002 | 0.017 | 3 | 157 | 30 |
| 88 | 0.0118 | 0.010 | 0.011 | 3 | 175 | 35 |
| 89 | 0.0024 | 0.005 | 0.001 | 2 | 167 | 37 |
| 90 | 0.0171 | 0.010 | 0.005 | 1 | 135 | 59 |
| 91 | 0.0213 | 0.008 | 0.018 | 5 | 157 | 17 |
| 92 | 0.0254 | 0.008 | 0.009 | 5 | 161 | 17 |
| 93 | 0.0089 | 0.008 | 0.004 | 4 | 175 | 16 |
| 94 | 0.0272 | 0.006 | 0.019 | 5 | 151 | 7 |
| 95 | 0.0007 | 0.007 | 0.002 | 7 | 167 | 8 |
| 96 | 0.0140 | 0.007 | 0.009 | 0 | 176 | 19 |
| 97 | 0.0172 | 0.002 | 0.015 | 2 | 155 | 24 |
| 98 | 0.0202 | 0.007 | 0.019 | 1 | 133 | 10 |
| 99 | 0.0036 | 0.007 | 0.009 | 2 | 161 | 12 |
| 100 | 0.0073 | 0.003 | 0.008 | 5 | 168 | 16 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 5-1

STEEL OF INVENTION

| No. | C | Si | Mn | Cr | Mo | W | V | Nb | (Mass. %) N |
|---|---|---|---|---|---|---|---|---|---|
| 101 | 0.14 | 0.08 | 0.75 | 6.87 | 0.220 | 1.96 | 0.61 | 0.40 | 0.11 |
| 102 | 0.20 | 0.19 | 0.95 | 11.03 | 0.298 | 2.89 | 0.29 | 0.41 | 0.12 |
| 103 | 0.11 | 0.04 | 0.64 | 9.24 | 0.601 | 1.85 | 0.55 | 0.05 | 0.24 |
| 104 | 0.26 | 0.67 | 0.88 | 5.76 | 0.456 | 1.61 | 0.25 | 0.01 | 0.19 |
| 105 | 0.17 | 0.39 | 0.34 | 11.41 | 0.206 | 3.27 | 0.20 | 0.18 | 0.17 |
| 106 | 0.07 | 0.27 | 0.49 | 17.82 | 0.686 | 1.33 | 0.24 | 0.48 | 0.14 |
| 107 | 0.21 | 0.53 | 0.40 | 16.09 | 0.733 | 0.25 | 0.71 | 0.11 | 0.19 |
| 108 | 0.26 | 0.30 | 0.73 | 17.14 | 0.675 | 1.06 | 0.46 | 0.19 | 0.14 |
| 109 | 0.16 | 0.59 | 0.56 | 12.45 | 0.852 | 1.59 | 0.80 | 0.43 | 0.21 |
| 110 | 0.17 | 0.12 | 0.55 | 6.22 | 0.109 | 1.35 | 0.11 | 0.23 | 0.12 |
| 111 | 0.22 | 0.72 | 0.58 | 16.08 | 0.273 | 1.42 | 0.66 | 0.01 | 0.17 |
| 112 | 0.27 | 0.29 | 0.51 | 7.19 | 0.686 | 2.91 | 0.35 | 0.43 | 0.23 |
| 113 | 0.29 | 0.68 | 0.22 | 10.02 | 0.682 | 1.98 | 0.48 | 0.43 | 0.24 |
| 114 | 0.21 | 0.18 | 0.37 | 9.45 | 0.098 | 1.38 | 0.89 | 0.41 | 0.16 |
| 115 | 0.28 | 0.22 | 0.82 | 9.57 | 0.754 | 0.54 | 0.91 | 0.04 | 0.21 |
| 116 | 0.16 | 0.68 | 0.64 | 14.96 | 0.993 | 0.59 | 0.41 | 0.23 | 0.20 |
| 117 | 0.24 | 0.26 | 0.92 | 10.54 | 0.173 | 1.03 | 0.20 | 0.17 | 0.24 |
| 118 | 0.04 | 0.79 | 0.31 | 7.23 | 0.613 | 2.93 | 0.60 | 0.26 | 0.04 |
| 119 | 0.09 | 0.57 | 0.28 | 15.69 | 0.146 | 0.81 | 0.96 | 0.18 | 0.04 |
| 120 | 0.06 | 0.27 | 0.71 | 8.04 | 0.121 | 0.75 | 0.16 | 0.09 | 0.20 |
| 121 | 0.03 | 0.13 | 0.65 | 14.25 | 0.842 | 0.46 | 0.45 | 0.40 | 0.23 |
| 122 | 0.25 | 0.02 | 0.78 | 6.38 | 0.170 | 2.77 | 0.71 | 0.29 | 0.23 |
| 123 | 0.10 | 0.22 | 0.56 | 14.90 | 0.439 | 2.21 | 0.30 | 0.18 | 0.15 |
| 124 | 0.25 | 0.22 | 0.69 | 5.34 | 0.500 | 3.21 | 0.05 | 0.24 | 0.19 |
| 125 | 0.08 | 0.66 | 0.62 | 14.29 | 0.666 | 0.21 | 0.74 | 0.13 | 0.20 |
| 126 | 0.11 | 0.23 | 0.20 | 7.25 | 0.295 | 2.62 | 0.28 | 0.26 | 0.13 |
| 127 | 0.02 | 0.77 | 0.52 | 14.51 | 0.203 | 3.28 | 0.46 | 0.07 | 0.19 |
| 128 | 0.03 | 0.58 | 0.25 | 7.90 | 0.724 | 3.29 | 0.63 | 0.21 | 0.21 |
| 129 | 0.26 | 0.71 | 0.84 | 17.89 | 0.210 | 0.46 | 0.14 | 0.36 | 0.03 |
| 130 | 0.21 | 0.64 | 0.58 | 9.84 | 0.986 | 2.52 | 0.78 | 0.18 | 0.11 |

TABLE 5-2

STEEL OF INVENTION

| No. | Ti | Zr | Ta | Hf | Co | Ni | (Mass. %) Cu |
|---|---|---|---|---|---|---|---|
| 101 | — | 0.140 | — | — | 1.17 | — | — |
| 102 | — | 1.860 | — | — | 3.80 | — | — |
| 103 | 1.404 | 1.731 | — | — | 4.68 | — | — |
| 104 | 1.667 | 1.445 | — | — | 3.01 | — | — |
| 105 | 0.575 | 1.664 | — | — | 0.40 | — | — |
| 106 | 1.760 | 0.058 | — | — | 3.27 | — | — |
| 107 | 1.915 | 0.313 | — | — | 3.63 | — | — |
| 108 | 1.701 | 1.081 | — | — | 0.65 | — | — |
| 109 | — | — | 1.638 | — | 0.80 | — | — |
| 110 | — | — | 1.980 | — | 0.86 | — | — |
| 111 | — | — | 0.209 | — | 4.82 | — | — |
| 112 | — | — | 1.014 | — | 4.72 | — | — |
| 113 | — | — | 1.072 | — | 2.21 | — | — |
| 114 | — | — | 0.075 | — | 1.31 | — | — |
| 115 | 1.592 | — | 0.651 | — | 3.56 | — | — |
| 116 | 0.673 | — | 0.501 | — | 3.42 | — | — |
| 117 | 1.451 | — | 0.278 | — | 2.48 | — | — |
| 118 | 0.584 | — | 1.652 | — | 2.31 | — | — |
| 119 | 1.764 | — | 1.303 | — | 2.20 | — | — |
| 120 | 1.626 | — | 1.925 | — | 1.37 | — | — |
| 121 | — | 1.168 | 0.162 | — | 3.77 | — | — |
| 122 | — | 0.784 | 1.701 | — | 3.87 | — | — |
| 123 | — | 0.018 | 0.215 | — | 0.84 | — | — |
| 124 | — | 1.470 | 0.326 | — | 1.03 | — | — |
| 125 | — | 0.880 | 0.754 | — | 1.34 | — | — |
| 126 | — | 0.911 | 0.183 | — | 3.44 | — | — |
| 127 | 1.756 | 1.252 | 0.281 | — | 1.69 | — | — |
| 128 | 0.436 | 1.545 | 0.696 | — | 4.86 | — | — |
| 129 | 0.861 | 1.463 | 1.103 | — | 4.96 | — | — |
| 130 | 1.714 | 0.693 | 1.188 | — | 3.68 | — | — |

TABLE 5-3

STEEL OF INVENTION

| No. | P | S | O | D-CRS | HAZCRS | (Mass. %) M % |
|---|---|---|---|---|---|---|
| 101 | 0.0264 | 0.004 | 0.006 | 5 | 157 | 8 |
| 102 | 0.0258 | 0.001 | 0.007 | 5 | 155 | 21 |
| 103 | 0.0011 | 0.002 | 0.010 | 6 | 164 | 39 |
| 104 | 0.0216 | 0.004 | 0.019 | 0 | 164 | 22 |
| 105 | 0.0080 | 0.002 | 0.005 | 5 | 155 | 22 |
| 106 | 0.0298 | 0.008 | 0.010 | 0 | 167 | 23 |
| 107 | 0.0228 | 0.007 | 0.014 | 3 | 177 | 30 |
| 108 | 0.0264 | 0.006 | 0.003 | 6 | 162 | 33 |
| 109 | 0.0060 | 0.004 | 0.012 | 6 | 151 | 25 |
| 110 | 0.0016 | 0.004 | 0.019 | 1 | 146 | 24 |
| 111 | 0.0229 | 0.010 | 0.002 | 5 | 174 | 10 |
| 112 | 0.0058 | 0.009 | 0.015 | 0 | 139 | 17 |
| 113 | 0.0199 | 0.006 | 0.007 | 0 | 143 | 22 |
| 114 | 0.0155 | 0.009 | 0.005 | 6 | 164 | 12 |
| 115 | 0.0024 | 0.001 | 0.013 | 4 | 155 | 31 |
| 116 | 0.0209 | 0.009 | 0.010 | 6 | 168 | 15 |
| 117 | 0.0208 | 0.004 | 0.012 | 7 | 132 | 26 |
| 118 | 0.0271 | 0.003 | 0.005 | 3 | 149 | 28 |
| 119 | 0.0205 | 0.004 | 0.017 | 3 | 146 | 29 |
| 120 | 0.0107 | 0.010 | 0.015 | 0 | 152 | 39 |
| 121 | 0.0227 | 0.001 | 0.014 | 6 | 168 | 21 |
| 122 | 0.0219 | 0.009 | 0.003 | 1 | 174 | 27 |
| 123 | 0.0029 | 0.008 | 0.006 | 4 | 171 | 16 |
| 124 | 0.0205 | 0.002 | 0.001 | 1 | 137 | 27 |
| 125 | 0.0256 | 0.003 | 0.015 | 7 | 151 | 26 |
| 126 | 0.0134 | 0.005 | 0.005 | 5 | 164 | 16 |
| 127 | 0.0234 | 0.006 | 0.016 | 5 | 155 | 38 |
| 128 | 0.0210 | 0.005 | 0.018 | 6 | 151 | 26 |
| 129 | 0.0158 | 0.005 | 0.005 | 0 | 131 | 35 |
| 130 | 0.0185 | 0.009 | 0.004 | 7 | 146 | 37 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 6-1

STEEL OF INVENTION

| No. | C | Si | Mn | Cr | Mo | W | V | Nb | (Mass. %) N |
|---|---|---|---|---|---|---|---|---|---|
| 131 | 0.14 | 0.64 | 0.53 | 7.51 | 0.891 | 2.28 | 0.93 | 0.09 | 0.03 |
| 132 | 0.13 | 0.55 | 0.55 | 15.34 | 0.760 | 0.90 | 0.91 | 0.49 | 0.12 |
| 133 | 0.28 | 0.28 | 0.92 | 11.68 | 0.928 | 2.74 | 0.07 | 0.09 | 0.21 |
| 134 | 0.26 | 0.06 | 0.70 | 7.24 | 0.721 | 0.67 | 0.70 | 0.02 | 0.04 |
| 135 | 0.16 | 0.18 | 0.56 | 6.61 | 0.491 | 2.41 | 0.19 | 0.20 | 0.03 |
| 136 | 0.22 | 0.10 | 0.77 | 14.08 | 0.069 | 2.49 | 0.35 | 0.08 | 0.03 |
| 137 | 0.12 | 0.10 | 0.81 | 14.55 | 0.288 | 0.33 | 0.52 | 0.05 | 0.25 |
| 138 | 0.23 | 0.04 | 0.54 | 12.41 | 0.988 | 0.38 | 0.05 | 0.03 | 0.03 |
| 139 | 0.23 | 0.20 | 0.63 | 5.54 | 0.016 | 2.09 | 0.74 | 0.20 | 0.07 |
| 140 | 0.05 | 0.04 | 0.94 | 11.20 | 0.684 | 3.25 | 0.95 | 0.46 | 0.20 |
| 141 | 0.24 | 0.61 | 0.95 | 14.26 | 0.833 | 1.64 | 0.54 | 0.25 | 0.15 |
| 142 | 0.01 | 0.61 | 0.52 | 6.09 | 0.811 | 3.37 | 0.79 | 0.22 | 0.22 |
| 143 | 0.06 | 0.30 | 0.33 | 17.26 | 0.956 | 1.30 | 0.10 | 0.30 | 0.04 |
| 144 | 0.18 | 0.35 | 0.64 | 12.88 | 0.093 | 1.45 | 0.25 | 0.15 | 0.02 |
| 145 | 0.04 | 0.62 | 0.93 | 10.57 | 0.068 | 1.69 | 0.12 | 0.20 | 0.15 |
| 146 | 0.03 | 0.20 | 0.26 | 8.05 | 0.211 | 1.43 | 0.50 | 0.11 | 0.25 |
| 147 | 0.09 | 0.12 | 0.89 | 9.42 | 0.336 | 1.72 | 0.26 | 0.03 | 0.04 |
| 148 | 0.18 | 0.65 | 0.29 | 6.32 | 0.302 | 0.45 | 0.70 | 0.15 | 0.10 |
| 149 | 0.11 | 0.12 | 0.34 | 9.76 | 0.454 | 0.40 | 0.71 | 0.38 | 0.13 |
| 150 | 0.12 | 0.34 | 0.92 | 17.51 | 0.620 | 1.00 | 0.11 | 0.16 | 0.10 |
| 151 | 0.02 | 0.79 | 0.27 | 14.38 | 0.136 | 1.70 | 0.70 | 0.37 | 0.09 |
| 152 | 0.19 | 0.56 | 0.68 | 11.14 | 0.818 | 0.27 | 0.35 | 0.21 | 0.18 |
| 153 | 0.16 | 0.31 | 0.81 | 5.80 | 0.037 | 1.20 | 0.39 | 0.33 | 0.10 |
| 154 | 0.01 | 0.68 | 0.93 | 15.75 | 0.107 | 0.60 | 0.16 | 0.15 | 0.03 |
| 155 | 0.15 | 0.39 | 0.51 | 12.78 | 0.363 | 1.23 | 0.95 | 0.34 | 0.18 |
| 156 | 0.08 | 0.07 | 0.21 | 7.67 | 0.645 | 0.90 | 0.67 | 0.32 | 0.16 |
| 157 | 0.04 | 0.78 | 0.32 | 17.99 | 0.293 | 0.72 | 0.61 | 0.26 | 0.16 |

TABLE 6-1-continued

STEEL OF INVENTION

| No. | C | Si | Mn | Cr | Mo | W | V | Nb | (Mass. %) N |
|---|---|---|---|---|---|---|---|---|---|
| 158 | 0.29 | 0.04 | 0.68 | 15.40 | 0.139 | 3.45 | 0.62 | 0.08 | 0.15 |
| 159 | 0.18 | 0.07 | 0.38 | 10.97 | 0.022 | 0.30 | 0.04 | 0.18 | 0.20 |
| 160 | 0.27 | 0.35 | 0.89 | 8.87 | 0.266 | 0.63 | 0.67 | 0.24 | 0.15 |

TABLE 6-2

STEEL OF INVENTION

| No. | Ti | Zr | Ta | Hf | Co | Ni | (Mass. %) Cu |
|---|---|---|---|---|---|---|---|
| 131 | 0.647 | 1.902 | 1.623 | — | 4.99 | — | — |
| 132 | 1.348 | 1.760 | 0.077 | — | 3.27 | — | — |
| 133 | — | — | — | 0.962 | 4.97 | — | — |
| 134 | — | — | — | 1.168 | 4.50 | — | — |
| 135 | — | — | — | 1.762 | 1.05 | — | — |
| 136 | — | — | — | 0.437 | 3.44 | — | — |
| 137 | — | — | — | 1.831 | 1.30 | — | — |
| 138 | — | — | — | 0.643 | 1.01 | — | — |
| 139 | 0.032 | — | — | 0.561 | 4.23 | — | — |
| 140 | 0.020 | — | — | 1.225 | 0.56 | — | — |
| 141 | 0.800 | — | — | 0.314 | 3.59 | — | — |
| 142 | 0.091 | — | — | 1.513 | 0.57 | — | — |
| 143 | 0.542 | — | — | 1.455 | 2.60 | — | — |
| 144 | 1.809 | — | — | 1.849 | 1.78 | — | — |
| 145 | — | 1.395 | — | 1.367 | 4.55 | — | — |
| 146 | — | 0.851 | — | 0.674 | 0.52 | — | — |
| 147 | — | 1.029 | — | 0.440 | 0.85 | — | — |
| 148 | — | 1.604 | — | 0.336 | 4.77 | — | — |
| 149 | — | 1.249 | — | 0.028 | 4.27 | — | — |
| 150 | — | 1.610 | — | 1.176 | 0.97 | — | — |
| 151 | — | — | 1.696 | 0.475 | 1.32 | — | — |
| 152 | — | — | 0.524 | 1.620 | 4.58 | — | — |
| 153 | — | — | 0.473 | 0.262 | 0.29 | — | — |
| 154 | — | — | 1.208 | 1.053 | 2.06 | — | — |
| 155 | — | — | 1.419 | 0.689 | 1.93 | — | — |
| 156 | — | — | 1.769 | 0.830 | 1.48 | — | — |
| 157 | — | 1.492 | 0.925 | 1.141 | 2.35 | — | — |
| 158 | — | 0.991 | 1.568 | 0.313 | 1.35 | — | — |
| 159 | — | 1.284 | 1.367 | 0.995 | 4.86 | — | — |
| 160 | — | 0.032 | 1.984 | 1.878 | 4.93 | — | — |

TABLE 6-3

STEEL OF INVENTION

| No. | P | S | O | D-CRS | HAZCRS | (Mass. %) M % |
|---|---|---|---|---|---|---|
| 131 | 0.0237 | 0.006 | 0.003 | 0 | 174 | 1 |
| 132 | 0.0266 | 0.004 | 0.006 | 0 | 143 | 36 |
| 133 | 0.0078 | 0.006 | 0.013 | 3 | 132 | 16 |
| 134 | 0.0215 | 0.007 | 0.018 | 3 | 167 | 14 |
| 135 | 0.0033 | 0.004 | 0.001 | 7 | 177 | 25 |
| 136 | 0.0231 | 0.004 | 0.015 | 5 | 139 | 17 |
| 137 | 0.0011 | 0.008 | 0.019 | 5 | 131 | 26 |
| 138 | 0.0072 | 0.004 | 0.010 | 5 | 180 | 17 |
| 139 | 0.0217 | 0.003 | 0.004 | 7 | 164 | 19 |
| 140 | 0.0246 | 0.006 | 0.006 | 3 | 137 | 15 |
| 141 | 0.0111 | 0.009 | 0.015 | 6 | 176 | 22 |
| 142 | 0.0061 | 0.004 | 0.017 | 4 | 157 | 24 |
| 143 | 0.0191 | 0.010 | 0.009 | 4 | 161 | 29 |
| 144 | 0.0161 | 0.008 | 0.017 | 0 | 138 | 39 |
| 145 | 0.0220 | 0.006 | 0.009 | 6 | 167 | 36 |
| 146 | 0.0020 | 0.003 | 0.010 | 6 | 176 | 21 |
| 147 | 0.0254 | 0.009 | 0.018 | 2 | 167 | 16 |
| 148 | 0.0131 | 0.007 | 0.010 | 1 | 168 | 28 |
| 149 | 0.0196 | 0.007 | 0.001 | 1 | 131 | 19 |
| 150 | 0.0102 | 0.005 | 0.009 | 5 | 135 | 35 |

TABLE 6-3-continued

STEEL OF INVENTION

| No. | P | S | O | D-CRS | HAZCRS | (Mass. %) M % |
|---|---|---|---|---|---|---|
| 151 | 0.0251 | 0.006 | 0.020 | 5 | 157 | 28 |
| 152 | 0.0296 | 0.002 | 0.012 | 6 | 150 | 26 |
| 153 | 0.0184 | 0.008 | 0.011 | 6 | 142 | 13 |
| 154 | 0.0168 | 0.005 | 0.014 | 7 | 135 | 28 |
| 155 | 0.0048 | 0.006 | 0.007 | 1 | 132 | 26 |
| 156 | 0.0223 | 0.003 | 0.017 | 6 | 161 | 31 |
| 157 | 0.0196 | 0.009 | 0.001 | 4 | 174 | 36 |
| 158 | 0.0068 | 0.010 | 0.015 | 3 | 175 | 27 |
| 159 | 0.0233 | 0.007 | 0.016 | 5 | 141 | 42 |
| 160 | 0.0201 | 0.009 | 0.003 | 4 | 174 | 42 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 7-1

STEEL OF INVENTION

| No. | C | Si | Mn | Cr | Mo | W | V | Nb | (Mass. %) N |
|---|---|---|---|---|---|---|---|---|---|
| 161 | 0.19 | 0.75 | 0.45 | 13.56 | 0.218 | 2.24 | 0.39 | 0.43 | 0.09 |
| 162 | 0.21 | 0.37 | 0.97 | 16.56 | 0.721 | 2.96 | 0.02 | 0.43 | 0.10 |
| 163 | 0.27 | 0.24 | 0.30 | 15.55 | 0.602 | 2.24 | 0.39 | 0.38 | 0.02 |
| 164 | 0.18 | 0.63 | 0.7 | 08.38 | 0.691 | 2.83 | 0.35 | 0.47 | 0.04 |
| 165 | 0.18 | 0.24 | 0.45 | 12.52 | 0.337 | 2.54 | 0.23 | 0.12 | 0.25 |
| 166 | 0.23 | 0.10 | 0.21 | 6.25 | 0.857 | 0.80 | 0.83 | 0.46 | 0.25 |
| 167 | 0.26 | 0.49 | 0.65 | 13.37 | 0.602 | 2.04 | 0.05 | 0.45 | 0.11 |
| 168 | 0.25 | 0.49 | 0.85 | 12.46 | 0.906 | 2.46 | 0.19 | 0.26 | 0.05 |
| 169 | 0.29 | 0.77 | 0.27 | 7.78 | 0.110 | 1.49 | 0.58 | 0.03 | 0.02 |
| 170 | 0.18 | 0.40 | 0.78 | 16.70 | 0.537 | 0.22 | 0.58 | 0.43 | 0.10 |
| 171 | 0.19 | 0.44 | 0.64 | 11.08 | 0.034 | 1.42 | 0.51 | 0.16 | 0.13 |
| 172 | 0.20 | 0.75 | 0.54 | 8.30 | 0.926 | 2.89 | 0.21 | 0.10 | 0.20 |
| 173 | 0.08 | 0.41 | 0.32 | 12.57 | 0.052 | 2.43 | 0.49 | 0.18 | 0.01 |
| 174 | 0.07 | 0.49 | 0.27 | 15.46 | 0.749 | 1.19 | 0.73 | 0.08 | 0.15 |
| 175 | 0.25 | 0.07 | 0.27 | 14.93 | 0.869 | 1.93 | 0.75 | 0.21 | 0.07 |
| 176 | 0.30 | 0.59 | 0.56 | 8.71 | 0.735 | 0.79 | 0.39 | 0.24 | 0.11 |
| 177 | 0.15 | 0.34 | 0.23 | 7.61 | 0.679 | 0.51 | 0.96 | 0.33 | 0.23 |
| 178 | 0.05 | 0.78 | 0.73 | 16.09 | 0.047 | 2.23 | 0.83 | 0.41 | 0.03 |
| 179 | 0.11 | 0.59 | 0.75 | 12.48 | 0.661 | 0.42 | 0.33 | 0.39 | 0.06 |
| 180 | 0.12 | 0.05 | 0.54 | 14.09 | 0.366 | 2.83 | 0.76 | 0.44 | 0.17 |
| 181 | 0.05 | 0.18 | 0.78 | 12.39 | 0.497 | 0.64 | 0.99 | 0.23 | 0.20 |
| 182 | 0.13 | 0.48 | 0.93 | 5.14 | 0.880 | 1.55 | 0.36 | 0.42 | 0.10 |
| 183 | 0.16 | 0.42 | 0.87 | 16.27 | 0.869 | 3.40 | 0.20 | 0.19 | 0.21 |
| 184 | 0.11 | 0.66 | 0.86 | 11.14 | 0.788 | 2.33 | 0.81 | 0.45 | 0.11 |
| 185 | 0.07 | 0.29 | 0.36 | 7.11 | 0.974 | 1.09 | 0.08 | 0.12 | 0.02 |
| 186 | 0.14 | 0.74 | 0.86 | 15.01 | 0.764 | 2.46 | 0.80 | 0.12 | 0.12 |
| 187 | 0.12 | 0.33 | 0.62 | 13.30 | 0.498 | 0.95 | 0.84 | 0.11 | 0.03 |
| 188 | 0.26 | 0.09 | 0.30 | 12.80 | 0.503 | 0.93 | 0.04 | 0.27 | 0.07 |
| 189 | 0.21 | 0.29 | 0.58 | 11.32 | 0.126 | 0.26 | 0.69 | 0.25 | 0.06 |
| 190 | 0.09 | 0.80 | 0.93 | 13.34 | 0.694 | 1.68 | 0.18 | 0.49 | 0.22 |

TABLE 7-2

STEEL OF INVENTION

| No. | Ti | Zr | Ta | Hf | Co | Ni | (Mass. %) Cu |
|---|---|---|---|---|---|---|---|
| 161 | — | 0.907 | 0.105 | 0.625 | 0.75 | — | — |
| 162 | — | 0.587 | 0.391 | 1.902 | 1.12 | — | — |
| 163 | 1.594 | — | 0.512 | 0.388 | 0.49 | — | — |
| 164 | 0.508 | — | 1.154 | 0.759 | 0.46 | — | — |
| 165 | 1.338 | — | 1.981 | 1.673 | 2.62 | — | — |
| 166 | 1.761 | — | 0.663 | 1.823 | 3.82 | — | — |

TABLE 7-2-continued

STEEL OF INVENTION

| No. | Ti | Zr | Ta | Hf | Co | Ni | (Mass. %) Cu |
|---|---|---|---|---|---|---|---|
| 167 | 0.476 | — | 1.885 | 0.880 | 3.27 | — | — |
| 168 | 1.154 | — | 0.315 | 1.493 | 2.53 | — | — |
| 169 | 1.447 | 0.255 | — | 0.337 | 0.84 | — | — |
| 170 | 0.041 | 1.529 | — | 0.098 | 2.23 | — | — |
| 171 | 0.597 | 0.681 | — | 0.450 | 1.13 | — | — |
| 172 | 1.775 | 0.354 | — | 1.066 | 1.51 | — | — |
| 173 | 0.262 | 1.210 | — | 0.612 | 2.65 | — | — |
| 174 | 1.757 | 1.947 | — | 1.763 | 3.71 | — | — |
| 175 | 1.909 | 0.205 | 1.307 | 1.158 | 3.80 | — | — |
| 176 | 0.377 | 1.649 | 1.502 | 0.482 | 2.23 | — | — |
| 177 | 0.853 | 0.995 | 0.970 | 0.450 | 0.70 | — | — |
| 178 | 1.998 | 1.905 | 1.364 | 0.722 | 3.17 | — | — |
| 179 | 0.493 | 0.040 | 1.344 | 1.935 | 1.58 | — | — |
| 180 | 0.988 | 0.083 | 0.597 | 1.782 | 4.79 | — | — |
| 181 | 0.188 | — | — | — | — | 3.17 | — |
| 182 | 0.712 | — | — | — | — | 0.69 | — |
| 183 | 0.283 | — | — | — | — | 1.48 | — |
| 184 | 0.562 | — | — | — | — | 2.43 | — |
| 185 | 1.198 | — | — | — | — | 0.30 | — |
| 186 | 1.887 | — | — | — | — | 1.56 | — |
| 187 | — | 0.798 | — | — | — | 2.98 | — |
| 188 | — | 1.187 | — | — | — | 3.75 | — |
| 189 | — | 1.520 | — | — | — | 3.12 | — |
| 190 | — | 1.477 | — | — | — | 2.74 | — |

TABLE 7-3

STEEL OF INVENTION

| No. | P | S | O | D-CRS | HAZCRS | (Mass. %) M % |
|---|---|---|---|---|---|---|
| 161 | 0.0220 | 0.006 | 0.009 | 3 | 154 | 18 |
| 162 | 0.0238 | 0.004 | 0.003 | 4 | 156 | 34 |
| 163 | 0.0208 | 0.002 | 0.010 | 3 | 159 | 29 |
| 164 | 0.0230 | 0.003 | 0.009 | 4 | 142 | 33 |
| 165 | 0.0107 | 0.006 | 0.015 | 2 | 155 | 47 |
| 166 | 0.0088 | 0.010 | 0.005 | 3 | 178 | 44 |
| 167 | 0.0123 | 0.008 | 0.007 | 2 | 162 | 32 |
| 168 | 0.0162 | 0.007 | 0.006 | 5 | 137 | 33 |
| 169 | 0.0157 | 0.007 | 0.009 | 3 | 178 | 24 |
| 170 | 0.0062 | 0.006 | 0.005 | 0 | 165 | 27 |
| 171 | 0.0273 | 0.002 | 0.017 | 5 | 175 | 19 |
| 172 | 0.0294 | 0.008 | 0.014 | 2 | 135 | 37 |
| 173 | 0.0078 | 0.003 | 0.013 | 4 | 173 | 26 |
| 174 | 0.0170 | 0.010 | 0.019 | 6 | 143 | 50 |
| 175 | 0.0218 | 0.003 | 0.011 | 5 | 171 | 40 |
| 176 | 0.0029 | 0.004 | 0.013 | 2 | 161 | 44 |
| 177 | 0.0156 | 0.003 | 0.005 | 3 | 140 | 36 |
| 178 | 0.0098 | 0.003 | 0.010 | 3 | 137 | 57 |
| 179 | 0.0103 | 0.002 | 0.018 | 2 | 177 | 35 |
| 180 | 0.0120 | 0.002 | 0.013 | 2 | 165 | 37 |
| 181 | 0.0255 | 0.008 | 0.014 | 5 | 154 | 7 |
| 182 | 0.0009 | 0.009 | 0.017 | 2 | 145 | 12 |
| 183 | 0.0223 | 0.002 | 0.009 | 1 | 142 | 10 |
| 184 | 0.0260 | 0.001 | 0.015 | 2 | 173 | 12 |
| 185 | 0.0067 | 0.008 | 0.004 | 2 | 165 | 18 |
| 186 | 0.0192 | 0.004 | 0.010 | 6 | 145 | 23 |
| 187 | 0.0289 | 0.010 | 0.013 | 3 | 142 | 18 |
| 188 | 0.0008 | 0.006 | 0.017 | 6 | 134 | 23 |
| 189 | 0.0196 | 0.004 | 0.011 | 2 | 147 | 22 |
| 190 | 0.0209 | 0.008 | 0.019 | 2 | 135 | 19 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 8-1

STEEL OF INVENTION

| No. | C | Si | Mn | Cr | Mo | W | V | Nb | (Mass. %) N |
|---|---|---|---|---|---|---|---|---|---|
| 191 | 0.27 | 0.33 | 0.81 | 10.22 | 0.553 | 1.33 | 0.31 | 0.39 | 0.14 |
| 192 | 0.13 | 0.68 | 0.49 | 12.62 | 0.520 | 1.98 | 0.42 | 0.14 | 0.03 |
| 193 | 0.05 | 0.18 | 0.64 | 12.12 | 0.945 | 1.44 | 0.36 | 0.13 | 0.09 |
| 194 | 0.13 | 0.27 | 0.34 | 13.18 | 0.177 | 2.50 | 0.96 | 0.05 | 0.03 |
| 195 | 0.04 | 0.41 | 0.65 | 13.48 | 0.033 | 1.27 | 0.56 | 0.05 | 0.18 |
| 196 | 0.16 | 0.49 | 0.63 | 10.87 | 0.351 | 0.56 | 0.50 | 0.07 | 0.13 |
| 197 | 0.30 | 0.37 | 0.56 | 16.37 | 0.473 | 3.09 | 0.60 | 0.01 | 0.10 |
| 198 | 0.12 | 0.32 | 0.71 | 8.10 | 0.222 | 1.67 | 0.69 | 0.28 | 0.15 |
| 199 | 0.15 | 0.58 | 0.92 | 16.48 | 0.429 | 2.40 | 0.13 | 0.32 | 0.01 |
| 200 | 0.20 | 0.67 | 0.70 | 7.17 | 0.464 | 3.16 | 0.73 | 0.30 | 0.24 |
| 201 | 0.23 | 0.44 | 0.70 | 16.85 | 0.149 | 3.36 | 0.86 | 0.37 | 0.09 |
| 202 | 0.18 | 0.15 | 0.39 | 10.83 | 0.303 | 0.78 | 0.34 | 0.45 | 0.22 |
| 203 | 0.16 | 0.46 | 0.44 | 13.07 | 0.771 | 1.49 | 0.98 | 0.47 | 0.13 |
| 204 | 0.26 | 0.07 | 0.72 | 14.80 | 0.395 | 1.65 | 0.66 | 0.34 | 0.25 |
| 205 | 0.29 | 0.80 | 0.69 | 7.58 | 0.508 | 0.75 | 0.69 | 0.23 | 0.18 |
| 206 | 0.05 | 0.18 | 0.63 | 15.23 | 0.445 | 1.50 | 0.90 | 0.06 | 0.13 |
| 207 | 0.08 | 0.42 | 0.40 | 9.31 | 0.031 | 1.73 | 0.65 | 0.23 | 0.05 |
| 208 | 0.05 | 0.23 | 0.67 | 7.59 | 0.616 | 0.90 | 0.76 | 0.19 | 0.02 |
| 209 | 0.04 | 0.66 | 0.52 | 14.30 | 0.038 | 1.78 | 0.57 | 0.33 | 0.02 |
| 210 | 0.30 | 0.78 | 0.20 | 14.34 | 0.625 | 0.53 | 0.42 | 0.34 | 0.22 |
| 211 | 0.20 | 0.08 | 0.80 | 11.98 | 0.714 | 1.52 | 0.12 | 0.36 | 0.13 |
| 212 | 0.13 | 0.39 | 0.56 | 11.60 | 0.635 | 0.93 | 0.53 | 0.09 | 0.17 |
| 213 | 0.20 | 0.41 | 0.98 | 17.71 | 0.248 | 1.56 | 0.99 | 0.18 | 0.07 |
| 214 | 0.19 | 0.78 | 0.32 | 15.07 | 0.366 | 1.18 | 0.83 | 0.06 | 0.15 |
| 215 | 0.08 | 0.22 | 0.84 | 7.95 | 0.323 | 2.51 | 0.39 | 0.12 | 0.01 |
| 216 | 0.09 | 0.15 | 0.80 | 7.38 | 0.467 | 1.76 | 0.48 | 0.30 | 0.09 |
| 217 | 0.05 | 0.44 | 0.49 | 11.21 | 0.633 | 1.71 | 0.48 | 0.27 | 0.11 |
| 218 | 0.18 | 0.19 | 0.57 | 17.16 | 0.145 | 3.39 | 0.19 | 0.44 | 0.03 |
| 219 | 0.15 | 0.05 | 0.91 | 10.31 | 0.857 | 1.41 | 0.95 | 0.24 | 0.18 |
| 220 | 0.07 | 0.29 | 0.98 | 14.37 | 0.096 | 3.39 | 0.12 | 0.08 | 0.15 |

TABLE 8-2

STEEL OF INVENTION

| No. | Ti | Zr | Ta | Hf | Co | Ni | (Mass. %) Cu |
|---|---|---|---|---|---|---|---|
| 191 | — | 0.724 | — | — | — | 4.15 | — |
| 192 | — | 0.919 | — | — | — | 4.15 | — |
| 193 | 1.414 | 1.737 | — | — | — | 1.99 | — |
| 194 | 1.662 | 1.868 | — | — | — | 4.10 | — |
| 195 | 1.995 | 0.968 | — | — | — | 4.86 | — |
| 196 | 0.112 | 0.729 | — | — | — | 1.15 | — |
| 197 | 0.652 | 1.798 | — | — | — | 4.10 | — |
| 198 | 0.270 | 1.867 | — | — | — | 0.94 | — |
| 199 | — | — | 1.997 | — | — | 0.51 | — |
| 200 | — | — | 1.618 | — | — | 4.42 | — |
| 201 | — | — | 0.590 | — | — | 2.15 | — |
| 202 | — | — | 0.612 | — | — | 0.32 | — |
| 203 | — | — | 0.376 | — | — | 2.88 | — |
| 204 | — | — | 0.521 | — | — | 1.81 | — |
| 205 | 1.236 | — | 1.723 | — | — | 3.54 | — |
| 206 | 0.913 | — | 1.670 | — | — | 2.48 | — |
| 207 | 1.757 | — | 0.032 | — | — | 0.25 | — |
| 208 | 0.433 | — | 1.456 | — | — | 3.23 | — |
| 209 | 0.603 | — | 0.634 | — | — | 1.05 | — |
| 210 | 0.952 | — | 1.214 | — | — | 2.47 | — |
| 211 | — | 1.529 | 0.895 | — | — | 4.41 | — |
| 212 | — | 0.011 | 0.342 | — | — | 1.20 | — |
| 213 | — | 0.565 | 0.231 | — | — | 1.71 | — |
| 214 | — | 0.844 | 1.209 | — | — | 2.64 | — |
| 215 | — | 0.545 | 1.976 | — | — | 0.98 | — |
| 216 | — | 0.338 | 1.198 | — | — | 2.99 | — |
| 217 | 0.551 | 0.877 | 1.540 | — | — | 3.18 | — |
| 218 | 1.440 | 0.847 | 0.689 | — | — | 0.69 | — |
| 219 | 0.559 | 1.905 | 1.286 | — | — | 2.00 | — |
| 220 | 1.563 | 0.76 | 0.050 | — | — | 1.47 | — |

TABLE 8-3

STEEL OF INVENTION (Mass. %)

| No. | P | S | O | D-CRS | HAZCRS | M % |
|---|---|---|---|---|---|---|
| 191 | 0.0145 | 0.002 | 0.001 | 7 | 151 | 16 |
| 192 | 0.0106 | 0.002 | 0.011 | 2 | 172 | 12 |
| 193 | 0.0041 | 0.009 | 0.016 | 1 | 176 | 30 |
| 194 | 0.0202 | 0.010 | 0.014 | 6 | 166 | 32 |
| 195 | 0.0238 | 0.009 | 0.002 | 1 | 144 | 29 |
| 196 | 0.0256 | 0.009 | 0.005 | 6 | 139 | 18 |
| 197 | 0.0051 | 0.008 | 0.011 | 3 | 177 | 24 |
| 198 | 0.0023 | 0.006 | 0.016 | 4 | 137 | 26 |
| 199 | 0.0126 | 0.005 | 0.007 | 2 | 147 | 24 |
| 200 | 0.0009 | 0.003 | 0.010 | 6 | 134 | 25 |
| 201 | 0.0218 | 0.003 | 0.004 | 7 | 175 | 14 |
| 202 | 0.0264 | 0.005 | 0.013 | 1 | 149 | 11 |
| 203 | 0.0097 | 0.003 | 0.015 | 4 | 159 | 15 |
| 204 | 0.0259 | 0.002 | 0.016 | 5 | 156 | 19 |
| 205 | 0.0108 | 0.008 | 0.015 | 3 | 170 | 33 |
| 206 | 0.0045 | 0.004 | 0.016 | 3 | 176 | 26 |
| 207 | 0.0165 | 0.007 | 0.007 | 0 | 180 | 25 |
| 208 | 0.0273 | 0.003 | 0.014 | 5 | 132 | 25 |
| 209 | 0.0019 | 0.003 | 0.015 | 5 | 161 | 16 |
| 210 | 0.0249 | 0.001 | 0.015 | 3 | 145 | 30 |
| 211 | 0.0022 | 0.005 | 0.012 | 4 | 161 | 25 |
| 212 | 0.0035 | 0.009 | 0.013 | 1 | 136 | 15 |
| 213 | 0.0086 | 0.002 | 0.004 | 3 | 150 | 12 |
| 214 | 0.0129 | 0.001 | 0.010 | 5 | 179 | 24 |
| 215 | 0.0118 | 0.010 | 0.011 | 2 | 176 | 33 |
| 216 | 0.0295 | 0.007 | 0.003 | 4 | 169 | 26 |
| 217 | 0.0022 | 0.006 | 0.010 | 3 | 160 | 37 |
| 218 | 0.0138 | 0.005 | 0.002 | 1 | 178 | 33 |
| 219 | 0.0153 | 0.007 | 0.013 | 0 | 150 | 35 |
| 220 | 0.0012 | 0.002 | 0.012 | 7 | 154 | 29 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 9-1

STEEL OF INVENTION (Mass. %)

| No. | C | Si | Mn | Cr | Mo | W | V | Nb | N |
|---|---|---|---|---|---|---|---|---|---|
| 221 | 0.02 | 0.37 | 0.64 | 14.25 | 0.193 | 0.58 | 0.99 | 0.11 | 0.01 |
| 222 | 0.25 | 0.18 | 0.97 | 14.38 | 0.985 | 2.32 | 0.46 | 0.27 | 0.23 |
| 223 | 0.28 | 0.76 | 0.24 | 12.56 | 0.823 | 3.16 | 0.82 | 0.23 | 0.15 |
| 224 | 0.06 | 0.03 | 0.70 | 13.02 | 0.518 | 2.47 | 0.41 | 0.14 | 0.21 |
| 225 | 0.26 | 0.58 | 0.62 | 7.33 | 0.417 | 1.44 | 0.08 | 0.43 | 0.02 |
| 226 | 0.26 | 0.35 | 0.30 | 12.90 | 0.374 | 2.84 | 0.16 | 0.03 | 0.01 |
| 227 | 0.16 | 0.38 | 0.39 | 7.95 | 0.202 | 2.75 | 0.48 | 0.33 | 0.04 |
| 228 | 0.06 | 0.14 | 0.34 | 16.35 | 0.737 | 2.34 | 0.38 | 0.27 | 0.04 |
| 229 | 0.19 | 0.68 | 0.85 | 10.11 | 0.334 | 1.07 | 0.70 | 0.02 | 0.24 |
| 230 | 0.22 | 0.32 | 0.98 | 6.50 | 0.315 | 3.32 | 0.29 | 0.22 | 0.23 |
| 231 | 0.24 | 0.48 | 0.99 | 9.89 | 0.019 | 0.32 | 0.46 | 0.07 | 0.21 |
| 232 | 0.22 | 0.65 | 0.35 | 11.64 | 0.776 | 3.05 | 0.55 | 0.22 | 0.14 |
| 233 | 0.10 | 0.30 | 0.93 | 9.52 | 0.421 | 2.71 | 0.39 | 0.33 | 0.21 |
| 234 | 0.26 | 0.48 | 1.00 | 14.56 | 0.306 | 0.47 | 0.34 | 0.10 | 0.16 |
| 235 | 0.09 | 0.28 | 0.83 | 5.06 | 0.252 | 2.34 | 0.22 | 0.41 | 0.06 |
| 236 | 0.25 | 0.36 | 0.69 | 11.45 | 0.104 | 1.20 | 0.86 | 0.21 | 0.12 |
| 237 | 0.13 | 0.19 | 0.84 | 11.98 | 0.189 | 1.44 | 0.62 | 0.39 | 0.16 |
| 238 | 0.25 | 0.04 | 0.76 | 11.14 | 0.848 | 0.89 | 0.81 | 0.40 | 0.05 |
| 239 | 0.13 | 0.17 | 0.31 | 13.18 | 0.418 | 0.63 | 0.78 | 0.38 | 0.08 |
| 240 | 0.15 | 0.06 | 0.97 | 9.52 | 0.730 | 1.79 | 0.38 | 0.01 | 0.23 |
| 241 | 0.14 | 0.37 | 0.59 | 11.08 | 0.132 | 0.52 | 0.40 | 0.20 | 0.22 |
| 242 | 0.17 | 0.56 | 0.66 | 9.08 | 0.438 | 1.24 | 0.23 | 0.13 | 0.12 |
| 243 | 0.22 | 0.15 | 0.64 | 8.14 | 0.510 | 1.77 | 0.17 | 0.22 | 0.02 |
| 244 | 0.22 | 0.54 | 0.79 | 5.96 | 0.671 | 1.54 | 0.56 | 0.12 | 0.24 |
| 245 | 0.27 | 0.44 | 0.99 | 6.88 | 0.754 | 1.67 | 0.25 | 0.26 | 0.01 |
| 246 | 0.05 | 0.51 | 0.31 | 8.74 | 0.595 | 1.62 | 0.07 | 0.06 | 0.03 |
| 247 | 0.21 | 0.61 | 0.60 | 15.93 | 0.528 | 2.46 | 0.34 | 0.17 | 0.12 |

TABLE 9-1-continued

STEEL OF INVENTION (Mass. %)

| No. | C | Si | Mn | Cr | Mo | W | V | Nb | N |
|---|---|---|---|---|---|---|---|---|---|
| 248 | 0.15 | 0.23 | 0.96 | 13.52 | 0.402 | 2.07 | 0.42 | 0.28 | 0.14 |
| 249 | 0.10 | 0.79 | 0.43 | 5.61 | 0.046 | 3.16 | 0.14 | 0.06 | 0.03 |
| 250 | 0.15 | 0.24 | 0.89 | 16.22 | 0.789 | 0.26 | 0.81 | 0.40 | 0.13 |

TABLE 9-2

STEEL OF INVENTION (Mass. %)

| No. | Ti | Zr | Ta | Hf | Co | Ni | Cu |
|---|---|---|---|---|---|---|---|
| 221 | 0.118 | 1.041 | 0.597 | — | — | 0.72 | — |
| 222 | 0.915 | 0.451 | 1.641 | — | — | 1.38 | — |
| 223 | — | — | — | 0.338 | — | 2.68 | — |
| 224 | — | — | — | 0.103 | — | 3.76 | — |
| 225 | — | — | — | 0.754 | — | 1.52 | — |
| 226 | — | — | — | 0.945 | — | 2.34 | — |
| 227 | — | — | — | 0.339 | — | 0.58 | — |
| 228 | — | — | — | 1.617 | — | 2.73 | — |
| 229 | 0.410 | — | — | 0.455 | — | 3.20 | — |
| 230 | 0.260 | — | — | 0.507 | — | 1.13 | — |
| 231 | 0.398 | — | — | 1.461 | — | 0.59 | — |
| 232 | 1.468 | — | — | 1.955 | — | 3.11 | — |
| 233 | 0.153 | — | — | 1.729 | — | 3.26 | — |
| 234 | 0.146 | — | — | 0.403 | — | 4.91 | — |
| 235 | — | 0.893 | — | 0.643 | — | 4.92 | — |
| 236 | — | 1.458 | — | 0.163 | — | 2.55 | — |
| 237 | — | 1.227 | — | 1.607 | — | 1.75 | — |
| 238 | — | 0.846 | — | 0.642 | — | 4.15 | — |
| 239 | — | 1.017 | — | 1.958 | — | 4.18 | — |
| 240 | — | 0.399 | — | 0.226 | — | 1.03 | — |
| 241 | — | — | 1.741 | 0.097 | — | 3.51 | — |
| 242 | — | — | 1.531 | 0.248 | — | 1.25 | — |
| 243 | — | — | 1.912 | 1.371 | — | 0.65 | — |
| 244 | — | — | 0.554 | 0.116 | — | 3.33 | — |
| 245 | — | — | 0.145 | 0.176 | — | 1.31 | — |
| 246 | — | — | 0.350 | 0.219 | — | 3.42 | — |
| 247 | — | 0.335 | 1.823 | 0.900 | — | 1.63 | — |
| 248 | — | 0.570 | 0.249 | 1.891 | — | 4.74 | — |
| 249 | — | 1.069 | 1.298 | 0.885 | — | 4.80 | — |
| 250 | — | 0.499 | 0.648 | 0.540 | — | 1.04 | — |

TABLE 9-3

STEEL OF INVENTION (Mass. %)

| No. | P | S | O | D-CRS | HAZCRS | M % |
|---|---|---|---|---|---|---|
| 221 | 0.0120 | 0.010 | 0.006 | 2 | 168 | 20 |
| 222 | 0.0271 | 0.003 | 0.018 | 6 | 143 | 32 |
| 223 | 0.0277 | 0.007 | 0.009 | 3 | 159 | 9 |
| 224 | 0.0230 | 0.006 | 0.014 | 3 | 168 | 13 |
| 225 | 0.0086 | 0.004 | 0.019 | 4 | 147 | 18 |
| 226 | 0.0089 | 0.009 | 0.002 | 2 | 174 | 19 |
| 227 | 0.0194 | 0.004 | 0.009 | 3 | 177 | 10 |
| 228 | 0.0204 | 0.008 | 0.016 | 2 | 134 | 26 |
| 229 | 0.0067 | 0.004 | 0.002 | 2 | 173 | 18 |
| 230 | 0.0034 | 0.009 | 0.011 | 0 | 170 | 17 |
| 231 | 0.0054 | 0.008 | 0.012 | 4 | 180 | 28 |
| 232 | 0.0227 | 0.010 | 0.020 | 1 | 179 | 36 |
| 233 | 0.0212 | 0.002 | 0.013 | 1 | 170 | 29 |
| 234 | 0.0099 | 0.003 | 0.016 | 7 | 132 | 18 |
| 235 | 0.0147 | 0.005 | 0.018 | 6 | 142 | 24 |
| 236 | 0.0153 | 0.008 | 0.014 | 4 | 177 | 19 |
| 237 | 0.0220 | 0.006 | 0.012 | 0 | 165 | 33 |
| 238 | 0.0147 | 0.009 | 0.017 | 4 | 160 | 25 |
| 239 | 0.0184 | 0.005 | 0.018 | 4 | 138 | 29 |
| 240 | 0.0283 | 0.004 | 0.020 | 3 | 153 | 13 |

TABLE 9-3-continued

STEEL OF INVENTION

| No. | P | S | O | D-CRS | HAZCRS | (Mass. %) M % |
|---|---|---|---|---|---|---|
| 241 | 0.0096 | 0.004 | 0.010 | 2 | 157 | 26 |
| 242 | 0.0171 | 0.001 | 0.015 | 0 | 178 | 19 |
| 243 | 0.0012 | 0.006 | 0.011 | 1 | 169 | 37 |
| 244 | 0.0164 | 0.004 | 0.007 | 5 | 157 | 15 |
| 245 | 0.0286 | 0.003 | 0.016 | 6 | 170 | 9 |
| 246 | 0.0176 | 0.010 | 0.009 | 5 | 136 | 14 |
| 247 | 0.0082 | 0.010 | 0.018 | 1 | 133 | 33 |
| 248 | 0.0253 | 0.002 | 0.004 | 1 | 139 | 31 |
| 249 | 0.0195 | 0.002 | 0.012 | 2 | 155 | 34 |
| 250 | 0.0158 | 0.008 | 0.018 | 4 | 161 | 25 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 10-1

STEEL OF INVENTION

| No. | C | Si | Mn | Cr | Mo | W | V | Nb | (Mass. %) N |
|---|---|---|---|---|---|---|---|---|---|
| 251 | 0.12 | 0.76 | 0.21 | 17.18 | 0.976 | 1.07 | 0.81 | 0.49 | 0.03 |
| 252 | 0.10 | 0.30 | 0.26 | 12.84 | 0.941 | 3.40 | 0.46 | 0.01 | 0.05 |
| 253 | 0.04 | 0.26 | 0.90 | 13.98 | 0.512 | 3.38 | 0.57 | 0.34 | 0.15 |
| 254 | 0.05 | 0.54 | 0.82 | 5.66 | 0.537 | 0.52 | 1.00 | 0.19 | 0.06 |
| 255 | 0.21 | 0.61 | 0.25 | 11.51 | 0.332 | 2.45 | 0.09 | 0.19 | 0.09 |
| 256 | 0.20 | 0.73 | 0.69 | 16.68 | 0.764 | 0.51 | 0.65 | 0.04 | 0.21 |
| 257 | 0.25 | 0.40 | 0.41 | 12.40 | 0.647 | 2.29 | 0.43 | 0.12 | 0.25 |
| 258 | 0.18 | 0.63 | 0.46 | 15.82 | 0.315 | 2.32 | 0.10 | 0.39 | 0.18 |
| 259 | 0.07 | 0.15 | 0.33 | 12.23 | 0.620 | 1.77 | 0.15 | 0.49 | 0.07 |
| 260 | 0.17 | 0.77 | 0.67 | 12.23 | 0.886 | 1.68 | 0.52 | 0.11 | 0.02 |
| 261 | 0.30 | 0.03 | 0.95 | 13.70 | 0.948 | 1.55 | 0.57 | 0.39 | 0.09 |
| 262 | 0.25 | 0.13 | 0.66 | 14.65 | 0.159 | 0.84 | 0.13 | 0.03 | 0.01 |
| 263 | 0.12 | 0.57 | 0.85 | 6.34 | 0.834 | 0.64 | 0.02 | 0.42 | 0.22 |
| 264 | 0.02 | 0.03 | 0.99 | 12.60 | 0.319 | 0.38 | 0.09 | 0.25 | 0.20 |
| 265 | 0.18 | 0.73 | 0.95 | 11.85 | 0.441 | 2.87 | 0.65 | 0.17 | 0.03 |
| 266 | 0.12 | 0.21 | 1.00 | 8.44 | 0.550 | 0.95 | 0.08 | 0.35 | 0.04 |
| 267 | 0.23 | 0.67 | 0.21 | 6.70 | 0.468 | 0.67 | 0.19 | 0.22 | 0.05 |
| 268 | 0.02 | 0.05 | 0.84 | 11.14 | 0.047 | 1.52 | 0.31 | 0.19 | 0.04 |
| 269 | 0.04 | 0.55 | 0.78 | 6.58 | 0.613 | 2.94 | 0.30 | 0.19 | 0.08 |
| 270 | 0.08 | 0.09 | 0.29 | 10.30 | 0.502 | 2.72 | 0.47 | 0.36 | 0.14 |
| 271 | 0.09 | 0.10 | 0.82 | 7.14 | 0.545 | 0.32 | 0.66 | 0.15 | 0.17 |
| 272 | 0.04 | 0.46 | 0.65 | 8.10 | 0.588 | 1.81 | 0.23 | 0.44 | 0.01 |
| 273 | 0.02 | 0.26 | 0.86 | 10.97 | 0.960 | 3.38 | 0.98 | 0.20 | 0.11 |
| 274 | 0.27 | 0.16 | 0.92 | 13.67 | 0.010 | 1.15 | 0.78 | 0.30 | 0.19 |
| 275 | 0.16 | 0.79 | 0.67 | 13.99 | 0.551 | 1.18 | 0.94 | 0.19 | 0.09 |
| 276 | 0.08 | 0.48 | 0.41 | 9.82 | 0.933 | 2.93 | 0.82 | 0.26 | 0.12 |
| 277 | 0.13 | 0.27 | 0.39 | 5.54 | 0.494 | 0.92 | 0.73 | 0.21 | 0.13 |
| 278 | 0.11 | 0.41 | 0.89 | 5.52 | 0.563 | 2.83 | 0.52 | 0.18 | 0.08 |
| 279 | 0.27 | 0.79 | 0.97 | 7.62 | 0.973 | 3.21 | 0.53 | 0.34 | 0.05 |
| 280 | 0.27 | 0.10 | 0.50 | 16.16 | 0.574 | 1.50 | 0.09 | 0.13 | 0.11 |

TABLE 10-2

STEEL OF INVENTION

| No. | Ti | Zr | Ta | Hf | Co | Ni | (Mass. %) Cu |
|---|---|---|---|---|---|---|---|
| 251 | — | 1.532 | 1.968 | 1.534 | — | 2.25 | — |
| 252 | — | 1.831 | 0.924 | 1.529 | — | 0.42 | — |
| 253 | 0.803 | — | 1.189 | 1.203 | — | 1.98 | — |
| 254 | 1.794 | — | 0.446 | 1.234 | — | 3.76 | — |
| 255 | 1.178 | — | 1.347 | 0.282 | — | 4.92 | — |
| 256 | 0.669 | — | 1.568 | 0.006 | — | 2.30 | — |

TABLE 10-2-continued

STEEL OF INVENTION

| No. | Ti | Zr | Ta | Hf | Co | Ni | (Mass. %) Cu |
|---|---|---|---|---|---|---|---|
| 257 | 1.865 | — | 1.787 | 0.110 | — | 2.35 | — |
| 258 | 1.510 | — | 1.686 | 1.249 | — | 4.24 | — |
| 259 | 0.248 | 0.985 | — | 1.109 | — | 2.42 | — |
| 260 | 0.747 | 1.654 | — | 0.344 | — | 3.26 | — |
| 261 | 0.690 | 1.627 | — | 0.621 | — | 3.56 | — |
| 262 | 0.733 | 0.594 | — | 0.632 | — | 2.61 | — |
| 263 | 1.562 | 1.228 | — | 0.042 | — | 4.34 | — |
| 264 | 1.829 | 0.192 | — | 1.507 | — | 0.81 | — |
| 265 | 0.239 | 0.167 | 0.176 | 1.724 | — | 0.82 | — |
| 266 | 0.432 | 0.819 | 0.623 | 0.357 | — | 1.19 | — |
| 267 | 1.083 | 1.821 | 0.789 | 1.070 | — | 1.12 | — |
| 268 | 1.896 | 1.854 | 0.352 | 0.550 | — | 2.25 | — |
| 269 | 0.526 | 1.566 | 0.959 | 1.438 | — | 1.33 | — |
| 270 | 1.625 | 0.646 | 0.293 | 0.424 | — | 4.80 | — |
| 271 | 0.875 | — | — | — | 4.92 | 4.72 | — |
| 272 | 1.948 | — | — | — | 1.30 | 2.68 | — |
| 273 | 0.540 | — | — | — | 1.21 | 0.25 | — |
| 274 | 0.300 | — | — | — | 3.89 | 1.47 | — |
| 275 | 1.883 | — | — | — | 1.33 | 0.73 | — |
| 276 | 0.993 | — | — | — | 4.81 | 2.10 | — |
| 277 | — | 1.883 | — | — | 1.49 | 2.39 | — |
| 278 | — | 1.083 | — | — | 2.60 | 3.16 | — |
| 279 | — | 1.692 | — | — | 4.94 | 1.25 | — |
| 280 | — | 0.390 | — | — | 0.53 | 3.06 | — |

TABLE 10-3

STEEL OF INVENTION

| No. | P | S | O | D-CRS | HAZCRS | (Mass. %) M % |
|---|---|---|---|---|---|---|
| 251 | 0.0093 | 0.002 | 0.019 | 6 | 158 | 51 |
| 252 | 0.0095 | 0.004 | 0.003 | 6 | 174 | 45 |
| 253 | 0.0271 | 0.009 | 0.015 | 4 | 137 | 31 |
| 254 | 0.0121 | 0.005 | 0.004 | 2 | 176 | 33 |
| 255 | 0.0193 | 0.006 | 0.004 | 1 | 166 | 28 |
| 256 | 0.0288 | 0.008 | 0.013 | 2 | 162 | 31 |
| 257 | 0.0210 | 0.007 | 0.017 | 5 | 141 | 36 |
| 258 | 0.0208 | 0.006 | 0.015 | 1 | 156 | 47 |
| 259 | 0.0233 | 0.007 | 0.002 | 4 | 134 | 30 |
| 260 | 0.0086 | 0.004 | 0.004 | 4 | 154 | 31 |
| 261 | 0.0164 | 0.006 | 0.018 | 6 | 142 | 29 |
| 262 | 0.0124 | 0.005 | 0.012 | 2 | 177 | 23 |
| 263 | 0.0212 | 0.006 | 0.012 | 1 | 137 | 36 |
| 264 | 0.0232 | 0.006 | 0.005 | 6 | 148 | 38 |
| 265 | 0.0132 | 0.004 | 0.008 | 5 | 140 | 27 |
| 266 | 0.0018 | 0.007 | 0.006 | 4 | 139 | 22 |
| 267 | 0.0133 | 0.002 | 0.017 | 2 | 173 | 44 |
| 268 | 0.0283 | 0.003 | 0.008 | 4 | 146 | 48 |
| 269 | 0.0116 | 0.002 | 0.015 | 3 | 134 | 41 |
| 270 | 0.0186 | 0.004 | 0.015 | 5 | 141 | 37 |
| 271 | 0.0142 | 0.009 | 0.006 | 0 | 144 | 19 |
| 272 | 0.0086 | 0.002 | 0.012 | 6 | 172 | 29 |
| 273 | 0.0114 | 0.004 | 0.002 | 4 | 151 | 12 |
| 274 | 0.0184 | 0.009 | 0.011 | 3 | 159 | 9 |
| 275 | 0.0239 | 0.005 | 0.016 | 6 | 150 | 22 |
| 276 | 0.0087 | 0.007 | 0.006 | 4 | 150 | 14 |
| 277 | 0.0127 | 0.002 | 0.006 | 4 | 164 | 21 |
| 278 | 0.0157 | 0.003 | 0.003 | 0 | 168 | 15 |
| 279 | 0.0279 | 0.008 | 0.002 | 3 | 140 | 23 |
| 280 | 0.0296 | 0.003 | 0.002 | 3 | 157 | 11 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 11-1

STEEL OF INVENTION (Mass. %)

| No. | C | Si | Mn | Cr | Mo | W | V | Nb | N |
|---|---|---|---|---|---|---|---|---|---|
| 281 | 0.21 | 0.16 | 0.55 | 9.60 | 0.692 | 0.45 | 0.04 | 0.45 | 0.24 |
| 282 | 0.04 | 0.07 | 1.00 | 11.83 | 0.171 | 1.18 | 0.69 | 0.47 | 0.03 |
| 283 | 0.15 | 0.09 | 0.50 | 14.04 | 0.827 | 1.50 | 0.42 | 0.37 | 0.05 |
| 284 | 0.05 | 0.48 | 0.93 | 7.76 | 0.514 | 0.83 | 0.03 | 0.06 | 0.24 |
| 285 | 0.13 | 0.33 | 0.95 | 16.76 | 0.069 | 0.36 | 0.37 | 0.20 | 0.10 |
| 286 | 0.20 | 0.30 | 0.84 | 13.00 | 0.319 | 1.12 | 0.28 | 0.46 | 0.06 |
| 287 | 0.07 | 0.65 | 0.86 | 13.75 | 0.599 | 2.61 | 0.10 | 0.27 | 0.21 |
| 288 | 0.13 | 0.07 | 0.49 | 10.48 | 0.256 | 2.63 | 0.64 | 0.29 | 0.02 |
| 289 | 0.03 | 0.40 | 0.39 | 7.51 | 0.118 | 2.29 | 0.27 | 0.19 | 0.06 |
| 290 | 0.17 | 0.72 | 0.43 | 15.69 | 0.023 | 1.04 | 0.79 | 0.38 | 0.04 |
| 291 | 0.20 | 0.13 | 0.48 | 6.91 | 0.801 | 1.64 | 0.08 | 0.29 | 0.18 |
| 292 | 0.08 | 0.05 | 0.80 | 17.97 | 0.794 | 0.25 | 0.43 | 0.32 | 0.17 |
| 293 | 0.05 | 0.36 | 0.87 | 7.79 | 0.338 | 2.92 | 0.21 | 0.41 | 0.24 |
| 294 | 0.07 | 0.15 | 0.95 | 13.30 | 0.768 | 2.54 | 0.73 | 0.47 | 0.10 |
| 295 | 0.22 | 0.08 | 0.52 | 6.30 | 0.424 | 1.85 | 0.35 | 0.41 | 0.06 |
| 296 | 0.18 | 0.40 | 0.65 | 17.17 | 0.631 | 0.29 | 0.39 | 0.17 | 0.22 |
| 297 | 0.19 | 0.21 | 0.79 | 17.72 | 0.737 | 2.30 | 0.20 | 0.39 | 0.16 |
| 298 | 0.20 | 0.55 | 0.42 | 12.37 | 0.565 | 2.34 | 0.59 | 0.25 | 0.10 |
| 299 | 0.15 | 0.51 | 0.61 | 11.99 | 0.964 | 3.24 | 0.42 | 0.41 | 0.11 |
| 300 | 0.16 | 0.74 | 0.43 | 14.49 | 0.270 | 2.76 | 0.04 | 0.31 | 0.03 |
| 301 | 0.02 | 0.34 | 0.54 | 17.69 | 0.808 | 2.03 | 0.73 | 0.35 | 0.19 |
| 302 | 0.13 | 0.75 | 0.43 | 6.51 | 0.925 | 0.51 | 0.88 | 0.21 | 0.18 |
| 303 | 0.29 | 0.64 | 0.34 | 11.22 | 0.948 | 2.58 | 0.81 | 0.05 | 0.08 |
| 304 | 0.15 | 0.30 | 0.56 | 16.62 | 0.212 | 1.09 | 0.84 | 0.27 | 0.22 |
| 305 | 0.27 | 0.76 | 0.55 | 7.85 | 0.066 | 2.15 | 0.82 | 0.32 | 0.08 |
| 306 | 0.15 | 0.73 | 0.98 | 8.57 | 0.328 | 0.23 | 0.59 | 0.10 | 0.08 |
| 307 | 0.17 | 0.07 | 0.90 | 16.38 | 0.324 | 1.35 | 0.49 | 0.02 | 0.09 |
| 308 | 0.15 | 0.21 | 1.00 | 16.52 | 0.413 | 3.37 | 0.79 | 0.02 | 0.17 |
| 309 | 0.19 | 0.26 | 0.36 | 7.00 | 0.945 | 0.84 | 0.92 | 0.50 | 0.17 |
| 310 | 0.09 | 0.10 | 0.43 | 11.53 | 0.243 | 3.12 | 0.70 | 0.40 | 0.06 |

TABLE 11-2

STEEL OF INVENTION (Mass. %)

| No. | Ti | Zr | Ta | Hf | Co | Ni | Cu |
|---|---|---|---|---|---|---|---|
| 281 | — | 1.822 | — | — | 0.53 | 0.58 | — |
| 282 | — | 0.712 | — | — | 4.25 | 2.69 | — |
| 283 | 0.574 | 0.683 | — | — | 1.21 | 3.71 | — |
| 284 | 1.971 | 1.393 | — | — | 2.64 | 0.50 | — |
| 285 | 0.951 | 0.559 | — | — | 0.57 | 4.25 | — |
| 286 | 0.147 | 1.851 | — | — | 1.46 | 2.28 | — |
| 287 | 1.251 | 1.941 | — | — | 2.12 | 0.94 | — |
| 288 | 1.925 | 0.495 | — | — | 1.71 | 1.80 | — |
| 289 | — | — | 0.602 | — | 4.25 | 1.71 | — |
| 290 | — | — | 0.709 | — | 4.21 | 4.71 | — |
| 291 | — | — | 0.651 | — | 3.13 | 0.35 | — |
| 292 | — | — | 1.113 | — | 0.25 | 4.68 | — |
| 293 | — | — | 1.738 | — | 1.96 | 2.45 | — |
| 294 | — | — | 0.233 | — | 0.29 | 2.57 | — |
| 295 | 1.277 | — | 1.252 | — | 4.05 | 4.16 | — |
| 296 | 1.752 | — | 1.482 | — | 0.48 | 1.73 | — |
| 297 | 1.867 | — | 1.586 | — | 0.75 | 1.61 | — |
| 298 | 0.258 | — | 1.229 | — | 4.10 | 3.06 | — |
| 299 | 1.616 | — | 0.091 | — | 4.93 | 0.46 | — |
| 300 | 1.633 | — | 1.842 | — | 2.47 | 2.65 | — |
| 301 | — | 0.207 | 0.156 | — | 0.70 | 4.02 | — |
| 302 | — | 0.750 | 0.712 | — | 3.68 | 1.40 | — |
| 303 | — | 0.823 | 1.165 | — | 0.99 | 1.22 | — |
| 304 | — | 1.106 | 1.196 | — | 1.43 | 0.25 | — |
| 305 | — | 0.272 | 1.475 | — | 1.84 | 4.92 | — |
| 306 | — | 0.980 | 1.667 | — | 1.38 | 4.80 | — |
| 307 | 0.959 | 1.913 | 1.452 | — | 4.15 | 3.97 | — |
| 308 | 0.239 | 1.730 | 1.484 | — | 2.05 | 1.60 | — |
| 309 | 0.234 | 0.142 | 0.479 | — | 1.62 | 4.15 | — |
| 310 | 0.586 | 0.789 | 1.078 | — | 4.41 | 1.21 | — |

TABLE 11-3

STEEL OF INVENTION (Mass. %)

| No. | P | S | O | D-CRS | HAZCRS | M % |
|---|---|---|---|---|---|---|
| 281 | 0.0006 | 0.008 | 0.018 | 3 | 149 | 19 |
| 282 | 0.0259 | 0.009 | 0.019 | 6 | 142 | 19 |
| 283 | 0.0106 | 0.004 | 0.010 | 7 | 139 | 17 |
| 284 | 0.0248 | 0.009 | 0.018 | 4 | 167 | 39 |
| 285 | 0.0186 | 0.006 | 0.010 | 4 | 131 | 19 |
| 286 | 0.0028 | 0.010 | 0.012 | 6 | 156 | 28 |
| 287 | 0.0166 | 0.006 | 0.012 | 1 | 172 | 36 |
| 288 | 0.0106 | 0.008 | 0.015 | 5 | 156 | 29 |
| 289 | 0.0243 | 0.008 | 0.010 | 1 | 134 | 17 |
| 290 | 0.0235 | 0.009 | 0.012 | 1 | 137 | 10 |
| 291 | 0.0029 | 0.007 | 0.017 | 3 | 140 | 13 |
| 292 | 0.0171 | 0.007 | 0.004 | 7 | 172 | 15 |
| 293 | 0.0018 | 0.009 | 0.009 | 4 | 160 | 20 |
| 294 | 0.0268 | 0.003 | 0.017 | 4 | 133 | 16 |
| 295 | 0.0125 | 0.004 | 0.016 | 3 | 167 | 34 |
| 296 | 0.0286 | 0.007 | 0.014 | 1 | 141 | 38 |
| 297 | 0.0256 | 0.002 | 0.015 | 6 | 133 | 31 |
| 298 | 0.0133 | 0.009 | 0.009 | 6 | 169 | 18 |
| 299 | 0.0016 | 0.009 | 0.019 | 6 | 179 | 21 |
| 300 | 0.0008 | 0.009 | 0.005 | 6 | 139 | 41 |
| 301 | 0.0209 | 0.008 | 0.002 | 4 | 177 | 15 |
| 302 | 0.0271 | 0.009 | 0.016 | 2 | 171 | 17 |
| 303 | 0.0147 | 0.006 | 0.015 | 0 | 174 | 22 |
| 304 | 0.0232 | 0.003 | 0.007 | 0 | 164 | 28 |
| 305 | 0.0032 | 0.005 | 0.015 | 4 | 143 | 26 |
| 306 | 0.0239 | 0.004 | 0.009 | 1 | 139 | 33 |
| 307 | 0.0065 | 0.006 | 0.005 | 2 | 180 | 40 |
| 308 | 0.0204 | 0.006 | 0.018 | 1 | 143 | 33 |
| 309 | 0.0012 | 0.006 | 0.008 | 7 | 131 | 14 |
| 310 | 0.0183 | 0.002 | 0.018 | 0 | 172 | 31 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 12-1

STEEL OF INVENTION (Mass. %)

| No. | C | Si | Mn | Cr | Mo | W | V | Nb | N |
|---|---|---|---|---|---|---|---|---|---|
| 311 | 0.10 | 0.74 | 0.29 | 14.89 | 0.132 | 1.34 | 0.43 | 0.12 | 0.14 |
| 312 | 0.03 | 0.13 | 0.20 | 8.54 | 0.953 | 3.26 | 0.95 | 0.33 | 0.14 |
| 313 | 0.10 | 0.47 | 0.84 | 16.34 | 0.552 | 1.73 | 0.14 | 0.45 | 0.03 |
| 314 | 0.29 | 0.07 | 0.46 | 10.07 | 0.749 | 2.80 | 0.77 | 0.41 | 0.23 |
| 315 | 0.24 | 0.76 | 0.95 | 7.19 | 0.887 | 2.62 | 0.23 | 0.11 | 0.24 |
| 316 | 0.21 | 0.05 | 0.56 | 5.37 | 0.799 | 2.30 | 0.31 | 0.45 | 0.25 |
| 317 | 0.14 | 0.18 | 0.76 | 15.68 | 0.326 | 2.95 | 0.87 | 0.40 | 0.22 |
| 318 | 0.28 | 0.62 | 0.63 | 16.48 | 0.800 | 0.76 | 0.26 | 0.34 | 0.24 |
| 319 | 0.14 | 0.06 | 0.44 | 12.09 | 0.065 | 3.41 | 0.30 | 0.44 | 0.02 |
| 320 | 0.26 | 0.35 | 0.84 | 6.87 | 0.444 | 2.10 | 0.81 | 0.14 | 0.12 |
| 321 | 0.15 | 0.56 | 0.52 | 11.65 | 0.278 | 2.91 | 0.67 | 0.09 | 0.16 |
| 322 | 0.21 | 0.56 | 0.54 | 17.85 | 0.403 | 0.32 | 0.67 | 0.45 | 0.19 |
| 323 | 0.23 | 0.24 | 0.36 | 10.32 | 0.656 | 0.43 | 0.67 | 0.16 | 0.08 |
| 324 | 0.17 | 0.63 | 0.67 | 6.44 | 0.375 | 1.02 | 0.50 | 0.37 | 0.13 |
| 325 | 0.29 | 0.05 | 0.52 | 17.17 | 0.401 | 1.58 | 0.51 | 0.27 | 0.07 |
| 326 | 0.08 | 0.31 | 0.99 | 14.24 | 0.060 | 1.53 | 0.03 | 0.50 | 0.10 |
| 327 | 0.23 | 0.12 | 0.74 | 15.10 | 0.691 | 2.00 | 0.37 | 0.50 | 0.06 |
| 328 | 0.26 | 0.52 | 0.84 | 11.02 | 0.629 | 0.79 | 0.88 | 0.18 | 0.03 |
| 329 | 0.26 | 0.22 | 0.77 | 12.93 | 0.212 | 0.64 | 0.41 | 0.44 | 0.21 |
| 330 | 0.19 | 0.25 | 0.38 | 5.69 | 0.273 | 1.06 | 0.29 | 0.48 | 0.21 |
| 331 | 0.28 | 0.09 | 0.35 | 13.06 | 0.640 | 1.43 | 0.84 | 0.45 | 0.09 |
| 332 | 0.21 | 0.40 | 0.95 | 13.62 | 0.668 | 2.94 | 0.91 | 0.28 | 0.07 |
| 333 | 0.21 | 0.67 | 0.85 | 11.63 | 0.684 | 3.36 | 0.85 | 0.36 | 0.09 |
| 334 | 0.23 | 0.36 | 0.31 | 11.46 | 0.026 | 0.51 | 0.97 | 0.39 | 0.14 |
| 335 | 0.09 | 0.54 | 0.81 | 17.53 | 0.522 | 0.44 | 0.13 | 0.03 | 0.04 |
| 336 | 0.03 | 0.66 | 0.61 | 8.04 | 0.019 | 2.60 | 0.15 | 0.43 | 0.23 |
| 337 | 0.28 | 0.62 | 0.37 | 6.98 | 0.339 | 1.51 | 0.85 | 0.03 | 0.20 |

TABLE 12-1-continued

STEEL OF INVENTION (Mass. %)

| No. | C | Si | Mn | Cr | Mo | W | V | Nb | N |
|---|---|---|---|---|---|---|---|---|---|
| 338 | 0.22 | 0.67 | 0.78 | 12.20 | 0.327 | 1.57 | 0.10 | 0.24 | 0.14 |
| 339 | 0.10 | 0.29 | 0.90 | 8.67 | 0.824 | 2.27 | 0.71 | 0.47 | 0.03 |
| 340 | 0.15 | 0.53 | 0.60 | 7.17 | 0.663 | 3.05 | 0.54 | 0.40 | 0.17 |

TABLE 12-2

STEEL OF INVENTION (Mass. %)

| No. | Ti | Zr | Ta | Hf | Co | Ni | Cu |
|---|---|---|---|---|---|---|---|
| 311 | 1.965 | 0.352 | 1.955 | — | 2.43 | 3.98 | — |
| 312 | 0.054 | 0.505 | 1.795 | — | 4.50 | 2.06 | — |
| 313 | — | — | — | 1.693 | 0.23 | 4.31 | — |
| 314 | — | — | — | 1.243 | 0.81 | 0.29 | — |
| 315 | — | — | — | 0.129 | 3.07 | 3.63 | — |
| 316 | — | — | — | 0.034 | 1.47 | 3.98 | — |
| 317 | — | — | — | 0.616 | 4.78 | 0.50 | — |
| 318 | — | — | — | 1.532 | 2.57 | 2.03 | — |
| 319 | 1.707 | — | — | 0.482 | 1.32 | 2.97 | — |
| 320 | 1.592 | — | — | 1.121 | 2.61 | 2.54 | — |
| 321 | 1.218 | — | — | 1.121 | 3.243 | 4.73 | — |
| 322 | 0.266 | — | — | 0.167 | 2.46 | 3.99 | — |
| 323 | 1.393 | — | — | 1.917 | 1.86 | 4.32 | — |
| 324 | 0.313 | — | — | 1.054 | 3.06 | 2.51 | — |
| 325 | — | 0.257 | — | 0.237 | 0.45 | 4.98 | — |
| 326 | — | 1.130 | — | 1.148 | 2.86 | 3.76 | — |
| 327 | — | 0.652 | — | 0.44 | 4.71 | 2.88 | — |
| 328 | — | 1.522 | — | 0.823 | 2.82 | 1.52 | — |
| 329 | — | 1.408 | — | 1.947 | 3.61 | 1.32 | — |
| 330 | — | 0.965 | — | 0.483 | 3.85 | 3.85 | — |
| 331 | — | — | 1.949 | 1.098 | 2.78 | 1.15 | — |
| 332 | — | — | 1.906 | 1.463 | 1.98 | 1.98 | — |
| 333 | — | — | 0.919 | 0.267 | 3.09 | 0.85 | — |
| 334 | — | — | 1.668 | 0.168 | 0.56 | 1.74 | — |
| 335 | — | — | 1.800 | 0.808 | 3.05 | 3.71 | — |
| 336 | — | — | 0.987 | 1.876 | 0.29 | 1.33 | — |
| 337 | — | 0.199 | 0.960 | 1.110 | 1.18 | 1.10 | — |
| 338 | — | 1.373 | 1.368 | 1.138 | 4.86 | 2.12 | — |
| 339 | — | 0.261 | 0.847 | 1.601 | 0.87 | 3.55 | — |
| 340 | — | 0.544 | 1.096 | 0.207 | 2.89 | 4.68 | — |

TABLE 12-3

STEEL OF INVENTION (Mass. %)

| No. | P | S | O | D-CRS | HAZCRS | M % |
|---|---|---|---|---|---|---|
| 311 | 0.0076 | 0.003 | 0.018 | 5 | 169 | 47 |
| 312 | 0.0083 | 0.006 | 0.003 | 2 | 149 | 26 |
| 313 | 0.0161 | 0.003 | 0.009 | 5 | 141 | 18 |
| 314 | 0.0256 | 0.003 | 0.014 | 2 | 171 | 24 |
| 315 | 0.0026 | 0.003 | 0.015 | 1 | 168 | 14 |
| 316 | 0.0016 | 0.003 | 0.008 | 7 | 159 | 10 |
| 317 | 0.0027 | 0.004 | 0.019 | 6 | 172 | 12 |
| 318 | 0.0012 | 0.003 | 0.006 | 1 | 135 | 21 |
| 319 | 0.0218 | 0.005 | 0.005 | 2 | 151 | 24 |
| 320 | 0.0299 | 0.009 | 0.013 | 1 | 172 | 27 |
| 321 | 0.0206 | 0.001 | 0.007 | 6 | 175 | 30 |
| 322 | 0.0189 | 0.006 | 0.004 | 2 | 140 | 14 |
| 323 | 0.0199 | 0.009 | 0.009 | 4 | 168 | 33 |
| 324 | 0.0036 | 0.008 | 0.020 | 1 | 162 | 23 |
| 325 | 0.0100 | 0.002 | 0.014 | 1 | 151 | 16 |
| 326 | 0.0193 | 0.003 | 0.007 | 5 | 161 | 23 |
| 327 | 0.0266 | 0.010 | 0.016 | 6 | 170 | 18 |
| 328 | 0.0273 | 0.003 | 0.017 | 2 | 156 | 32 |
| 329 | 0.0012 | 0.003 | 0.019 | 3 | 148 | 40 |
| 330 | 0.0180 | 0.008 | 0.007 | 6 | 147 | 23 |

TABLE 12-3-continued

STEEL OF INVENTION (Mass. %)

| No. | P | S | O | D-CRS | HAZCRS | M % |
|---|---|---|---|---|---|---|
| 331 | 0.0281 | 0.009 | 0.007 | 6 | 156 | 35 |
| 332 | 0.0264 | 0.003 | 0.016 | 6 | 153 | 36 |
| 333 | 0.0086 | 0.008 | 0.013 | 6 | 166 | 16 |
| 334 | 0.0139 | 0.003 | 0.002 | 2 | 148 | 21 |
| 335 | 0.0224 | 0.006 | 0.011 | 6 | 151 | 31 |
| 336 | 0.0149 | 0.005 | 0.006 | 3 | 153 | 28 |
| 337 | 0.0166 | 0.008 | 0.005 | 6 | 132 | 24 |
| 338 | 0.0220 | 0.006 | 0.003 | 6 | 166 | 38 |
| 339 | 0.0262 | 0.004 | 0.018 | 0 | 131 | 33 |
| 340 | 0.0095 | 0.007 | 0.016 | 7 | 157 | 27 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 13-1

STEEL OF INVENTION (Mass. %)

| No. | C | Si | Mn | Cr | Mo | W | V | Nb | N |
|---|---|---|---|---|---|---|---|---|---|
| 341 | 0.04 | 0.08 | 0.54 | 5.41 | 0.168 | 3.33 | 0.89 | 0.19 | 0.17 |
| 342 | 0.30 | 0.77 | 0.60 | 8.00 | 0.184 | 2.60 | 0.64 | 0.02 | 0.22 |
| 343 | 0.16 | 0.13 | 0.23 | 12.67 | 0.053 | 2.00 | 0.10 | 0.28 | 0.18 |
| 344 | 0.14 | 0.37 | 0.92 | 17.37 | 0.596 | 0.93 | 0.11 | 0.41 | 0.24 |
| 345 | 0.21 | 0.59 | 0.94 | 6.88 | 0.665 | 2.20 | 0.49 | 0.34 | 0.11 |
| 346 | 0.03 | 0.66 | 0.54 | 5.17 | 0.092 | 0.30 | 0.11 | 0.22 | 0.01 |
| 347 | 0.26 | 0.44 | 0.40 | 10.05 | 0.206 | 2.93 | 0.28 | 0.46 | 0.01 |
| 348 | 0.30 | 0.60 | 0.39 | 6.34 | 0.342 | 2.94 | 0.34 | 0.49 | 0.20 |
| 349 | 0.07 | 0.22 | 0.38 | 18.00 | 0.346 | 3.10 | 0.63 | 0.48 | 0.16 |
| 350 | 0.13 | 0.34 | 0.63 | 16.75 | 0.539 | 2.88 | 0.98 | 0.10 | 0.11 |
| 351 | 0.13 | 0.06 | 0.61 | 7.17 | 0.277 | 3.38 | 0.26 | 0.01 | 0.25 |
| 352 | 0.03 | 0.04 | 0.20 | 6.57 | 0.387 | 2.43 | 0.76 | 0.13 | 0.17 |
| 353 | 0.20 | 0.53 | 0.46 | 6.21 | 0.201 | 1.10 | 0.83 | 0.13 | 0.20 |
| 354 | 0.18 | 0.62 | 0.86 | 17.01 | 0.057 | 2.16 | 0.81 | 0.42 | 0.17 |
| 355 | 0.05 | 0.18 | 0.47 | 10.84 | 0.782 | 3.42 | 0.54 | 0.42 | 0.05 |
| 356 | 0.06 | 0.64 | 0.35 | 11.51 | 0.730 | 2.69 | 0.85 | 0.07 | 0.03 |
| 357 | 0.17 | 0.33 | 0.79 | 10.50 | 0.230 | 2.75 | 0.58 | 0.01 | 0.09 |
| 358 | 0.02 | 0.28 | 0.43 | 5.52 | 0.600 | 2.99 | 0.05 | 0.16 | 0.05 |
| 359 | 0.02 | 0.35 | 0.34 | 7.34 | 0.681 | 2.89 | 0.10 | 0.44 | 0.12 |
| 360 | 0.11 | 0.43 | 0.42 | 14.27 | 0.844 | 2.01 | 0.59 | 0.30 | 0.02 |
| 361 | 0.25 | 0.40 | 0.53 | 11.04 | 0.407 | 3.04 | 0.36 | 0.13 | 0.20 |
| 362 | 0.09 | 0.12 | 0.52 | 14.75 | 0.187 | 2.10 | 0.21 | 0.09 | 0.12 |
| 363 | 0.18 | 0.62 | 0.27 | 10.49 | 0.036 | 2.00 | 0.97 | 0.10 | 0.12 |
| 364 | 0.03 | 0.23 | 0.85 | 9.05 | 0.284 | 2.18 | 0.04 | 0.10 | 0.15 |
| 365 | 0.16 | 0.38 | 0.53 | 8.42 | 0.777 | 2.12 | 0.20 | 0.49 | 0.06 |
| 366 | 0.11 | 0.54 | 0.37 | 12.80 | 0.344 | 2.88 | 0.79 | 0.44 | 0.03 |
| 367 | 0.25 | 0.60 | 0.64 | 7.02 | 0.311 | 0.65 | 0.66 | 0.37 | 0.04 |
| 368 | 0.25 | 0.02 | 0.42 | 15.15 | 0.529 | 1.50 | 0.16 | 0.21 | 0.17 |
| 369 | 0.21 | 0.25 | 0.77 | 15.44 | 0.331 | 3.23 | 0.10 | 0.11 | 0.13 |
| 370 | 0.07 | 0.77 | 0.76 | 12.22 | 0.544 | 0.32 | 0.31 | 0.23 | 0.13 |

TABLE 13-2

STEEL OF INVENTION (Mass. %)

| No. | Ti | Zr | Ta | Hf | Co | Ni | Cu |
|---|---|---|---|---|---|---|---|
| 341 | — | 0.887 | 1.780 | 1.610 | 0.52 | 2.29 | — |
| 342 | — | 0.994 | 0.592 | 1.507 | 2.62 | 0.45 | — |
| 343 | 0.348 | — | 0.174 | 1.543 | 1.10 | 0.69 | — |
| 344 | 1.622 | — | 0.191 | 0.385 | 4.84 | 2.25 | — |
| 345 | 1.781 | — | 1.336 | 1.719 | 1.03 | 1.95 | — |
| 346 | 1.478 | — | 0.290 | 0.230 | 0.91 | 3.83 | — |

TABLE 13-2-continued

STEEL OF INVENTION

| No. | Ti | Zr | Ta | Hf | Co | Ni | Cu (Mass. %) |
|---|---|---|---|---|---|---|---|
| 347 | 0.402 | — | 1.705 | 1.569 | 1.28 | 2.27 | — |
| 348 | 0.205 | — | 1.264 | 1.418 | 1.34 | 1.28 | — |
| 349 | 1.566 | 1.846 | — | 1.445 | 0.31 | 4.89 | — |
| 350 | 0.166 | 0.064 | — | 1.322 | 2.21 | 2.70 | — |
| 351 | 1.679 | 1.062 | — | 1.712 | 1.41 | 1.11 | — |
| 352 | 0.775 | 0.508 | — | 1.290 | 4.35 | 1.72 | — |
| 353 | 1.108 | 1.097 | — | 1.754 | 0.70 | 3.83 | — |
| 354 | 0.365 | 0.493 | — | 1.750 | 1.60 | 4.18 | — |
| 355 | 0.197 | 0.371 | 0.494 | 1.962 | 3.91 | 4.41 | — |
| 356 | 0.307 | 1.385 | 0.353 | 1.051 | 4.39 | 1.30 | — |
| 357 | 0.354 | 0.230 | 0.404 | 1.689 | 2.27 | 3.65 | — |
| 358 | 1.966 | 1.537 | 1.288 | 0.549 | 1.58 | 1.13 | — |
| 359 | 0.872 | 1.011 | 1.703 | 1.293 | 1.49 | 4.89 | — |
| 360 | 0.766 | 1.341 | 1.345 | 0.632 | 3.70 | 4.63 | — |
| 361 | 1.274 | — | — | — | — | — | 0.78 |
| 362 | 0.074 | — | — | — | — | — | 1.77 |
| 363 | 1.826 | — | — | — | — | — | 1.57 |
| 364 | 1.239 | — | — | — | — | — | 0.80 |
| 365 | 0.962 | — | — | — | — | — | 0.95 |
| 366 | 0.660 | — | — | — | — | — | 1.73 |
| 367 | — | 1.386 | — | — | — | — | 1.95 |
| 368 | — | 0.581 | — | — | — | — | 1.32 |
| 369 | — | 0.640 | — | — | — | — | 1.31 |
| 370 | — | 0.253 | — | — | — | — | 0.76 |

TABLE 13-3

STEEL OF INVENTION

| No. | P | S | O | D-CRS | HAZCRS | M % (Mass. %) |
|---|---|---|---|---|---|---|
| 341 | 0.0268 | 0.009 | 0.015 | 4 | 170 | 44 |
| 342 | 0.0284 | 0.003 | 0.020 | 2 | 149 | 37 |
| 343 | 0.0094 | 0.005 | 0.019 | 6 | 146 | 30 |
| 344 | 0.0242 | 0.006 | 0.008 | 7 | 138 | 26 |
| 345 | 0.0236 | 0.005 | 0.014 | 5 | 180 | 51 |
| 346 | 0.0028 | 0.007 | 0.014 | 6 | 148 | 20 |
| 347 | 0.0164 | 0.004 | 0.004 | 1 | 169 | 40 |
| 348 | 0.0144 | 0.002 | 0.002 | 4 | 173 | 27 |
| 349 | 0.0075 | 0.005 | 0.002 | 5 | 161 | 43 |
| 350 | 0.0200 | 0.002 | 0.013 | 1 | 161 | 26 |
| 351 | 0.0026 | 0.009 | 0.003 | 5 | 177 | 40 |
| 352 | 0.0098 | 0.003 | 0.005 | 4 | 136 | 26 |
| 353 | 0.0222 | 0.005 | 0.008 | 5 | 164 | 42 |
| 354 | 0.0199 | 0.004 | 0.019 | 2 | 166 | 26 |
| 355 | 0.0128 | 0.008 | 0.004 | 2 | 170 | 30 |
| 356 | 0.0109 | 0.006 | 0.010 | 4 | 176 | 32 |
| 357 | 0.0239 | 0.005 | 0.003 | 6 | 165 | 26 |
| 358 | 0.0029 | 0.005 | 0.011 | 5 | 162 | 46 |
| 359 | 0.0019 | 0.004 | 0.009 | 0 | 146 | 50 |
| 360 | 0.0018 | 0.004 | 0.006 | 0 | 146 | 45 |
| 361 | 0.0121 | 0.010 | 0.016 | 3 | 137 | 24 |
| 362 | 0.0282 | 0.005 | 0.008 | 5 | 173 | 9 |
| 363 | 0.0151 | 0.002 | 0.008 | 6 | 133 | 26 |
| 364 | 0.0279 | 0.004 | 0.012 | 4 | 168 | 20 |
| 365 | 0.0018 | 0.010 | 0.008 | 3 | 156 | 18 |
| 366 | 0.0213 | 0.008 | 0.002 | 3 | 175 | 13 |
| 367 | 0.0223 | 0.002 | 0.020 | 6 | 153 | 22 |
| 368 | 0.0293 | 0.005 | 0.020 | 0 | 168 | 17 |
| 369 | 0.0077 | 0.009 | 0.018 | 6 | 146 | 16 |
| 370 | 0.0122 | 0.005 | 0.011 | 3 | 167 | 11 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 14-1

STEEL OF INVENTION

| No. | C | Si | Mn | Cr | Mo | W | V | Nb | N (Mass. %) |
|---|---|---|---|---|---|---|---|---|---|
| 371 | 0.08 | 0.27 | 0.26 | 16.45 | 0.018 | 2.17 | 0.65 | 0.02 | 0.01 |
| 372 | 0.20 | 0.20 | 0.73 | 6.46 | 0.575 | 3.27 | 0.94 | 0.12 | 0.09 |
| 373 | 0.08 | 0.02 | 0.45 | 6.10 | 0.063 | 3.07 | 0.05 | 0.46 | 0.08 |
| 374 | 0.12 | 0.79 | 0.49 | 6.75 | 0.806 | 2.70 | 0.26 | 0.21 | 0.07 |
| 375 | 0.11 | 0.43 | 0.71 | 12.68 | 0.144 | 3.22 | 0.92 | 0.03 | 0.02 |
| 376 | 0.02 | 0.76 | 0.58 | 8.94 | 0.916 | 0.85 | 0.91 | 0.34 | 0.25 |
| 377 | 0.23 | 0.07 | 0.78 | 12.81 | 0.463 | 3.28 | 0.53 | 0.31 | 0.12 |
| 378 | 0.25 | 0.22 | 0.37 | 9.20 | 0.114 | 1.71 | 0.13 | 0.12 | 0.20 |
| 379 | 0.19 | 0.28 | 0.41 | 8.84 | 0.204 | 0.54 | 0.03 | 0.41 | 0.07 |
| 380 | 0.15 | 0.13 | 0.38 | 16.29 | 0.071 | 0.58 | 0.07 | 0.36 | 0.07 |
| 381 | 0.21 | 0.80 | 0.54 | 16.16 | 0.047 | 2.22 | 0.09 | 0.41 | 0.03 |
| 382 | 0.19 | 0.22 | 0.77 | 12.97 | 0.962 | 0.66 | 0.42 | 0.44 | 0.15 |
| 383 | 0.03 | 0.21 | 0.94 | 17.69 | 0.675 | 0.67 | 0.40 | 0.16 | 0.16 |
| 384 | 0.28 | 0.65 | 0.50 | 8.60 | 0.509 | 3.34 | 0.38 | 0.20 | 0.14 |
| 385 | 0.02 | 0.63 | 0.55 | 16.04 | 0.796 | 3.15 | 0.18 | 0.25 | 0.04 |
| 386 | 0.20 | 0.41 | 0.53 | 5.40 | 0.872 | 2.90 | 0.63 | 0.46 | 0.06 |
| 387 | 0.07 | 0.24 | 0.31 | 6.94 | 0.081 | 2.01 | 0.58 | 0.03 | 0.18 |
| 388 | 0.15 | 0.40 | 0.57 | 5.67 | 0.747 | 1.62 | 0.86 | 0.34 | 0.10 |
| 389 | 0.24 | 0.75 | 0.79 | 5.97 | 0.219 | 2.81 | 0.81 | 0.33 | 0.14 |
| 390 | 0.02 | 0.39 | 0.81 | 5.60 | 0.327 | 3.43 | 0.28 | 0.16 | 0.04 |
| 391 | 0.15 | 0.74 | 0.92 | 15.52 | 0.905 | 1.25 | 0.08 | 0.01 | 0.23 |
| 392 | 0.02 | 0.52 | 0.58 | 7.52 | 0.787 | 2.33 | 0.04 | 0.28 | 0.19 |
| 393 | 0.15 | 0.75 | 0.87 | 5.49 | 0.322 | 1.19 | 1.00 | 0.40 | 0.11 |
| 394 | 0.21 | 0.15 | 0.83 | 13.76 | 0.326 | 0.60 | 0.34 | 0.04 | 0.10 |
| 395 | 0.29 | 0.55 | 0.77 | 10.90 | 0.159 | 3.33 | 0.84 | 0.11 | 0.09 |
| 396 | 0.20 | 0.23 | 0.53 | 7.47 | 0.628 | 2.16 | 0.37 | 0.03 | 0.05 |
| 397 | 0.04 | 0.27 | 0.79 | 8.05 | 0.094 | 1.60 | 0.75 | 0.22 | 0.19 |
| 398 | 0.20 | 0.12 | 0.21 | 16.99 | 0.876 | 1.04 | 0.82 | 0.35 | 0.22 |
| 399 | 0.19 | 0.05 | 0.66 | 12.52 | 0.822 | 3.27 | 0.91 | 0.33 | 0.22 |
| 400 | 0.11 | 0.73 | 0.82 | 5.70 | 0.768 | 2.80 | 0.88 | 0.33 | 0.05 |

TABLE 14-2

STEEL OF INVENTION

| No. | Ti | Zr | Ta | Hf | Co | Ni | Cu (Mass. %) |
|---|---|---|---|---|---|---|---|
| 371 | — | 0.091 | — | — | — | — | 0.28 |
| 372 | — | 0.838 | — | — | — | — | 1.35 |
| 373 | 1.534 | 1.141 | — | — | — | — | 0.98 |
| 374 | 1.298 | 0.693 | — | — | — | — | 0.69 |
| 375 | 1.068 | 0.158 | — | — | — | — | 1.96 |
| 376 | 1.546 | 0.191 | — | — | — | — | 0.91 |
| 377 | 0.417 | 1.485 | — | — | — | — | 1.75 |
| 378 | 1.320 | 1.709 | — | — | — | — | 0.58 |
| 379 | — | — | 1.218 | — | — | — | 0.70 |
| 380 | — | — | 0.977 | — | — | — | 0.92 |
| 381 | — | — | 0.050 | — | — | — | 0.94 |
| 382 | — | — | 1.100 | — | — | — | 0.46 |
| 383 | — | — | 0.792 | — | — | — | 0.99 |
| 384 | — | — | 1.824 | — | — | — | 1.34 |
| 385 | 0.337 | — | 1.856 | — | — | — | 0.31 |
| 386 | 0.783 | — | 0.562 | — | — | — | 1.20 |
| 387 | 0.325 | — | 1.566 | — | — | — | 1.01 |
| 388 | 0.636 | — | 0.619 | — | — | — | 0.37 |
| 389 | 1.374 | — | 1.370 | — | — | — | 1.68 |
| 390 | 1.231 | — | 0.468 | — | — | — | 1.01 |
| 391 | — | 1.846 | 0.600 | — | — | — | 1.71 |
| 392 | — | 0.615 | 0.427 | — | — | — | 0.75 |
| 393 | — | 0.388 | 0.627 | — | — | — | 0.56 |
| 394 | — | 0.845 | 1.877 | — | — | — | 1.72 |
| 395 | — | 1.652 | 0.850 | — | — | — | 0.36 |
| 396 | — | 0.485 | 1.208 | — | — | — | 1.57 |
| 397 | 1.632 | 1.997 | 0.622 | — | — | — | 1.45 |
| 398 | 1.522 | 1.895 | 1.780 | — | — | — | 1.51 |
| 399 | 1.575 | 0.817 | 1.332 | — | — | — | 1.47 |
| 400 | 0.458 | 0.455 | 1.965 | — | — | — | 1.02 |

TABLE 14-3

STEEL OF INVENTION

| No. | P | S | O | D-CRS | HAZCRS | (Mass. %) M % |
|---|---|---|---|---|---|---|
| 371 | 0.0084 | 0.009 | 0.016 | 3 | 158 | 12 |
| 372 | 0.0210 | 0.002 | 0.019 | 7 | 146 | 20 |
| 373 | 0.0002 | 0.004 | 0.017 | 3 | 159 | 31 |
| 374 | 0.0011 | 0.006 | 0.017 | 5 | 175 | 24 |
| 375 | 0.0184 | 0.009 | 0.005 | 1 | 172 | 23 |
| 376 | 0.0028 | 0.005 | 0.009 | 3 | 177 | 28 |
| 377 | 0.0239 | 0.004 | 0.005 | 0 | 143 | 23 |
| 378 | 0.0024 | 0.005 | 0.009 | 5 | 149 | 29 |
| 379 | 0.0226 | 0.007 | 0.008 | 3 | 146 | 21 |
| 380 | 0.0200 | 0.009 | 0.010 | 6 | 162 | 19 |
| 381 | 0.0048 | 0.003 | 0.020 | 3 | 175 | 11 |
| 382 | 0.0167 | 0.003 | 0.006 | 3 | 163 | 19 |
| 383 | 0.0058 | 0.003 | 0.014 | 2 | 153 | 12 |
| 384 | 0.0274 | 0.009 | 0.002 | 6 | 149 | 21 |
| 385 | 0.0167 | 0.003 | 0.005 | 5 | 178 | 28 |
| 386 | 0.0132 | 0.009 | 0.009 | 3 | 167 | 22 |
| 387 | 0.0125 | 0.009 | 0.014 | 2 | 145 | 25 |
| 388 | 0.0247 | 0.001 | 0.004 | 5 | 165 | 23 |
| 389 | 0.0299 | 0.002 | 0.017 | 3 | 153 | 31 |
| 390 | 0.0227 | 0.009 | 0.019 | 5 | 138 | 19 |
| 391 | 0.0138 | 0.004 | 0.017 | 7 | 147 | 31 |
| 392 | 0.0276 | 0.008 | 0.008 | 1 | 158 | 13 |
| 393 | 0.0149 | 0.005 | 0.008 | 6 | 150 | 21 |
| 394 | 0.0152 | 0.008 | 0.014 | 1 | 173 | 34 |
| 395 | 0.0091 | 0.006 | 0.014 | 2 | 158 | 30 |
| 396 | 0.0210 | 0.007 | 0.003 | 7 | 180 | 24 |
| 397 | 0.0016 | 0.009 | 0.008 | 5 | 168 | 42 |
| 398 | 0.0056 | 0.001 | 0.006 | 6 | 175 | 47 |
| 399 | 0.0133 | 0.001 | 0.014 | 4 | 178 | 38 |
| 400 | 0.0046 | 0.002 | 0.018 | 2 | 155 | 29 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 15-1

STEEL OF INVENTION

| No. | C | Si | Mn | Cr | Mo | W | V | Nb | (Mass. %) N |
|---|---|---|---|---|---|---|---|---|---|
| 401 | 0.20 | 0.06 | 0.54 | 13.75 | 0.541 | 2.37 | 0.55 | 0.28 | 0.24 |
| 402 | 0.13 | 0.27 | 0.52 | 8.69 | 0.489 | 1.47 | 0.25 | 0.10 | 0.06 |
| 403 | 0.28 | 0.43 | 1.00 | 14.23 | 0.934 | 2.83 | 0.32 | 0.42 | 0.17 |
| 404 | 0.17 | 0.44 | 0.65 | 15.29 | 0.219 | 0.94 | 0.09 | 0.20 | 0.18 |
| 405 | 0.19 | 0.54 | 0.56 | 16.25 | 0.678 | 0.26 | 0.89 | 0.34 | 0.16 |
| 406 | 0.15 | 0.21 | 0.57 | 8.35 | 0.646 | 1.85 | 0.10 | 0.27 | 0.21 |
| 407 | 0.14 | 0.51 | 0.57 | 9.18 | 0.465 | 0.25 | 0.99 | 0.14 | 0.03 |
| 408 | 0.11 | 0.52 | 0.82 | 16.50 | 0.964 | 3.17 | 0.46 | 0.13 | 0.08 |
| 409 | 0.02 | 0.12 | 0.80 | 15.18 | 0.984 | 3.45 | 0.30 | 0.39 | 0.18 |
| 410 | 0.25 | 0.73 | 0.75 | 9.38 | 0.845 | 2.16 | 0.85 | 0.37 | 0.07 |
| 411 | 0.19 | 0.67 | 0.98 | 16.87 | 0.910 | 0.50 | 0.48 | 0.46 | 0.06 |
| 412 | 0.20 | 0.59 | 0.53 | 15.88 | 0.010 | 2.85 | 0.99 | 0.10 | 0.23 |
| 413 | 0.26 | 0.76 | 0.48 | 17.11 | 0.459 | 2.03 | 0.74 | 0.19 | 0.19 |
| 414 | 0.01 | 0.66 | 0.29 | 12.13 | 0.611 | 0.83 | 0.07 | 0.16 | 0.25 |
| 415 | 0.14 | 0.53 | 0.24 | 5.06 | 0.293 | 0.33 | 0.76 | 0.17 | 0.13 |
| 416 | 0.02 | 0.27 | 0.98 | 13.47 | 0.848 | 1.67 | 0.22 | 0.38 | 0.16 |
| 417 | 0.18 | 0.52 | 0.80 | 15.67 | 0.112 | 2.64 | 0.24 | 0.47 | 0.17 |
| 418 | 0.29 | 0.37 | 0.36 | 16.09 | 0.914 | 2.72 | 0.67 | 0.37 | 0.01 |
| 419 | 0.15 | 0.09 | 0.73 | 12.59 | 0.107 | 1.37 | 0.36 | 0.48 | 0.12 |
| 420 | 0.29 | 0.33 | 0.98 | 15.88 | 0.997 | 1.30 | 0.61 | 0.23 | 0.09 |
| 421 | 0.24 | 0.57 | 0.57 | 17.53 | 0.946 | 2.01 | 0.29 | 0.02 | 0.02 |
| 422 | 0.08 | 0.67 | 0.58 | 15.17 | 0.280 | 1.30 | 0.23 | 0.03 | 0.21 |
| 423 | 0.21 | 0.13 | 0.47 | 13.45 | 0.340 | 1.95 | 0.25 | 0.18 | 0.15 |
| 424 | 0.14 | 0.38 | 0.51 | 16.45 | 0.446 | 3.35 | 0.19 | 0.37 | 0.04 |
| 425 | 0.12 | 0.50 | 0.57 | 9.23 | 0.450 | 1.73 | 0.88 | 0.05 | 0.09 |
| 426 | 0.10 | 0.76 | 0.53 | 15.66 | 0.189 | 3.11 | 0.69 | 0.11 | 0.12 |
| 427 | 0.17 | 0.25 | 0.64 | 14.01 | 0.981 | 0.37 | 0.42 | 0.47 | 0.10 |

TABLE 15-1-continued

STEEL OF INVENTION

| No. | C | Si | Mn | Cr | Mo | W | V | Nb | (Mass. %) N |
|---|---|---|---|---|---|---|---|---|---|
| 428 | 0.15 | 0.41 | 0.38 | 15.19 | 0.190 | 1.23 | 0.92 | 0.32 | 0.24 |
| 429 | 0.27 | 0.32 | 0.42 | 10.62 | 0.630 | 1.82 | 0.53 | 0.31 | 0.13 |
| 430 | 0.06 | 0.65 | 0.22 | 11.12 | 0.646 | 3.26 | 0.58 | 0.12 | 0.10 |

TABLE 15-2

STEEL OF INVENTION

| No. | Ti | Zr | Ta | Hf | Co | Ni | (Mass. %) Cu |
|---|---|---|---|---|---|---|---|
| 401 | 0.848 | 1.455 | 1.334 | — | — | — | 0.74 |
| 402 | 1.406 | 0.521 | 1.130 | — | — | — | 0.37 |
| 403 | — | — | — | 0.647 | — | — | 1.41 |
| 404 | — | — | — | 1.144 | — | — | 1.76 |
| 405 | — | — | — | 0.462 | — | — | 0.23 |
| 406 | — | — | — | 0.253 | — | — | 1.01 |
| 407 | — | — | — | 1.189 | — | — | 1.12 |
| 408 | — | — | — | 1.944 | — | — | 0.25 |
| 409 | 0.479 | — | — | 0.181 | — | — | 0.82 |
| 410 | 0.577 | — | — | 1.580 | — | — | 0.72 |
| 411 | 1.898 | — | — | 0.818 | — | — | 1.47 |
| 412 | 1.113 | — | — | 1.575 | — | — | 1.88 |
| 413 | 1.885 | — | — | 1.512 | — | — | 0.73 |
| 414 | 1.885 | — | — | 0.287 | — | — | 0.43 |
| 415 | — | 0.946 | — | 0.587 | — | — | 1.60 |
| 416 | — | 1.300 | — | 1.065 | — | — | 1.22 |
| 417 | — | 0.795 | — | 0.427 | — | — | 0.82 |
| 418 | — | 1.075 | — | 0.310 | — | — | 1.90 |
| 419 | — | 0.840 | — | 1.414 | — | — | 1.46 |
| 420 | — | 1.756 | — | 0.398 | — | — | 1.89 |
| 421 | — | — | 1.768 | 1.928 | — | — | 0.22 |
| 422 | — | — | 1.066 | 1.688 | — | — | 0.64 |
| 423 | — | — | 1.890 | 1.344 | — | — | 1.95 |
| 424 | — | — | 1.902 | 0.556 | — | — | 0.27 |
| 425 | — | — | 0.821 | 1.035 | — | — | 0.71 |
| 426 | — | — | 0.277 | 1.420 | — | — | 0.25 |
| 427 | — | 1.683 | 1.936 | 1.383 | — | — | 1.31 |
| 428 | — | 0.951 | 0.485 | 1.593 | — | — | 0.90 |
| 429 | — | 1.417 | 0.591 | 1.732 | — | — | 1.40 |
| 430 | — | 0.760 | 1.950 | 0.497 | — | — | 1.66 |

TABLE 15-3

STEEL OF INVENTION

| No. | P | S | O | D-CRS | HAZCRS | (Mass. %) M % |
|---|---|---|---|---|---|---|
| 401 | 0.0047 | 0.003 | 0.006 | 7 | 134 | 45 |
| 402 | 0.0234 | 0.007 | 0.014 | 5 | 142 | 38 |
| 403 | 0.0112 | 0.003 | 0.008 | 4 | 132 | 16 |
| 404 | 0.0230 | 0.003 | 0.015 | 1 | 133 | 17 |
| 405 | 0.0238 | 0.002 | 0.013 | 4 | 146 | 18 |
| 406 | 0.0240 | 0.002 | 0.007 | 3 | 149 | 11 |
| 407 | 0.0035 | 0.002 | 0.005 | 1 | 171 | 16 |
| 408 | 0.0169 | 0.009 | 0.003 | 4 | 139 | 20 |
| 409 | 0.0151 | 0.005 | 0.008 | 4 | 130 | 18 |
| 410 | 0.0074 | 0.009 | 0.007 | 2 | 173 | 22 |
| 411 | 0.0195 | 0.008 | 0.016 | 2 | 145 | 26 |
| 412 | 0.0163 | 0.003 | 0.012 | 6 | 173 | 27 |
| 413 | 0.0078 | 0.008 | 0.003 | 2 | 136 | 40 |
| 414 | 0.0039 | 0.007 | 0.012 | 7 | 162 | 22 |
| 415 | 0.0149 | 0.002 | 0.010 | 1 | 177 | 26 |
| 416 | 0.0208 | 0.007 | 0.002 | 2 | 160 | 30 |
| 417 | 0.0018 | 0.002 | 0.005 | 0 | 139 | 14 |
| 418 | 0.0127 | 0.002 | 0.004 | 2 | 166 | 18 |
| 419 | 0.0190 | 0.003 | 0.018 | 4 | 169 | 22 |
| 420 | 0.0153 | 0.008 | 0.003 | 0 | 151 | 25 |

TABLE 15-3-continued

STEEL OF INVENTION

| No. | P | S | O | D-CRS | HAZCRS | (Mass. %) M % |
|---|---|---|---|---|---|---|
| 421 | 0.0121 | 0.004 | 0.015 | 4 | 139 | 42 |
| 422 | 0.0043 | 0.006 | 0.011 | 3 | 161 | 27 |
| 423 | 0.0018 | 0.002 | 0.009 | 4 | 146 | 36 |
| 424 | 0.0149 | 0.004 | 0.005 | 2 | 169 | 24 |
| 425 | 0.0240 | 0.003 | 0.014 | 3 | 161 | 26 |
| 426 | 0.0085 | 0.004 | 0.005 | 6 | 172 | 26 |
| 427 | 0.0089 | 0.003 | 0.004 | 2 | 131 | 52 |
| 428 | 0.0201 | 0.002 | 0.007 | 4 | 141 | 34 |
| 429 | 0.0222 | 0.005 | 0.002 | 5 | 179 | 37 |
| 430 | 0.0257 | 0.005 | 0.014 | 6 | 173 | 32 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 16-1

STEEL OF INVENTION

| No. | C | Si | Mn | Cr | Mo | W | V | Nb | (Mass. %) N |
|---|---|---|---|---|---|---|---|---|---|
| 431 | 0.19 | 0.08 | 0.86 | 8.06 | 0.572 | 3.36 | 0.41 | 0.15 | 0.10 |
| 432 | 0.03 | 0.05 | 0.59 | 12.20 | 0.236 | 1.55 | 0.84 | 0.09 | 0.22 |
| 433 | 0.26 | 0.44 | 0.51 | 8.61 | 0.483 | 2.27 | 0.72 | 0.33 | 0.05 |
| 434 | 0.11 | 0.72 | 0.85 | 14.45 | 0.648 | 1.68 | 0.40 | 0.31 | 0.03 |
| 435 | 0.11 | 0.38 | 0.71 | 8.35 | 0.574 | 2.56 | 0.70 | 0.20 | 0.14 |
| 436 | 0.21 | 0.436 | 0.75 | 7.52 | 0.092 | 1.03 | 0.45 | 0.15 | 0.20 |
| 437 | 0.22 | 0.44 | 0.43 | 16.23 | 0.519 | 3.12 | 0.97 | 0.34 | 0.18 |
| 438 | 0.24 | 0.58 | 0.82 | 12.89 | 0.711 | 1.74 | 0.65 | 0.43 | 0.04 |
| 439 | 0.08 | 0.38 | 0.60 | 8.48 | 0.502 | 1.28 | 0.28 | 0.35 | 0.10 |
| 440 | 0.26 | 0.46 | 0.44 | 7.36 | 0.227 | 2.87 | 0.70 | 0.02 | 0.08 |
| 441 | 0.16 | 0.72 | 0.99 | 13.74 | 0.713 | 1.00 | 0.28 | 0.09 | 0.06 |
| 442 | 0.03 | 0.63 | 0.53 | 6.15 | 0.813 | 3.39 | 0.81 | 0.24 | 0.24 |
| 443 | 0.10 | 0.46 | 0.54 | 8.40 | 0.850 | 2.87 | 0.17 | 0.13 | 0.10 |
| 444 | 0.04 | 0.46 | 0.86 | 11.81 | 0.661 | 2.22 | 0.16 | 0.44 | 0.09 |
| 445 | 0.23 | 0.50 | 0.99 | 14.35 | 0.090 | 0.90 | 0.62 | 0.33 | 0.15 |
| 446 | 0.04 | 0.08 | 0.78 | 13.83 | 0.463 | 1.66 | 0.40 | 0.46 | 0.03 |
| 447 | 0.17 | 0.23 | 0.90 | 14.57 | 0.618 | 2.32 | 0.82 | 0.27 | 0.02 |
| 448 | 0.26 | 0.05 | 0.83 | 8.08 | 0.402 | 0.70 | 0.27 | 0.17 | 0.23 |
| 449 | 0.27 | 0.57 | 0.83 | 11.65 | 0.143 | 1.18 | 1.00 | 0.31 | 0.23 |
| 450 | 0.29 | 0.50 | 0.77 | 16.57 | 0.669 | 1.59 | 0.42 | 0.38 | 0.25 |
| 451 | 0.29 | 0.10 | 0.52 | 7.82 | 0.828 | 1.38 | 0.82 | 0.29 | 0.23 |
| 452 | 0.21 | 0.03 | 0.34 | 15.62 | 0.446 | 1.63 | 0.56 | 0.21 | 0.14 |
| 453 | 0.29 | 0.54 | 0.52 | 5.58 | 0.371 | 1.86 | 0.46 | 0.30 | 0.06 |
| 454 | 0.05 | 0.72 | 0.90 | 14.33 | 0.928 | 3.14 | 0.86 | 0.48 | 0.06 |
| 455 | 0.18 | 0.45 | 0.57 | 13.87 | 0.463 | 3.28 | 0.12 | 0.19 | 0.24 |
| 456 | 0.17 | 0.39 | 0.60 | 15.03 | 0.303 | 3.39 | 0.54 | 0.31 | 0.19 |
| 457 | 0.15 | 0.79 | 0.84 | 9.06 | 0.777 | 1.26 | 0.46 | 0.28 | 0.22 |
| 458 | 0.19 | 0.34 | 0.37 | 7.00 | 0.239 | 2.98 | 0.24 | 0.27 | 0.07 |
| 459 | 0.26 | 0.11 | 0.27 | 6.71 | 0.517 | 1.40 | 0.70 | 0.19 | 0.05 |
| 460 | 0.30 | 0.74 | 0.79 | 12.50 | 0.448 | 0.94 | 0.68 | 0.22 | 0.24 |

TABLE 16-2

STEEL OF INVENTION

| No. | Ti | Zr | Ta | Hf | Co | Ni | (Mass. %) Cu |
|---|---|---|---|---|---|---|---|
| 431 | — | 0.639 | 1.211 | 0.524 | — | — | 1.34 |
| 432 | — | 0.726 | 0.049 | 0.494 | — | — | 1.06 |
| 433 | 0.765 | — | 1.131 | 1.079 | — | — | 0.54 |
| 434 | 1.520 | — | 1.120 | 0.937 | — | — | 1.25 |
| 435 | 1.628 | — | 1.707 | 0.763 | — | — | 0.21 |
| 436 | 1.741 | — | 0.571 | 0.229 | — | — | 0.75 |

TABLE 16-2-continued

STEEL OF INVENTION

| No. | Ti | Zr | Ta | Hf | Co | Ni | (Mass. %) Cu |
|---|---|---|---|---|---|---|---|
| 437 | 0.521 | — | 0.369 | 0.994 | — | — | 1.65 |
| 438 | 0.678 | — | 1.778 | 0.745 | — | — | 1.73 |
| 439 | 1.855 | 1.633 | — | 0.136 | — | — | 1.57 |
| 440 | 1.728 | 1.576 | — | 0.842 | — | — | 1.78 |
| 441 | 0.993 | 1.759 | — | 0.519 | — | — | 1.17 |
| 442 | 0.294 | 1.893 | — | 1.869 | — | — | 1.25 |
| 443 | 0.312 | 1.621 | — | 0.568 | — | — | 1.72 |
| 444 | 0.709 | 0.615 | — | 0.247 | — | — | 1.40 |
| 445 | 0.170 | 1.548 | 1.008 | 1.616 | — | — | 0.86 |
| 446 | 1.375 | 1.100 | 0.448 | 1.332 | — | — | 0.75 |
| 447 | 1.970 | 1.952 | 0.558 | 0.087 | — | — | 1.64 |
| 448 | 0.671 | 1.758 | 1.983 | 1.521 | — | — | 1.45 |
| 449 | 0.094 | 0.199 | 1.411 | 1.326 | — | — | 0.77 |
| 450 | 0.950 | 1.927 | 0.503 | 0.154 | — | — | 0.22 |
| 451 | 0.901 | — | — | — | 4.33 | — | 0.42 |
| 452 | 0.608 | — | — | — | 2.63 | — | 1.03 |
| 453 | 0.758 | — | — | — | 1.95 | — | 0.89 |
| 454 | 0.010 | — | — | — | 3.93 | — | 1.50 |
| 455 | 1.046 | — | — | — | 0.49 | — | 0.74 |
| 456 | 1.534 | — | — | — | 0.53 | — | 1.06 |
| 457 | — | 0.062 | — | — | 0.83 | — | 0.33 |
| 458 | — | 1.419 | — | — | 3.00 | — | 1.86 |
| 459 | — | 1.131 | — | — | 3.86 | — | 0.85 |
| 460 | — | 1.846 | — | — | 4.98 | — | 1.52 |

TABLE 16-3

STEEL OF INVENTION

| No. | P | S | O | D-CRS | HAZCRS | (Mass. %) M % |
|---|---|---|---|---|---|---|
| 431 | 0.0101 | 0.006 | 0.012 | 0 | 176 | 32 |
| 432 | 0.0157 | 0.006 | 0.001 | 3 | 166 | 22 |
| 433 | 0.0226 | 0.003 | 0.008 | 2 | 144 | 32 |
| 434 | 0.0108 | 0.005 | 0.020 | 2 | 140 | 37 |
| 435 | 0.0053 | 0.002 | 0.014 | 3 | 131 | 40 |
| 436 | 0.0165 | 0.006 | 0.006 | 4 | 144 | 33 |
| 437 | 0.0242 | 0.010 | 0.013 | 6 | 132 | 23 |
| 438 | 0.0088 | 0.009 | 0.012 | 2 | 172 | 38 |
| 439 | 0.0099 | 0.005 | 0.009 | 3 | 169 | 33 |
| 440 | 0.0078 | 0.002 | 0.002 | 6 | 149 | 36 |
| 441 | 0.0124 | 0.003 | 0.007 | 5 | 141 | 31 |
| 442 | 0.0190 | 0.006 | 0.010 | 1 | 171 | 36 |
| 443 | 0.0226 | 0.001 | 0.017 | 3 | 167 | 28 |
| 444 | 0.0036 | 0.009 | 0.009 | 1 | 159 | 23 |
| 445 | 0.0015 | 0.010 | 0.008 | 6 | 172 | 41 |
| 446 | 0.0268 | 0.002 | 0.013 | 4 | 135 | 37 |
| 447 | 0.0146 | 0.004 | 0.010 | 1 | 150 | 47 |
| 448 | 0.0197 | 0.007 | 0.006 | 6 | 170 | 52 |
| 449 | 0.0074 | 0.007 | 0.017 | 3 | 174 | 31 |
| 450 | 0.0176 | 0.006 | 0.003 | 6 | 138 | 33 |
| 451 | 0.0007 | 0.008 | 0.006 | 3 | 141 | 15 |
| 452 | 0.0114 | 0.002 | 0.005 | 0 | 135 | 18 |
| 453 | 0.0149 | 0.009 | 0.016 | 3 | 173 | 13 |
| 454 | 0.0214 | 0.009 | 0.017 | 3 | 133 | 11 |
| 455 | 0.0107 | 0.002 | 0.005 | 3 | 142 | 18 |
| 456 | 0.0084 | 0.007 | 0.005 | 5 | 178 | 26 |
| 457 | 0.0091 | 0.002 | 0.004 | 5 | 144 | 11 |
| 458 | 0.0229 | 0.002 | 0.010 | 5 | 143 | 24 |
| 459 | 0.0152 | 0.002 | 0.008 | 7 | 152 | 16 |
| 460 | 0.0107 | 0.004 | 0.006 | 3 | 149 | 25 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 17-1

STEEL OF INVENTION

| No. | C | Si | Mn | Cr | Mo | W | V | Nb | (Mass. %) N |
|---|---|---|---|---|---|---|---|---|---|
| 461 | 0.27 | 0.54 | 0.21 | 15.79 | 0.868 | 2.70 | 0.03 | 0.01 | 0.01 |
| 462 | 0.13 | 0.55 | 0.80 | 7.85 | 0.113 | 1.18 | 0.06 | 0.24 | 0.15 |
| 463 | 0.25 | 0.26 | 0.41 | 6.09 | 0.014 | 0.77 | 0.11 | 0.07 | 0.03 |
| 464 | 0.30 | 0.30 | 0.93 | 14.73 | 0.397 | 2.59 | 0.51 | 0.18 | 0.19 |
| 465 | 0.23 | 0.57 | 0.62 | 12.45 | 0.620 | 2.82 | 0.12 | 0.47 | 0.14 |
| 466 | 0.14 | 0.54 | 0.55 | 9.95 | 0.021 | 2.57 | 0.27 | 0.13 | 0.18 |
| 467 | 0.28 | 0.09 | 0.59 | 11.56 | 0.409 | 2.93 | 0.28 | 0.31 | 0.16 |
| 468 | 0.01 | 0.24 | 0.60 | 15.14 | 0.641 | 3.35 | 0.99 | 0.43 | 0.03 |
| 469 | 0.02 | 0.49 | 0.46 | 5.65 | 0.550 | 1.67 | 0.27 | 0.18 | 0.25 |
| 470 | 0.25 | 0.72 | 0.44 | 13.48 | 0.473 | 0.64 | 0.90 | 0.20 | 0.04 |
| 471 | 0.08 | 0.78 | 0.80 | 16.87 | 0.738 | 1.34 | 0.26 | 0.17 | 0.21 |
| 472 | 0.18 | 0.56 | 0.61 | 13.71 | 0.186 | 3.25 | 0.66 | 0.26 | 0.24 |
| 473 | 0.22 | 0.70 | 0.94 | 14.90 | 0.146 | 0.85 | 0.45 | 0.37 | 0.10 |
| 474 | 0.29 | 0.68 | 0.86 | 5.26 | 0.960 | 1.91 | 0.94 | 0.44 | 0.21 |
| 475 | 0.06 | 0.38 | 0.23 | 15.27 | 0.969 | 2.54 | 0.04 | 0.39 | 0.19 |
| 476 | 0.21 | 0.47 | 0.55 | 10.34 | 0.013 | 0.58 | 0.98 | 0.13 | 0.11 |
| 477 | 0.25 | 0.40 | 0.86 | 14.23 | 0.918 | 0.44 | 0.69 | 0.07 | 0.05 |
| 478 | 0.13 | 0.05 | 0.62 | 11.72 | 0.517 | 3.18 | 0.94 | 0.14 | 0.10 |
| 479 | 0.11 | 0.48 | 0.53 | 7.37 | 0.157 | 1.72 | 0.13 | 0.49 | 0.21 |
| 480 | 0.26 | 0.38 | 0.84 | 5.44 | 0.166 | 0.43 | 0.52 | 0.07 | 0.11 |
| 481 | 0.12 | 0.79 | 0.22 | 10.31 | 0.878 | 0.43 | 0.50 | 0.26 | 0.11 |
| 482 | 0.07 | 0.41 | 0.55 | 13.34 | 0.637 | 2.82 | 0.39 | 0.26 | 0.18 |
| 483 | 0.20 | 0.28 | 0.47 | 5.80 | 0.764 | 2.09 | 0.51 | 0.22 | 0.03 |
| 484 | 0.04 | 0.29 | 0.28 | 11.76 | 0.117 | 1.05 | 0.72 | 0.06 | 0.24 |
| 485 | 0.12 | 0.28 | 0.63 | 15.93 | 0.014 | 2.40 | 0.84 | 0.20 | 0.15 |
| 486 | 0.09 | 0.55 | 0.60 | 9.73 | 0.294 | 0.71 | 0.23 | 0.31 | 0.09 |
| 487 | 0.06 | 0.55 | 0.85 | 10.58 | 0.799 | 0.36 | 0.21 | 0.06 | 0.14 |
| 488 | 0.27 | 0.57 | 0.85 | 9.79 | 0.363 | 0.78 | 0.58 | 0.10 | 0.02 |
| 489 | 0.23 | 0.06 | 0.87 | 11.59 | 0.812 | 1.47 | 0.74 | 0.12 | 0.17 |
| 490 | 0.05 | 0.09 | 0.39 | 7.64 | 0.499 | 0.22 | 0.49 | 0.04 | 0.07 |

TABLE 17-2

STEEL OF INVENTION

| No. | Ti | Zr | Ta | Hf | Co | Ni | (Mass. %) Cu |
|---|---|---|---|---|---|---|---|
| 461 | — | 0.284 | — | — | 0.84 | — | 0.86 |
| 462 | — | 0.053 | — | — | 2.56 | — | 0.37 |
| 463 | 1.029 | 0.881 | — | — | 2.58 | — | 1.59 |
| 464 | 0.305 | 0.413 | — | — | 3.94 | — | 1.50 |
| 465 | 0.086 | 1.331 | — | — | 1.93 | — | 0.68 |
| 466 | 1.035 | 0.284 | — | — | 0.30 | — | 1.57 |
| 467 | 1.834 | 1.978 | — | — | 0.66 | — | 0.27 |
| 468 | 1.127 | 0.071 | — | — | 2.23 | — | 1.89 |
| 469 | — | — | 1.350 | — | 1.78 | — | 1.60 |
| 470 | — | — | 1.931 | — | 0.92 | — | 1.83 |
| 471 | — | — | 0.305 | — | 3.74 | — | 0.51 |
| 472 | — | — | 1.140 | — | 2.19 | — | 0.89 |
| 473 | — | — | 1.093 | — | 2.73 | — | 1.83 |
| 474 | — | — | 0.834 | — | 4.53 | — | 1.19 |
| 475 | 1.094 | — | 0.052 | — | 1.99 | — | 0.49 |
| 476 | 1.700 | — | 1.388 | — | 3.94 | — | 0.33 |
| 477 | 0.871 | — | 1.545 | — | 2.39 | — | 0.43 |
| 478 | 0.274 | — | 1.194 | — | 3.81 | — | 0.50 |
| 479 | 0.595 | — | 1.995 | — | 4.95 | — | 0.23 |
| 480 | 0.478 | — | 0.636 | — | 2.62 | — | 0.21 |
| 481 | — | 1.988 | 1.762 | — | 0.90 | — | 1.08 |
| 482 | - | 1.189 | 0.072 | — | 3.74 | — | 1.62 |
| 483 | — | 0.864 | 0.220 | — | 0.76 | — | 0.65 |
| 484 | — | 1.683 | 0.881 | — | 3.17 | — | 1.45 |
| 485 | — | 0.327 | 0.723 | — | 2.97 | — | 1.04 |
| 486 | — | 0.457 | 1.435 | — | 1.82 | — | 1.83 |
| 487 | 0.262 | 1.739 | 1.663 | — | 3.70 | — | 1.72 |
| 488 | 0.936 | 0.868 | 0.105 | — | 3.02 | — | 0.41 |
| 489 | 1.241 | 0.503 | 0.415 | — | 1.41 | — | 0.31 |
| 490 | 0.844 | 1.313 | 1.270 | — | 0.44 | — | 0.22 |

TABLE 17-3

STEEL OF INVENTION

| No. | P | S | O | D-CRS | HAZCRS | (Mass. %) M % |
|---|---|---|---|---|---|---|
| 461 | 0.0195 | 0.003 | 0.019 | 3 | 162 | 9 |
| 462 | 0.0220 | 0.002 | 0.007 | 1 | 144 | 13 |
| 463 | 0.0282 | 0.004 | 0.014 | 4 | 147 | 26 |
| 464 | 0.0182 | 0.007 | 0.017 | 1 | 149 | 12 |
| 465 | 0.0165 | 0.005 | 0.004 | 5 | 177 | 23 |
| 466 | 0.0189 | 0.001 | 0.001 | 3 | 161 | 19 |
| 467 | 0.0202 | 0.004 | 0.014 | 3 | 176 | 41 |
| 468 | 0.0008 | 0.001 | 0.010 | 5 | 151 | 17 |
| 469 | 0.0150 | 0.006 | 0.016 | 6 | 165 | 22 |
| 470 | 0.0282 | 0.004 | 0.019 | 6 | 143 | 28 |
| 471 | 0.0061 | 0.005 | 0.007 | 2 | 139 | 16 |
| 472 | 0.0182 | 0.006 | 0.014 | 3 | 132 | 23 |
| 473 | 0.0148 | 0.003 | 0.008 | 4 | 173 | 23 |
| 474 | 0.0206 | 0.009 | 0.006 | 4 | 141 | 17 |
| 475 | 0.0160 | 0.009 | 0.013 | 2 | 162 | 16 |
| 476 | 0.0260 | 0.002 | 0.018 | 4 | 166 | 34 |
| 477 | 0.0157 | 0.009 | 0.007 | 1 | 154 | 24 |
| 478 | 0.0105 | 0.009 | 0.016 | 3 | 154 | 21 |
| 479 | 0.0050 | 0.002 | 0.004 | 6 | 170 | 26 |
| 480 | 0.0243 | 0.009 | 0.014 | 4 | 178 | 20 |
| 481 | 0.0040 | 0.005 | 0.015 | 1 | 157 | 40 |
| 482 | 0.0286 | 0.008 | 0.005 | 5 | 158 | 21 |
| 483 | 0.0185 | 0.002 | 0.008 | 4 | 161 | 15 |
| 484 | 0.0136 | 0.003 | 0.011 | 2 | 168 | 32 |
| 485 | 0.0089 | 0.006 | 0.012 | 2 | 156 | 14 |
| 486 | 0.0147 | 0.005 | 0.008 | 4 | 153 | 25 |
| 487 | 0.0110 | 0.008 | 0.015 | 7 | 137 | 41 |
| 488 | 0.0228 | 0.003 | 0.009 | 3 | 136 | 23 |
| 489 | 0.0152 | 0.003 | 0.008 | 1 | 177 | 30 |
| 490 | 0.0283 | 0.002 | 0.008 | 5 | 164 | 38 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 18-1

STEEL OF INVENTION

| No. | C | Si | Mn | Cr | Mo | W | V | Nb | (Mass. %) N |
|---|---|---|---|---|---|---|---|---|---|
| 491 | 0.11 | 0.52 | 0.86 | 8.60 | 0.255 | 3.11 | 0.18 | 0.26 | 0.04 |
| 492 | 0.22 | 0.44 | 0.96 | 12.39 | 0.406 | 1.30 | 0.62 | 0.45 | 0.05 |
| 493 | 0.18 | 0.12 | 0.55 | 10.29 | 0.285 | 2.52 | 0.68 | 0.29 | 0.05 |
| 494 | 0.10 | 0.59 | 0.71 | 6.80 | 0.746 | 2.96 | 0.68 | 0.19 | 0.24 |
| 495 | 0.06 | 0.18 | 0.91 | 12.91 | 0.623 | 2.06 | 0.46 | 0.32 | 0.23 |
| 496 | 0.03 | 0.70 | 0.61 | 6.71 | 0.744 | 0.94 | 0.84 | 0.36 | 0.09 |
| 497 | 0.11 | 0.46 | 0.87 | 12.13 | 0.441 | 0.67 | 0.19 | 0.45 | 0.03 |
| 498 | 0.23 | 0.12 | 0.39 | 14.14 | 0.553 | 0.73 | 0.30 | 0.04 | 0.13 |
| 499 | 0.21 | 0.32 | 0.99 | 16.95 | 0.917 | 0.58 | 0.53 | 0.26 | 0.10 |
| 500 | 0.15 | 0.16 | 0.59 | 12.09 | 0.371 | 1.32 | 0.72 | 0.07 | 0.15 |
| 501 | 0.15 | 0.30 | 0.63 | 16.91 | 0.259 | 0.80 | 0.22 | 0.36 | 0.24 |
| 502 | 0.16 | 0.21 | 0.58 | 16.24 | 0.900 | 3.39 | 0.34 | 0.06 | 0.08 |
| 503 | 0.12 | 0.16 | 0.33 | 14.50 | 0.146 | 0.29 | 0.41 | 0.32 | 0.25 |
| 504 | 0.29 | 0.79 | 0.51 | 9.34 | 0.813 | 2.54 | 0.78 | 0.09 | 0.21 |
| 505 | 0.18 | 0.03 | 0.63 | 5.44 | 0.262 | 2.99 | 0.32 | 0.02 | 0.06 |
| 506 | 0.18 | 0.10 | 0.94 | 13.51 | 0.811 | 2.75 | 0.80 | 0.02 | 0.11 |
| 507 | 0.09 | 0.48 | 0.90 | 11.93 | 0.804 | 2.91 | 0.60 | 0.01 | 0.21 |
| 508 | 0.01 | 0.64 | 0.39 | 17.95 | 0.566 | 1.27 | 0.05 | 0.17 | 0.18 |
| 509 | 0.05 | 0.45 | 0.88 | 16.71 | 0.448 | 2.28 | 0.46 | 0.40 | 0.12 |
| 510 | 0.14 | 0.58 | 0.23 | 5.75 | 0.275 | 0.41 | 0.70 | 0.15 | 0.22 |
| 511 | 0.11 | 0.50 | 0.72 | 15.75 | 0.393 | 1.77 | 0.11 | 0.07 | 0.08 |
| 512 | 0.04 | 0.48 | 0.22 | 11.89 | 0.129 | 2.46 | 0.97 | 0.30 | 0.15 |
| 513 | 0.18 | 0.77 | 0.98 | 11.56 | 0.319 | 0.32 | 0.19 | 0.06 | 0.03 |
| 514 | 0.19 | 0.08 | 0.88 | 6.15 | 0.302 | 3.04 | 0.05 | 0.47 | 0.03 |
| 515 | 0.03 | 0.62 | 0.98 | 12.92 | 0.405 | 1.82 | 0.88 | 0.23 | 0.24 |
| 516 | 0.08 | 0.70 | 0.38 | 10.44 | 0.978 | 1.11 | 0.09 | 0.25 | 0.14 |
| 517 | 0.29 | 0.58 | 0.91 | 9.47 | 0.854 | 0.35 | 0.43 | 0.44 | 0.17 |

TABLE 18-1-continued

STEEL OF INVENTION

| No. | C | Si | Mn | Cr | Mo | W | V | Nb | (Mass. %) N |
|---|---|---|---|---|---|---|---|---|---|
| 518 | 0.04 | 0.53 | 0.45 | 7.77 | 0.857 | 2.25 | 0.29 | 0.23 | 0.04 |
| 519 | 0.29 | 0.42 | 0.48 | 16.33 | 0.833 | 3.04 | 0.97 | 0.02 | 0.08 |
| 520 | 0.13 | 0.50 | 0.46 | 13.55 | 0.621 | 0.51 | 0.84 | 0.49 | 0.14 |

TABLE 18-2

STEEL OF INVENTION

| No. | Ti | Zr | Ta | Hf | Co | Ni | (Mass. %) Cu |
|---|---|---|---|---|---|---|---|
| 491 | 1.420 | 0.968 | 1.336 | — | 1.78 | — | 0.74 |
| 492 | 1.612 | 0.146 | 0.286 | — | 4.58 | — | 1.59 |
| 493 | — | — | — | 1.815 | 0.92 | — | 0.66 |
| 494 | — | — | — | 0.475 | 1.99 | — | 0.36 |
| 495 | — | — | — | 1.386 | 2.13 | — | 1.29 |
| 496 | — | — | — | 0.238 | 3.04 | — | 1.37 |
| 497 | — | — | — | 0.718 | 1.53 | — | 0.29 |
| 498 | — | — | — | 1.476 | 1.57 | — | 1.37 |
| 499 | 1.378 | — | — | 1.204 | 4.81 | — | 0.69 |
| 500 | 1.877 | — | — | 1.555 | 0.83 | — | 0.68 |
| 501 | 1.073 | — | — | 0.228 | 0.89 | — | 1.03 |
| 502 | 0.634 | — | — | 0.848 | 1.70 | — | 1.45 |
| 503 | 1.207 | — | — | 1.123 | 2.60 | — | 0.74 |
| 504 | 0.492 | — | — | 0.742 | 2.77 | — | 0.42 |
| 505 | — | 0.599 | — | 0.337 | 1.40 | — | 1.09 |
| 506 | — | 1.634 | — | 0.592 | 4.87 | — | 0.64 |
| 507 | — | 1.272 | — | 1.196 | 2.87 | — | 0.58 |
| 508 | — | 1.182 | — | 0.802 | 4.15 | — | 1.53 |
| 509 | — | 1.043 | — | 0.094 | 0.75 | — | 1.38 |
| 510 | — | 1.511 | — | 1.722 | 3.86 | — | 1.63 |
| 511 | — | — | 1.968 | 0.357 | 0.65 | — | 1.08 |
| 512 | — | — | 1.807 | 0.712 | 4.83 | — | 1.25 |
| 513 | — | — | 0.631 | 0.404 | 1.12 | — | 1.83 |
| 514 | — | — | 1.130 | 1.153 | 0.84 | — | 1.65 |
| 515 | — | — | 1.970 | 0.608 | 3.14 | — | 0.41 |
| 516 | — | — | 0.844 | 0.450 | 2.44 | — | 0.48 |
| 517 | — | 1.406 | 1.361 | 1.320 | 0.29 | — | 1.60 |
| 518 | — | 1.987 | 0.280 | 1.939 | 3.22 | — | 0.77 |
| 519 | — | 1.217 | 1.199 | 1.948 | 0.76 | — | 1.29 |
| 520 | — | 0.797 | 1.829 | 1.029 | 4.15 | — | 1.04 |

TABLE 18-3

STEEL OF INVENTION

| No. | P | S | O | D-CRS | HAZCRS | (Mass. %) M % |
|---|---|---|---|---|---|---|
| 491 | 0.0123 | 0.002 | 0.006 | 3 | 173 | 39 |
| 492 | 0.0071 | 0.003 | 0.008 | 7 | 157 | 21 |
| 493 | 0.0079 | 0.003 | 0.012 | 2 | 146 | 24 |
| 494 | 0.0245 | 0.006 | 0.004 | 5 | 165 | 15 |
| 495 | 0.0233 | 0.003 | 0.010 | 3 | 143 | 16 |
| 496 | 0.0113 | 0.005 | 0.008 | 0 | 157 | 8 |
| 497 | 0.0017 | 0.009 | 0.014 | 5 | 136 | 16 |
| 498 | 0.0032 | 0.008 | 0.005 | 2 | 156 | 25 |
| 499 | 0.0261 | 0.002 | 0.008 | 1 | 147 | 30 |
| 500 | 0.0208 | 0.003 | 0.009 | 4 | 135 | 38 |
| 501 | 0.0119 | 0.009 | 0.005 | 7 | 148 | 25 |
| 502 | 0.0095 | 0.009 | 0.003 | 4 | 164 | 19 |
| 503 | 0.0092 | 0.003 | 0.018 | 6 | 160 | 25 |
| 504 | 0.0205 | 0.002 | 0.020 | 4 | 165 | 18 |
| 505 | 0.0240 | 0.005 | 0.014 | 4 | 131 | 15 |
| 506 | 0.0143 | 0.010 | 0.016 | 5 | 136 | 26 |
| 507 | 0.0018 | 0.007 | 0.014 | 6 | 133 | 24 |
| 508 | 0.0262 | 0.007 | 0.013 | 1 | 149 | 25 |
| 509 | 0.0082 | 0.010 | 0.002 | 1 | 162 | 23 |
| 510 | 0.0021 | 0.004 | 0.006 | 1 | 150 | 38 |

TABLE 18-3-continued

STEEL OF INVENTION

| No. | P | S | O | D-CRS | HAZCRS | (Mass. %) M % |
|---|---|---|---|---|---|---|
| 511 | 0.0033 | 0.003 | 0.012 | 6 | 140 | 32 |
| 512 | 0.0220 | 0.004 | 0.017 | 1 | 136 | 30 |
| 513 | 0.0080 | 0.006 | 0.018 | 4 | 164 | 17 |
| 514 | 0.0020 | 0.002 | 0.002 | 5 | 153 | 23 |
| 515 | 0.0135 | 0.001 | 0.014 | 7 | 131 | 34 |
| 516 | 0.0224 | 0.001 | 0.003 | 1 | 175 | 22 |
| 517 | 0.0097 | 0.006 | 0.013 | 5 | 163 | 39 |
| 518 | 0.0295 | 0.003 | 0.013 | 3 | 148 | 41 |
| 519 | 0.0026 | 0.002 | 0.019 | 1 | 157 | 39 |
| 520 | 0.0285 | 0.005 | 0.008 | 1 | 143 | 41 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 19-1

STEEL OF INVENTION

| No. | C | Si | Mn | Cr | Mo | W | V | Nb | (Mass. %) N |
|---|---|---|---|---|---|---|---|---|---|
| 521 | 0.09 | 0.67 | 0.26 | 16.70 | 0.548 | 2.34 | 0.72 | 0.07 | 0.04 |
| 522 | 0.11 | 0.77 | 0.96 | 17.31 | 0.463 | 3.08 | 0.45 | 0.16 | 0.24 |
| 523 | 0.17 | 0.31 | 0.41 | 13.03 | 0.187 | 2.15 | 0.85 | 0.42 | 0.09 |
| 524 | 0.05 | 0.31 | 0.89 | 8.43 | 0.069 | 0.70 | 0.29 | 0.29 | 0.15 |
| 525 | 0.15 | 0.26 | 0.27 | 14.18 | 0.923 | 3.06 | 0.07 | 0.18 | 0.02 |
| 526 | 0.28 | 0.42 | 0.41 | 15.26 | 0.613 | 0.54 | 0.05 | 0.02 | 0.03 |
| 527 | 0.24 | 0.67 | 0.78 | 16.12 | 0.466 | 2.46 | 0.05 | 0.44 | 0.25 |
| 528 | 0.13 | 0.49 | 0.86 | 14.48 | 0.808 | 3.32 | 0.90 | 0.16 | 0.17 |
| 529 | 0.20 | 0.53 | 0.92 | 14.76 | 0.484 | 0.91 | 0.47 | 0.30 | 0.22 |
| 530 | 0.10 | 0.27 | 0.41 | 14.93 | 0.335 | 1.34 | 0.08 | 0.06 | 0.01 |
| 531 | 0.22 | 0.75 | 0.81 | 12.70 | 0.682 | 0.72 | 0.05 | 0.10 | 0.10 |
| 532 | 0.08 | 0.68 | 0.39 | 12.54 | 0.873 | 3.49 | 0.72 | 0.33 | 0.09 |
| 533 | 0.08 | 0.31 | 0.22 | 5.73 | 0.240 | 0.83 | 0.44 | 0.17 | 0.17 |
| 534 | 0.29 | 0.69 | 0.55 | 16.06 | 0.103 | 0.43 | 0.53 | 0.29 | 0.07 |
| 535 | 0.25 | 0.13 | 0.87 | 9.12 | 0.824 | 1.81 | 0.83 | 0.12 | 0.11 |
| 536 | 0.20 | 0.46 | 0.25 | 15.12 | 0.223 | 2.73 | 0.20 | 0.30 | 0.13 |
| 537 | 0.08 | 0.36 | 0.94 | 12.48 | 0.146 | 1.04 | 0.93 | 0.03 | 0.21 |
| 538 | 0.28 | 0.12 | 0.83 | 12.06 | 0.418 | 1.13 | 0.41 | 0.45 | 0.20 |
| 539 | 0.04 | 0.77 | 0.98 | 11.84 | 0.884 | 2.45 | 0.43 | 0.25 | 0.16 |
| 530 | 0.03 | 0.22 | 0.84 | 15.87 | 0.871 | 1.14 | 0.84 | 0.09 | 0.19 |
| 541 | 0.06 | 0.31 | 0.71 | 15.93 | 0.728 | 1.65 | 0.98 | 0.13 | 0.24 |
| 542 | 0.22 | 0.52 | 0.84 | 16.03 | 0.282 | 1.77 | 0.70 | 0.05 | 0.16 |
| 543 | 0.18 | 0.32 | 0.31 | 7.84 | 0.873 | 0.98 | 0.33 | 0.25 | 0.14 |
| 544 | 0.03 | 0.37 | 0.58 | 14.93 | 0.328 | 0.32 | 0.18 | 0.41 | 0.14 |
| 545 | 0.01 | 0.15 | 0.32 | 9.32 | 0.984 | 2.62 | 0.10 | 0.22 | 0.01 |
| 546 | 0.09 | 0.71 | 0.60 | 15.01 | 0.200 | 0.74 | 0.93 | 0.31 | 0.19 |
| 547 | 0.07 | 0.74 | 0.49 | 16.69 | 0.784 | 0.70 | 0.02 | 0.37 | 0.15 |
| 548 | 0.04 | 0.52 | 0.26 | 12.21 | 0.582 | 1.96 | 0.18 | 0.31 | 0.22 |
| 549 | 0.24 | 0.67 | 0.57 | 12.50 | 0.928 | 0.69 | 0.75 | 0.06 | 0.12 |
| 550 | 0.20 | 0.70 | 0.90 | 8.91 | 0.161 | 2.94 | 0.09 | 0.02 | 0.17 |

TABLE 19-2

STEEL OF INVENTION

| No. | Ti | Zr | Ta | Hf | Co | Ni | (Mass. %) Cu |
|---|---|---|---|---|---|---|---|
| 521 | — | 1.365 | 0.836 | 0.848 | 2.98 | — | 0.67 |
| 522 | — | 1.611 | 0.870 | 0.066 | 3.68 | — | 0.75 |
| 523 | 1.828 | — | 0.653 | 1.394 | 3.12 | — | 1.91 |
| 524 | 0.234 | — | 1.815 | 1.474 | 0.44 | — | 1.14 |
| 525 | 1.435 | — | 0.036 | 1.973 | 4.44 | — | 1.74 |
| 526 | 0.149 | — | 0.984 | 1.575 | 4.77 | — | 1.64 |

TABLE 19-2-continued

STEEL OF INVENTION

| No. | Ti | Zr | Ta | Hf | Co | Ni | (Mass. %) Cu |
|---|---|---|---|---|---|---|---|
| 527 | 0.015 | — | 1.338 | 0.941 | 0.62 | — | 0.50 |
| 528 | 0.706 | — | 1.753 | 0.750 | 0.81 | — | 1.65 |
| 529 | 0.888 | 1.824 | — | 1.679 | 4.58 | — | 0.31 |
| 530 | 1.249 | 0.694 | — | 0.401 | 1.52 | — | 0.67 |
| 531 | 0.462 | 1.294 | — | 0.588 | 2.86 | — | 1.52 |
| 532 | 0.187 | 1.268 | — | 1.879 | 2.94 | — | 1.69 |
| 533 | 0.075 | 1.335 | — | 1.002 | 3.49 | — | 0.89 |
| 534 | 0.827 | 0.153 | — | 0.607 | 1.28 | — | 0.60 |
| 535 | 0.120 | 0.372 | 1.380 | 1.348 | 2.68 | — | 1.44 |
| 536 | 0.595 | 0.675 | 0.614 | 0.903 | 2.09 | — | 1.29 |
| 537 | 0.960 | 1.725 | 0.976 | 0.955 | 3.62 | — | 0.79 |
| 538 | 1.869 | 0.194 | 0.113 | 1.146 | 1.54 | — | 0.51 |
| 539 | 1.982 | 1.779 | 0.737 | 0.198 | 2.41 | — | 1.98 |
| 530 | 2.000 | 0.144 | 1.500 | 1.749 | 2.97 | — | 1.31 |
| 541 | 0.566 | — | — | — | — | 2.44 | 0.88 |
| 542 | 0.386 | — | — | — | — | 4.35 | 1.31 |
| 543 | 1.093 | — | — | — | — | 2.05 | 0.50 |
| 544 | 1.369 | — | — | — | — | 2.00 | 0.86 |
| 545 | 1.909 | — | — | — | — | 3.39 | 1.19 |
| 546 | 1.372 | — | — | — | — | 3.02 | 1.18 |
| 547 | — | 0.694 | — | — | — | 4.87 | 1.45 |
| 548 | — | 1.400 | — | — | — | 3.45 | 0.82 |
| 549 | — | 0.936 | — | — | — | 0.29 | 0.76 |
| 550 | — | 0.968 | — | — | — | 1.88 | 1.02 |

TABLE 19-3

STEEL OF INVENTION

| No. | P | S | O | D-CRS | HAZCRS | (Mass. %) M % |
|---|---|---|---|---|---|---|
| 521 | 0.0127 | 0.001 | 0.016 | 3 | 134 | 34 |
| 522 | 0.0249 | 0.008 | 0.001 | 4 | 157 | 26 |
| 523 | 0.0009 | 0.009 | 0.008 | 0 | 142 | 38 |
| 524 | 0.0100 | 0.009 | 0.015 | 1 | 163 | 36 |
| 525 | 0.0025 | 0.005 | 0.018 | 6 | 151 | 39 |
| 526 | 0.0036 | 0.006 | 0.005 | 2 | 158 | 31 |
| 527 | 0.0229 | 0.005 | 0.010 | 4 | 161 | 25 |
| 528 | 0.0112 | 0.005 | 0.013 | 1 | 138 | 35 |
| 529 | 0.0084 | 0.005 | 0.018 | 1 | 166 | 46 |
| 530 | 0.0243 | 0.003 | 0.014 | 3 | 175 | 30 |
| 531 | 0.0091 | 0.003 | 0.016 | 1 | 165 | 31 |
| 532 | 0.0029 | 0.002 | 0.002 | 1 | 165 | 37 |
| 533 | 0.0011 | 0.005 | 0.017 | 3 | 178 | 26 |
| 534 | 0.0282 | 0.004 | 0.010 | 1 | 131 | 19 |
| 535 | 0.0048 | 0.008 | 0.006 | 2 | 153 | 34 |
| 536 | 0.0004 | 0.005 | 0.012 | 4 | 170 | 34 |
| 537 | 0.0252 | 0.004 | 0.005 | 7 | 162 | 45 |
| 538 | 0.0297 | 0.004 | 0.002 | 1 | 154 | 38 |
| 539 | 0.0090 | 0.006 | 0.009 | 4 | 175 | 43 |
| 530 | 0.0178 | 0.005 | 0.003 | 4 | 154 | 54 |
| 541 | 0.0063 | 0.004 | 0.001 | 3 | 167 | 11 |
| 542 | 0.0146 | 0.006 | 0.009 | 3 | 142 | 16 |
| 543 | 0.0225 | 0.001 | 0.015 | 4 | 157 | 20 |
| 544 | 0.0106 | 0.005 | 0.014 | 3 | 140 | 20 |
| 545 | 0.0037 | 0.003 | 0.015 | 5 | 169 | 26 |
| 546 | 0.0266 | 0.003 | 0.013 | 6 | 146 | 25 |
| 547 | 0.0297 | 0.008 | 0.015 | 4 | 148 | 17 |
| 548 | 0.0233 | 0.002 | 0.017 | 6 | 180 | 21 |
| 549 | 0.0022 | 0.007 | 0.008 | 2 | 168 | 13 |
| 550 | 0.0067 | 0.008 | 0.003 | 4 | 165 | 21 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 20-1

STEEL OF INVENTION

| No. | C | Si | Mn | Cr | Mo | W | V | Nb | (Mass. %) N |
|---|---|---|---|---|---|---|---|---|---|
| 551 | 0.16 | 0.47 | 0.70 | 5.73 | 0.609 | 1.57 | 0.50 | 0.36 | 0.21 |
| 552 | 0.06 | 0.25 | 0.67 | 14.06 | 0.626 | 1.03 | 0.35 | 0.26 | 0.08 |
| 553 | 0.01 | 0.68 | 0.65 | 12.02 | 0.032 | 0.72 | 0.45 | 0.13 | 0.21 |
| 554 | 0.25 | 0.48 | 0.93 | 10.68 | 0.669 | 3.45 | 0.65 | 0.14 | 0.22 |
| 555 | 0.15 | 0.67 | 0.56 | 7.65 | 0.862 | 2.01 | 0.29 | 0.46 | 0.07 |
| 556 | 0.10 | 0.36 | 0.22 | 7.62 | 0.968 | 0.89 | 0.68 | 0.26 | 0.18 |
| 557 | 0.19 | 0.59 | 0.98 | 8.28 | 0.317 | 2.81 | 0.21 | 0.45 | 0.05 |
| 558 | 0.24 | 0.06 | 0.71 | 14.01 | 0.235 | 2.28 | 0.16 | 0.46 | 0.23 |
| 559 | 0.05 | 0.58 | 0.86 | 16.07 | 0.052 | 2.00 | 0.37 | 0.43 | 0.21 |
| 560 | 0.15 | 0.08 | 0.92 | 5.99 | 0.622 | 1.56 | 0.22 | 0.32 | 0.06 |
| 561 | 0.21 | 0.39 | 0.35 | 14.08 | 0.772 | 0.31 | 0.99 | 0.03 | 0.11 |
| 562 | 0.17 | 0.21 | 0.62 | 12.26 | 0.843 | 2.71 | 0.58 | 0.21 | 0.07 |
| 563 | 0.15 | 0.18 | 0.40 | 11.34 | 0.171 | 1.60 | 0.28 | 0.29 | 0.03 |
| 564 | 0.22 | 0.58 | 0.76 | 15.69 | 0.086 | 1.39 | 0.43 | 0.44 | 0.07 |
| 565 | 0.06 | 0.10 | 0.77 | 16.73 | 0.427 | 3.20 | 0.87 | 0.34 | 0.15 |
| 566 | 0.06 | 0.56 | 0.29 | 12.23 | 0.028 | 3.16 | 0.45 | 0.39 | 0.23 |
| 567 | 0.30 | 0.28 | 0.40 | 6.64 | 0.228 | 2.42 | 0.48 | 0.02 | 0.14 |
| 568 | 0.16 | 0.68 | 0.95 | 17.20 | 0.850 | 2.03 | 0.81 | 0.13 | 0.10 |
| 569 | 0.04 | 0.48 | 0.63 | 15.87 | 0.745 | 1.48 | 0.29 | 0.15 | 0.17 |
| 570 | 0.16 | 0.69 | 0.49 | 6.96 | 0.736 | 0.20 | 0.22 | 0.49 | 0.09 |
| 571 | 0.06 | 0.05 | 0.41 | 14.39 | 0.179 | 2.68 | 0.47 | 0.10 | 0.17 |
| 572 | 0.26 | 0.75 | 0.66 | 16.58 | 0.888 | 3.35 | 0.36 | 0.35 | 0.13 |
| 573 | 0.13 | 0.73 | 0.71 | 11.34 | 0.224 | 1.72 | 0.73 | 0.20 | 0.18 |
| 574 | 0.21 | 0.62 | 0.42 | 16.10 | 0.006 | 0.53 | 0.42 | 0.04 | 0.03 |
| 575 | 0.16 | 0.31 | 0.48 | 15.72 | 0.075 | 0.90 | 0.27 | 0.06 | 0.12 |
| 576 | 0.23 | 0.05 | 0.72 | 7.87 | 0.252 | 2.23 | 0.10 | 0.39 | 0.06 |
| 577 | 0.06 | 0.10 | 0.24 | 16.61 | 0.389 | 0.74 | 0.74 | 0.24 | 0.04 |
| 578 | 0.06 | 0.35 | 0.91 | 7.32 | 0.818 | 2.47 | 0.55 | 0.26 | 0.16 |
| 579 | 0.03 | 0.65 | 0.57 | 10.25 | 0.876 | 1.92 | 0.85 | 0.37 | 0.23 |
| 580 | 0.21 | 0.11 | 0.72 | 10.38 | 0.409 | 1.88 | 0.99 | 0.48 | 0.12 |

TABLE 20-2

STEEL OF INVENTION

| No. | Ti | Zr | Ta | Hf | Co | Ni | (Mass. %) Cu |
|---|---|---|---|---|---|---|---|
| 551 | — | 1.163 | — | — | — | 2.58 | 1.27 |
| 552 | — | 0.203 | — | — | — | 4.02 | 0.33 |
| 553 | 0.758 | 1.720 | — | — | — | 0.52 | 0.57 |
| 554 | 1.744 | 1.419 | — | — | — | 1.01 | 1.73 |
| 555 | 0.717 | 1.982 | — | — | — | 2.27 | 0.83 |
| 556 | 1.334 | 0.065 | — | — | — | 1.11 | 0.23 |
| 557 | 0.274 | 1.342 | — | — | — | 3.95 | 1.47 |
| 558 | 0.186 | 1.479 | — | — | — | 2.80 | 0.65 |
| 559 | — | — | 0.968 | — | — | 1.65 | 1.95 |
| 560 | — | — | 0.609 | — | — | 4.54 | 1.50 |
| 561 | — | — | 0.498 | — | — | 3.47 | 0.78 |
| 562 | — | — | 1.290 | — | — | 4.81 | 0.42 |
| 563 | — | — | 1.690 | — | — | 3.06 | 1.92 |
| 564 | — | — | 1.357 | — | — | 4.57 | 1.37 |
| 565 | 1.501 | — | 1.926 | — | — | 1.35 | 1.18 |
| 566 | 1.464 | — | 0.140 | — | — | 4.65 | 1.97 |
| 567 | 1.448 | — | 1.617 | — | — | 4.04 | 1.62 |
| 568 | 0.145 | — | 0.046 | — | — | 1.21 | 1.67 |
| 569 | 0.196 | — | 1.116 | — | — | 4.89 | 0.89 |
| 570 | 0.293 | — | 1.467 | — | — | 4.74 | 0.80 |
| 571 | — | 1.772 | 0.787 | — | — | 4.76 | 0.21 |
| 572 | — | 0.587 | 1.743 | — | — | 1.72 | 1.49 |
| 573 | — | 0.327 | 1.014 | — | — | 4.49 | 1.70 |
| 574 | — | 1.695 | 1.273 | — | — | 0.28 | 1.41 |
| 575 | — | 0.357 | 0.190 | — | — | 0.28 | 0.34 |
| 576 | — | 1.963 | 0.423 | — | — | 3.72 | 1.78 |
| 577 | 0.748 | 0.217 | 1.659 | — | — | 4.99 | 1.84 |
| 578 | 1.401 | 0.776 | 1.577 | — | — | 3.29 | 1.12 |
| 579 | 0.159 | 1.287 | 1.805 | — | — | 2.67 | 0.22 |
| 580 | 0.669 | 1.461 | 1.073 | — | — | 4.73 | 0.67 |

TABLE 20-3

STEEL OF INVENTION

| No. | P | S | O | D-CRS | HAZCRS | (Mass. %) M % |
|---|---|---|---|---|---|---|
| 551 | 0.0015 | 0.008 | 0.008 | 5 | 148 | 17 |
| 552 | 0.0267 | 0.004 | 0.002 | 6 | 172 | 8 |
| 553 | 0.0026 | 0.006 | 0.019 | 6 | 163 | 32 |
| 554 | 0.0141 | 0.007 | 0.008 | 4 | 174 | 29 |
| 555 | 0.0117 | 0.005 | 0.015 | 3 | 133 | 27 |
| 556 | 0.0051 | 0.003 | 0.016 | 1 | 143 | 23 |
| 557 | 0.0043 | 0.010 | 0.009 | 5 | 131 | 18 |
| 558 | 0.0048 | 0.009 | 0.020 | 2 | 175 | 22 |
| 559 | 0.0162 | 0.009 | 0.015 | 6 | 177 | 18 |
| 560 | 0.0189 | 0.003 | 0.003 | 4 | 167 | 19 |
| 561 | 0.0078 | 0.004 | 0.008 | 7 | 145 | 9 |
| 562 | 0.0080 | 0.006 | 0.018 | 2 | 141 | 16 |
| 563 | 0.0296 | 0.006 | 0.010 | 2 | 131 | 23 |
| 564 | 0.0226 | 0.009 | 0.019 | 7 | 144 | 20 |
| 565 | 0.0272 | 0.003 | 0.014 | 4 | 131 | 35 |
| 566 | 0.0237 | 0.005 | 0.002 | 3 | 147 | 17 |
| 567 | 0.0067 | 0.005 | 0.017 | 6 | 144 | 35 |
| 568 | 0.0019 | 0.006 | 0.017 | 2 | 174 | 8 |
| 569 | 0.0037 | 0.006 | 0.020 | 3 | 165 | 22 |
| 570 | 0.0074 | 0.004 | 0.002 | 2 | 144 | 25 |
| 571 | 0.0084 | 0.002 | 0.018 | 1 | 141 | 29 |
| 572 | 0.0012 | 0.005 | 0.007 | 1 | 132 | 25 |
| 573 | 0.0263 | 0.005 | 0.014 | 6 | 145 | 24 |
| 574 | 0.0189 | 0.001 | 0.017 | 7 | 157 | 28 |
| 575 | 0.0038 | 0.006 | 0.012 | 6 | 148 | 18 |
| 576 | 0.0061 | 0.009 | 0.016 | 3 | 168 | 31 |
| 577 | 0.0210 | 0.008 | 0.007 | 4 | 171 | 29 |
| 578 | 0.0134 | 0.006 | 0.019 | 6 | 136 | 36 |
| 579 | 0.0085 | 0.003 | 0.010 | 6 | 138 | 39 |
| 580 | 0.0162 | 0.009 | 0.008 | 2 | 157 | 33 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 21-1

STEEL OF INVENTION

| No. | C | Si | Mn | Cr | Mo | W | V | Nb | (Mass. %) N |
|---|---|---|---|---|---|---|---|---|---|
| 581 | 0.26 | 0.15 | 0.42 | 5.47 | 0.232 | 1.78 | 0.31 | 0.04 | 0.01 |
| 582 | 0.29 | 0.27 | 0.73 | 13.00 | 0.693 | 1.08 | 0.61 | 0.17 | 0.24 |
| 583 | 0.09 | 0.31 | 0.32 | 17.77 | 0.126 | 0.89 | 0.75 | 0.31 | 0.15 |
| 584 | 0.06 | 0.56 | 0.27 | 11.16 | 0.864 | 2.33 | 0.09 | 0.39 | 0.19 |
| 585 | 0.29 | 0.49 | 0.83 | 10.43 | 0.250 | 3.19 | 0.90 | 0.07 | 0.08 |
| 586 | 0.02 | 0.37 | 0.69 | 7.15 | 0.614 | 1.28 | 0.10 | 0.25 | 0.15 |
| 587 | 0.06 | 0.06 | 0.51 | 12.08 | 0.794 | 1.05 | 0.95 | 0.13 | 0.22 |
| 588 | 0.07 | 0.60 | 0.94 | 16.45 | 0.616 | 0.23 | 0.82 | 0.34 | 0.15 |
| 589 | 0.16 | 0.71 | 0.68 | 11.92 | 0.437 | 3.29 | 0.07 | 0.34 | 0.02 |
| 590 | 0.13 | 0.26 | 0.78 | 15.66 | 0.573 | 3.08 | 0.49 | 0.02 | 0.01 |
| 591 | 0.22 | 0.66 | 0.32 | 6.08 | 0.875 | 2.37 | 0.45 | 0.06 | 0.10 |
| 592 | 0.10 | 0.64 | 0.77 | 7.16 | 0.181 | 2.24 | 0.76 | 0.11 | 0.25 |
| 593 | 0.29 | 0.44 | 0.38 | 16.55 | 0.306 | 0.50 | 0.28 | 0.36 | 0.17 |
| 594 | 0.18 | 0.73 | 0.63 | 6.24 | 0.100 | 3.23 | 0.82 | 0.46 | 0.07 |
| 595 | 0.29 | 0.20 | 0.59 | 6.57 | 0.893 | 1.61 | 0.74 | 0.10 | 0.14 |
| 596 | 0.28 | 0.66 | 0.92 | 8.93 | 0.029 | 1.71 | 0.86 | 0.43 | 0.24 |
| 597 | 0.26 | 0.45 | 0.31 | 11.18 | 0.341 | 1.35 | 0.53 | 0.37 | 0.07 |
| 598 | 0.17 | 0.21 | 0.20 | 17.68 | 0.164 | 3.28 | 0.08 | 0.10 | 0.08 |
| 599 | 0.26 | 0.19 | 0.49 | 13.31 | 0.331 | 2.03 | 0.34 | 0.27 | 0.23 |
| 600 | 0.19 | 0.29 | 0.22 | 15.47 | 0.684 | 1.99 | 0.16 | 0.06 | 0.24 |
| 601 | 0.06 | 0.75 | 0.48 | 90.00 | 0.559 | 2.61 | 0.35 | 0.38 | 0.07 |
| 602 | 0.25 | 0.27 | 0.73 | 11.25 | 0.289 | 1.71 | 0.27 | 0.41 | 0.04 |
| 603 | 0.14 | 0.69 | 0.84 | 13.59 | 0.208 | 0.40 | 0.25 | 0.31 | 0.23 |
| 604 | 0.26 | 0.69 | 0.67 | 7.38 | 0.652 | 3.06 | 0.12 | 0.24 | 0.13 |
| 605 | 0.27 | 0.55 | 0.90 | 10.01 | 0.958 | 0.96 | 0.71 | 0.39 | 0.17 |
| 606 | 0.13 | 0.52 | 1.00 | 12.72 | 0.456 | 3.36 | 0.86 | 0.15 | 0.07 |
| 607 | 0.07 | 0.48 | 0.42 | 13.60 | 0.998 | 1.58 | 0.93 | 0.22 | 0.16 |

TABLE 21-1-continued

STEEL OF INVENTION

| No. | C | Si | Mn | Cr | Mo | W | V | Nb | (Mass. %) N |
|---|---|---|---|---|---|---|---|---|---|
| 608 | 0.20 | 0.69 | 0.66 | 16.91 | 0.910 | 1.62 | 0.25 | 0.23 | 0.04 |
| 609 | 0.03 | 0.63 | 0.76 | 14.01 | 0.526 | 1.29 | 0.13 | 0.14 | 0.02 |
| 610 | 0.24 | 0.57 | 0.20 | 9.22 | 0.685 | 3.35 | 0.90 | 0.33 | 0.18 |

TABLE 21-2

STEEL OF INVENTION

| No. | Ti | Zr | Ta | Hf | Co | Ni | (Mass. %) Cu |
|---|---|---|---|---|---|---|---|
| 581 | 1.622 | 1.938 | 0.020 | — | — | 1.45 | 0.35 |
| 582 | 0.687 | 1.423 | 1.327 | — | — | 1.73 | 1.69 |
| 583 | — | — | — | 1.260 | — | 4.65 | 1.65 |
| 584 | — | — | — | 1.256 | — | 2.37 | 0.89 |
| 585 | — | — | — | 1.984 | — | 1.20 | 1.78 |
| 586 | — | — | — | 0.122 | — | 2.79 | 0.43 |
| 587 | — | — | — | 1.345 | — | 3.91 | 1.94 |
| 588 | — | — | — | 1.320 | — | 1.47 | 0.65 |
| 589 | 0.546 | — | — | 0.716 | — | 4.16 | 1.60 |
| 590 | 0.644 | — | — | 0.228 | — | 1.69 | 1.86 |
| 591 | 1.916 | — | — | 1.515 | — | 2.86 | 0.20 |
| 592 | 1.005 | — | — | 0.252 | — | 2.05 | 0.83 |
| 593 | 1.589 | — | — | 0.094 | — | 3.26 | 0.77 |
| 594 | 0.356 | — | — | 1.712 | — | 3.31 | 0.59 |
| 595 | — | 1.529 | — | 1.801 | — | 3.84 | 0.92 |
| 596 | — | 1.422 | — | 0.017 | — | 4.03 | 1.45 |
| 597 | — | 1.391 | — | 0.041 | — | 3.13 | 1.90 |
| 598 | — | 1.101 | — | 1.535 | — | 0.31 | 1.97 |
| 599 | — | 1.223 | — | 1.181 | — | 2.05 | 1.38 |
| 600 | — | 1.421 | — | 0.639 | — | 2.66 | 0.69 |
| 601 | — | — | 1.739 | 1.583 | — | 1.42 | 1.44 |
| 602 | — | — | 0.303 | 1.700 | — | 2.36 | 1.54 |
| 603 | — | — | 1.329 | 0.655 | — | 2.26 | 0.67 |
| 604 | — | — | 0.498 | 0.114 | — | 2.76 | 0.37 |
| 605 | — | — | 1.481 | 0.756 | — | 3.05 | 1.21 |
| 606 | — | — | 0.943 | 1.241 | — | 2.30 | 1.10 |
| 607 | — | 0.662 | 0.552 | 1.241 | — | 4.57 | 1.55 |
| 608 | — | 0.723 | 0.986 | 0.437 | — | 4.28 | 1.36 |
| 609 | — | 0.908 | 1.908 | 1.479 | — | 2.98 | 1.14 |
| 610 | — | 1.901 | 0.016 | 1.085 | — | 2.39 | 1.50 |

TABLE 21-3

STEEL OF INVENTION

| No. | P | S | O | D-CRS | HAZCRS | (Mass. %) M % |
|---|---|---|---|---|---|---|
| 581 | 0.0168 | 0.002 | 0.017 | 0 | 170 | 35 |
| 582 | 0.0054 | 0.001 | 0.016 | 3 | 154 | 38 |
| 583 | 0.0068 | 0.002 | 0.002 | 6 | 138 | 15 |
| 584 | 0.0015 | 0.006 | 0.019 | 4 | 149 | 19 |
| 585 | 0.0291 | 0.009 | 0.017 | 7 | 164 | 26 |
| 586 | 0.0103 | 0.004 | 0.001 | 2 | 163 | 9 |
| 587 | 0.0143 | 0.003 | 0.017 | 0 | 172 | 18 |
| 588 | 0.0221 | 0.004 | 0.013 | 3 | 169 | 16 |
| 589 | 0.0280 | 0.007 | 0.005 | 5 | 156 | 22 |
| 590 | 0.0276 | 0.005 | 0.010 | 7 | 138 | 19 |
| 591 | 0.0161 | 0.001 | 0.006 | 6 | 141 | 33 |
| 592 | 0.0032 | 0.008 | 0.017 | 5 | 142 | 21 |
| 593 | 0.0289 | 0.010 | 0.012 | 6 | 171 | 25 |
| 594 | 0.0283 | 0.010 | 0.007 | 6 | 154 | 30 |
| 595 | 0.0268 | 0.007 | 0.017 | 2 | 169 | 32 |
| 596 | 0.0193 | 0.003 | 0.003 | 7 | 144 | 19 |
| 597 | 0.0009 | 0.008 | 0.017 | 3 | 157 | 17 |
| 598 | 0.0265 | 0.009 | 0.018 | 6 | 160 | 28 |
| 599 | 0.0167 | 0.010 | 0.013 | 5 | 157 | 27 |
| 600 | 0.0257 | 0.009 | 0.018 | 2 | 149 | 29 |

TABLE 21-3-continued

STEEL OF INVENTION

| No. | P | S | O | D-CRS | HAZCRS | (Mass. %) M % |
|---|---|---|---|---|---|---|
| 601 | 0.0193 | 0.005 | 0.010 | 6 | 140 | 34 |
| 602 | 0.0224 | 0.006 | 0.006 | 5 | 158 | 25 |
| 603 | 0.0152 | 0.001 | 0.012 | 6 | 179 | 27 |
| 604 | 0.0076 | 0.007 | 0.015 | 0 | 132 | 10 |
| 605 | 0.0247 | 0.008 | 0.003 | 4 | 170 | 27 |
| 606 | 0.0015 | 0.003 | 0.020 | 2 | 170 | 25 |
| 607 | 0.0229 | 0.009 | 0.015 | 0 | 135 | 29 |
| 608 | 0.0095 | 0.010 | 0.014 | 2 | 143 | 27 |
| 609 | 0.0159 | 0.010 | 0.003 | 4 | 172 | 38 |
| 610 | 0.0075 | 0.007 | 0.010 | 4 | 173 | 33 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 22-1

STEEL OF INVENTION

| No. | C | Si | Mn | Cr | Mo | W | V | Nb | (Mass. %) N |
|---|---|---|---|---|---|---|---|---|---|
| 611 | 0.06 | 0.75 | 0.85 | 6.96 | 0.221 | 0.67 | 0.93 | 0.24 | 0.13 |
| 612 | 0.16 | 0.68 | 0.97 | 5.05 | 0.465 | 0.93 | 0.06 | 0.28 | 0.07 |
| 613 | 0.20 | 0.61 | 0.85 | 14.50 | 0.765 | 0.34 | 0.09 | 0.13 | 0.20 |
| 614 | 0.15 | 0.40 | 0.74 | 13.63 | 0.956 | 3.29 | 0.87 | 0.43 | 0.24 |
| 615 | 0.24 | 0.73 | 0.92 | 6.76 | 0.871 | 0.98 | 0.26 | 0.38 | 0.03 |
| 616 | 0.27 | 0.28 | 0.85 | 11.21 | 0.341 | 1.10 | 0.06 | 0.14 | 0.12 |
| 617 | 0.07 | 0.10 | 0.80 | 11.88 | 0.697 | 1.47 | 0.61 | 0.36 | 0.01 |
| 618 | 0.15 | 0.43 | 0.23 | 6.61 | 0.290 | 3.21 | 0.27 | 0.23 | 0.13 |
| 619 | 0.18 | 0.40 | 0.63 | 12.80 | 0.940 | 2.46 | 0.84 | 0.15 | 0.20 |
| 620 | 0.11 | 0.25 | 0.26 | 15.43 | 0.505 | 0.37 | 0.22 | 0.30 | 0.18 |
| 621 | 0.19 | 0.25 | 0.58 | 5.71 | 0.799 | 1.30 | 0.18 | 0.10 | 0.04 |
| 622 | 0.08 | 0.26 | 0.26 | 7.56 | 0.172 | 1.43 | 0.09 | 0.20 | 0.09 |
| 623 | 0.17 | 0.16 | 0.78 | 5.84 | 0.449 | 0.22 | 0.76 | 0.29 | 0.06 |
| 624 | 0.11 | 0.61 | 0.41 | 11.42 | 0.473 | 0.43 | 0.06 | 0.27 | 0.14 |
| 625 | 0.16 | 0.69 | 0.60 | 9.18 | 0.081 | 1.51 | 0.79 | 0.07 | 0.06 |
| 626 | 0.25 | 0.27 | 0.43 | 9.97 | 0.104 | 2.91 | 0.33 | 0.11 | 0.13 |
| 627 | 0.21 | 0.79 | 0.58 | 11.66 | 0.378 | 0.82 | 0.96 | 0.29 | 0.20 |
| 628 | 0.13 | 0.57 | 0.50 | 12.18 | 0.247 | 1.29 | 0.58 | 0.30 | 0.23 |
| 629 | 0.10 | 0.63 | 0.47 | 15.79 | 0.038 | 2.10 | 0.96 | 0.05 | 0.17 |
| 630 | 0.22 | 0.08 | 0.34 | 7.35 | 0.583 | 2.72 | .0.98 | 0.44 | 0.24 |
| 631 | 0.02 | 0.34 | 0.81 | 17.28 | 0.726 | 0.96 | 0.48 | 0.17 | 0.14 |
| 632 | 0.30 | 0.50 | 0.92 | 10.90 | 0.297 | 2.86 | 0.26 | 0.13 | 0.08 |
| 633 | 0.01 | 0.45 | 0.95 | 5.68 | 0.645 | 1.34 | 0.67 | 0.50 | 0.15 |
| 634 | 0.27 | 0.06 | 0.38 | 5.99 | 0.101 | 2.42 | 0.08 | 0.45 | 0.17 |
| 635 | 0.16 | 0.75 | 0.27 | 9.63 | 0.992 | 0.62 | 0.77 | 0.15 | 0.12 |
| 636 | 0.05 | 0.43 | 0.88 | 7.89 | 0.657 | 0.30 | 0.12 | 0.26 | 0.19 |
| 637 | 0.05 | 0.56 | 0.89 | 11.77 | 0.438 | 0.98 | 0.44 | 0.20 | 0.22 |
| 638 | 0.12 | 0.23 | 0.96 | 6.15 | 0.172 | 2.10 | 0.58 | 0.15 | 0.18 |
| 639 | 0.20 | 0.07 | 0.97 | 8.23 | 0.674 | 3.08 | 0.36 | 0.25 | 0.02 |
| 640 | 0.10 | 0.74 | 0.38 | 9.49 | 0.309 | 3.44 | 0.15 | 0.20 | 0.07 |

TABLE 22-2

STEEL OF INVENTION

| No. | Ti | Zr | Ta | Hf | Co | Ni | (Mass. %) Cu |
|---|---|---|---|---|---|---|---|
| 611 | — | 1.381 | 0.967 | 0.900 | — | 1.64 | 0.34 |
| 612 | — | 0.010 | 0.436 | 1.594 | — | 2.40 | 1.87 |
| 613 | 1.738 | — | 1.064 | 0.821 | — | 3.80 | 1.28 |
| 614 | 0.015 | — | 0.569 | 1.286 | — | 2.72 | 1.88 |
| 615 | 0.557 | — | 0.610 | 1.656 | — | 0.78 | 0.70 |
| 616 | 0.062 | — | 1.833 | 1.572 | — | 1.89 | 1.89 |

TABLE 22-2-continued

STEEL OF INVENTION

| No. | Ti | Zr | Ta | Hf | Co | Ni | (Mass. %) Cu |
|---|---|---|---|---|---|---|---|
| 617 | 1.170 | — | 0.944 | 0.755 | — | 0.64 | 0.72 |
| 618 | 1.575 | — | 0.590 | 1.822 | — | 3.24 | 1.33 |
| 619 | 1.956 | 0.861 | — | 1.500 | — | 1.90 | 0.79 |
| 620 | 0.979 | 0.857 | — | 1.441 | — | 0.52 | 0.56 |
| 621 | 0.312 | 1.024 | — | 1.287 | — | 3.11 | 0.36 |
| 622 | 1.631 | 1.064 | — | 0.743 | — | 4.11 | 0.79 |
| 623 | 0.603 | 0.650 | — | 1.475 | — | 2.74 | 0.66 |
| 624 | 0.890 | 1.443 | — | 1.153 | — | 2.98 | 1.46 |
| 625 | 0.186 | 0.115 | 0.895 | 0.440 | — | 1.67 | 0.21 |
| 626 | 0.151 | 0.336 | 0.101 | 1.003 | — | 2.78 | 1.11 |
| 627 | 0.464 | 1.771 | 0.887 | 0.537 | — | 0.78 | 1.17 |
| 628 | 1.782 | 0.127 | 1.952 | 0.700 | — | 4.45 | 0.98 |
| 629 | 1.789 | 0.039 | 0.951 | 0.176 | — | 1.03 | 0.27 |
| 630 | 0.150 | 0.207 | 1.569 | 1.629 | — | 1.74 | 1.42 |
| 631 | 0.528 | — | — | — | 2.19 | 0.92 | 1.45 |
| 632 | 1.613 | — | — | — | 1.89 | 0.24 | 1.85 |
| 633 | 0.079 | — | — | — | 2.42 | 3.69 | 0.54 |
| 634 | 0.592 | — | — | — | 3.05 | 0.91 | 0.81 |
| 635 | 0.808 | — | — | — | 2.96 | 3.10 | 0.59 |
| 636 | 1.428 | — | — | — | 1.37 | 4.66 | 1.36 |
| 637 | — | 1.490 | — | — | 2.29 | 4.81 | 1.02 |
| 638 | — | 1.763 | — | — | 2.49 | 0.33 | 1.99 |
| 639 | — | 1.309 | — | — | 3.66 | 2.50 | 1.27 |
| 640 | — | 1.828 | — | — | 2.54 | 3.24 | 0.35 |

TABLE 22-3

STEEL OF INVENTION

| No. | P | S | O | D-CRS | HAZCRS | (Mass. %) M % |
|---|---|---|---|---|---|---|
| 611 | 0.0243 | 0.004 | 0.011 | 6 | 176 | 35 |
| 612 | 0.0015 | 0.009 | 0.013 | 7 | 132 | 27 |
| 613 | 0.0087 | 0.007 | 0.012 | 4 | 170 | 37 |
| 614 | 0.0263 | 0.010 | 0.006 | 4 | 142 | 24 |
| 615 | 0.0050 | 0.007 | 0.020 | 6 | 176 | 28 |
| 616 | 0.0134 | 0.005 | 0.013 | 1 | 175 | 34 |
| 617 | 0.0031 | 0.009 | 0.019 | 6 | 166 | 29 |
| 618 | 0.0129 | 0.002 | 0.017 | 2 | 152 | 41 |
| 619 | 0.0240 | 0.007 | 0.013 | 3 | 161 | 37 |
| 620 | 0.0158 | 0.007 | 0.013 | 6 | 145 | 39 |
| 621 | 0.0137 | 0.006 | 0.015 | 4 | 133 | 34 |
| 622 | 0.0127 | 0.003 | 0.015 | 2 | 152 | 31 |
| 623 | 0.0077 | 0.009 | 0.010 | 4 | 179 | 29 |
| 624 | 0.0089 | 0.010 | 0.006 | 4 | 144 | 31 |
| 625 | 0.0112 | 0.008 | 0.019 | 1 | 172 | 27 |
| 626 | 0.0099 | 0.007 | 0.009 | 1 | 143 | 24 |
| 627 | 0.0003 | 0.005 | 0.010 | 2 | 133 | 42 |
| 628 | 0.0069 | 0.009 | 0.018 | 5 | 171 | 40 |
| 629 | 0.0251 | 0.010 | 0.013 | 0 | 133 | 35 |
| 630 | 0.0202 | 0.009 | 0.009 | 1 | 174 | 38 |
| 631 | 0.0020 | 0.002 | 0.013 | 5 | 170 | 10 |
| 632 | 0.0104 | 0.005 | 0.013 | 6 | 175 | 19 |
| 633 | 0.0109 | 0.007 | 0.005 | 2 | 166 | 12 |
| 634 | 0.0281 | 0.006 | 0.005 | 6 | 171 | 12 |
| 635 | 0.0127 | 0.002 | 0.001 | 2 | 142 | 19 |
| 636 | 0.0043 | 0.006 | 0.018 | 4 | 158 | 24 |
| 637 | 0.0130 | 0.008 | 0.005 | 6 | 171 | 24 |
| 638 | 0.0188 | 0.006 | 0.007 | 5 | 158 | 25 |
| 639 | 0.0025 | 0.008 | 0.011 | 6 | 149 | 17 |
| 640 | 0.0030 | 0.004 | 0.005 | 1 | 144 | 23 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 23-1

STEEL OF INVENTION (Mass. %)

| No. | C | Si | Mn | Cr | Mo | W | V | Nb | N |
|---|---|---|---|---|---|---|---|---|---|
| 641 | 0.07 | 0.17 | 0.66 | 14.30 | 0.390 | 0.93 | 0.23 | 0.14 | 0.04 |
| 642 | 0.20 | 0.18 | 0.47 | 14.07 | 0.774 | 3.34 | 0.50 | 0.26 | 0.02 |
| 643 | 0.30 | 0.65 | 0.91 | 13.22 | 0.294 | 3.48 | 0.75 | 0.47 | 0.09 |
| 644 | 0.17 | 0.65 | 0.61 | 15.86 | 0.761 | 0.77 | 0.84 | 0.19 | 0.20 |
| 645 | 0.06 | 0.06 | 0.27 | 7.07 | 0.039 | 1.33 | 0.60 | 0.09 | 0.08 |
| 646 | 0.22 | 0.33 | 0.54 | 10.71 | 0.948 | 1.29 | 0.85 | 0.32 | 0.17 |
| 647 | 0.01 | 0.15 | 0.50 | 51.0 | 0.336 | 1.78 | 0.46 | 0.07 | 0.08 |
| 648 | 0.11 | 0.17 | 0.40 | 7.60 | 0.529 | 0.58 | 0.73 | 0.49 | 0.22 |
| 649 | 0.19 | 0.25 | 0.93 | 9.53 | 0.359 | 0.44 | 0.51 | 0.02 | 0.11 |
| 650 | 0.19 | 0.28 | 0.35 | 15.27 | 0.173 | 0.85 | 0.15 | 0.06 | 0.04 |
| 651 | 0.21 | 0.13 | 0.52 | 16.32 | 0.798 | 2.91 | 0.46 | 0.28 | 0.22 |
| 652 | 0.21 | 0.05 | 0.92 | 16.90 | 0.086 | 1.14 | 0.29 | 0.35 | 0.02 |
| 653 | 0.29 | 0.71 | 0.63 | 15.04 | 0.360 | 3.24 | 0.97 | 0.44 | 0.11 |
| 654 | 0.10 | 0.41 | 0.69 | 8.44 | 0.952 | 0.41 | 0.86 | 0.23 | 0.22 |
| 655 | 0.17 | 0.59 | 0.60 | 8.03 | 0.211 | 2.00 | 0.27 | 0.12 | 0.18 |
| 656 | 0.18 | 0.33 | 0.99 | 11.57 | 0.949 | 0.86 | 0.04 | 0.03 | 0.19 |
| 657 | 0.22 | 0.29 | 0.57 | 17.19 | 0.536 | 3.10 | 0.99 | 0.37 | 0.22 |
| 658 | 0.09 | 0.34 | 0.38 | 9.48 | 0.282 | 1.54 | 0.99 | 0.09 | 0.23 |
| 659 | 0.19 | 0.36 | 0.70 | 12.49 | 0.532 | 2.26 | 0.87 | 0.07 | 0.05 |
| 660 | 0.02 | 0.21 | 0.20 | 11.01 | 0.622 | 1.39 | 0.45 | 0.25 | 0.01 |
| 661 | 0.28 | 0.16 | 0.75 | 9.37 | 0.385 | 3.33 | 0.07 | 0.29 | 0.19 |
| 662 | 0.17 | 0.46 | 0.21 | 11.99 | 0.656 | 2.64 | 0.07 | 0.36 | 0.19 |
| 663 | 0.11 | 0.22 | 0.85 | 16.73 | 0.273 | 0.38 | 0.76 | 0.38 | 0.09 |
| 664 | 0.16 | 0.07 | 0.94 | 8.41 | 0.574 | 0.99 | 0.04 | 0.28 | 0.09 |
| 665 | 0.02 | 0.30 | 0.76 | 17.55 | 0.400 | 0.62 | 0.67 | 0.20 | 0.15 |
| 666 | 0.20 | 0.36 | 0.97 | 9.41 | 0.081 | 2.04 | 0.06 | 0.33 | 0.11 |
| 667 | 0.07 | 0.55 | 0.24 | 14.37 | 0.947 | 3.03 | 0.96 | 0.33 | 0.17 |
| 668 | 0.03 | 0.32 | 0.83 | 17.23 | 0.339 | 1.41 | 0.30 | 0.36 | 0.17 |
| 669 | 0.03 | 0.72 | 0.62 | 15.87 | 0.096 | 1.59 | 0.34 | 0.11 | 0.08 |
| 670 | 0.16 | 0.07 | 0.67 | 14.75 | 0.548 | 3.03 | 0.94 | 0.47 | 0.09 |

TABLE 23-2

STEEL OF INVENTION (Mass. %)

| No. | Ti | Zr | Ta | Hf | Co | Ni | Cu |
|---|---|---|---|---|---|---|---|
| 641 | — | 0.967 | — | — | 0.82 | 4.30 | 0.78 |
| 642 | — | 0.431 | — | — | 2.47 | 4.79 | 1.33 |
| 643 | 1.039 | 0.860 | — | — | 1.92 | 1.56 | 0.81 |
| 644 | 1.958 | 1.934 | — | — | 0.75 | 0.99 | 1.63 |
| 645 | 0.320 | 1.331 | — | — | 0.57 | 4.70 | 0.76 |
| 646 | 0.776 | 1.709 | — | — | 3.01 | 2.31 | 0.66 |
| 647 | 1.028 | 0.752 | — | — | 2.48 | 2.63 | 1.00 |
| 648 | 1.708 | 1.127 | — | — | 3.02 | 2.50 | 1.49 |
| 649 | — | — | 1.216 | — | 1.42 | 1.11 | 0.95 |
| 650 | — | — | 0.082 | — | 4.09 | 4.87 | 1.77 |
| 651 | — | — | 0.652 | — | 0.62 | 0.97 | 1.84 |
| 652 | — | — | 0.621 | — | 4.67 | 3.08 | 0.90 |
| 653 | — | — | 1.640 | — | 1.01 | 0.75 | 0.43 |
| 654 | — | — | 1.396 | — | 3.27 | 0.43 | 1.93 |
| 655 | 1.643 | — | 1.563 | — | 1.07 | 1.32 | 1.53 |
| 656 | 1.141 | — | 1.798 | — | 3.23 | 0.26 | 0.72 |
| 657 | 0.131 | — | 0.793 | — | 4.13 | 1.22 | 1.01 |
| 658 | 0.304 | — | 0.200 | — | 0.60 | 3.44 | 1.19 |
| 659 | 0.304 | — | 0.704 | — | 3.87 | 1.33 | 1.88 |
| 660 | 1.823 | — | 1.946 | — | 3.48 | 3.63 | 1.85 |
| 661 | — | 0.176 | 1.644 | — | 1.16 | 2.52 | 0.88 |
| 662 | — | 0.786 | 1.458 | — | 3.26 | 1.88 | 0.41 |
| 663 | — | 0.819 | 1.059 | — | 4.22 | 3.38 | 1.07 |
| 664 | — | 1.909 | 0.090 | — | 3.16 | 1.36 | 0.75 |
| 665 | — | 0.777 | 0.258 | — | 4.20 | 2.31 | 0.97 |
| 666 | — | 0.072 | 0.221 | — | 4.11 | 3.01 | 0.53 |
| 667 | 1.272 | 1.462 | 1.647 | — | 4.49 | 2.64 | 0.92 |
| 668 | 0.081 | 1.588 | 0.181 | — | 4.48 | 2.79 | 1.83 |
| 669 | 1.461 | 1.159 | 1.159 | — | 0.97 | 2.71 | 1.19 |
| 670 | 1.063 | 1.859 | 1.360 | — | 0.47 | 4.15 | 0.54 |

TABLE 23-3

STEEL OF INVENTION (Mass. %)

| No. | P | S | O | D-CRS | HAZCRS | M % |
|---|---|---|---|---|---|---|
| 641 | 0.0015 | 0.005 | 0.013 | 6 | 172 | 20 |
| 642 | 0.0224 | 0.005 | 0.015 | 3 | 161 | 17 |
| 643 | 0.0162 | 0.008 | 0.006 | 1 | 139 | 22 |
| 644 | 0.0226 | 0.007 | 0.002 | 2 | 133 | 39 |
| 645 | 0.0067 | 0.006 | 0.011 | 2 | 171 | 19 |
| 646 | 0.0088 | 0.007 | 0.009 | 6 | 180 | 31 |
| 647 | 0.0089 | 0.009 | 0.003 | 7 | 139 | 22 |
| 648 | 0.0021 | 0.002 | 0.010 | 6 | 174 | 32 |
| 649 | 0.0132 | 0.002 | 0.006 | 0 | 165 | 18 |
| 650 | 0.0228 | 0.008 | 0.009 | 1 | 139 | 10 |
| 651 | 0.0107 | 0.004 | 0.014 | 7 | 173 | 11 |
| 652 | 0.0018 | 0.008 | 0.019 | 4 | 170 | 11 |
| 653 | 0.0213 | 0.008 | 0.020 | 4 | 158 | 18 |
| 654 | 0.0045 | 0.003 | 0.005 | 7 | 164 | 19 |
| 655 | 0.0212 | 0.001 | 0.009 | 4 | 167 | 35 |
| 656 | 0.0068 | 0.005 | 0.009 | 4 | 143 | 30 |
| 657 | 0.0010 | 0.004 | 0.013 | 0 | 147 | 13 |
| 658 | 0.0288 | 0.001 | 0.016 | 1 | 155 | 14 |
| 659 | 0.0259 | 0.009 | 0.017 | 5 | 170 | 13 |
| 660 | 0.0165 | 0.003 | 0.010 | 5 | 170 | 37 |
| 661 | 0.0118 | 0.009 | 0.004 | 6 | 133 | 28 |
| 662 | 0.0061 | 0.008 | 0.014 | 0 | 161 | 26 |
| 663 | 0.0245 | 0.001 | 0.009 | 0 | 132 | 21 |
| 664 | 0.0173 | 0.007 | 0.003 | 2 | 149 | 30 |
| 665 | 0.0243 | 0.005 | 0.014 | 4 | 140 | 20 |
| 666 | 0.0261 | 0.008 | 0.009 | 1 | 132 | 8 |
| 667 | 0.0022 | 0.009 | 0.013 | 7 | 154 | 48 |
| 668 | 0.0222 | 0.007 | 0.015 | 5 | 132 | 20 |
| 669 | 0.0074 | 0.010 | 0.002 | 4 | 145 | 45 |
| 670 | 0.0275 | 0.007 | 0.008 | 7 | 170 | 47 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 24-1

STEEL OF INVENTION (Mass. %)

| No. | C | Si | Mn | Cr | Mo | W | V | Nb | N |
|---|---|---|---|---|---|---|---|---|---|
| 671 | 0.09 | 0.57 | 0.86 | 5.19 | 0.536 | 1.89 | 0.96 | 0.38 | 0.17 |
| 672 | 0.06 | 0.16 | 0.25 | 17.61 | 0.897 | 2.60 | 0.23 | 0.50 | 0.15 |
| 673 | 0.16 | 0.65 | 0.72 | 17.33 | 0.464 | 1.27 | 0.55 | 0.25 | 0.12 |
| 674 | 0.07 | 0.73 | 0.52 | 8.61 | 0.571 | 0.70 | 0.29 | 0.05 | 0.15 |
| 675 | 0.02 | 0.30 | 0.33 | 15.51 | 0.063 | 1.98 | 0.28 | 0.06 | 0.21 |
| 676 | 0.25 | 0.38 | 0.82 | 16.27 | 0.759 | 1.27 | 0.34 | 0.20 | 0.02 |
| 677 | 0.13 | 0.07 | 0.65 | 8.78 | 0.012 | 1.33 | 0.81 | 0.39 | 0.01 |
| 678 | 0.06 | 0.03 | 0.50 | 16.98 | 0.150 | 1.62 | 0.55 | 0.06 | 0.04 |
| 679 | 0.28 | 0.12 | 0.64 | 12.62 | 0.008 | 1.61 | 0.87 | 0.11 | 0.05 |
| 680 | 0.16 | 0.60 | 0.53 | 13.18 | 0.919 | 0.73 | 0.62 | 0.45 | 0.14 |
| 681 | 0.08 | 0.57 | 0.43 | 16.48 | 0.239 | 3.42 | 0.14 | 0.28 | 0.13 |
| 682 | 0.15 | 0.29 | 0.63 | 13.87 | 0.277 | 0.88 | 0.25 | 0.25 | 0.24 |
| 683 | 0.02 | 0.41 | 0.59 | 16.07 | 0.377 | 2.42 | 0.27 | 0.02 | 0.06 |
| 684 | 0.08 | 0.02 | 0.97 | 8.22 | 0.880 | 2.63 | 0.58 | 0.02 | 0.15 |
| 685 | 0.15 | 0.56 | 0.85 | 14.11 | 0.131 | 2.58 | 0.99 | 0.16 | 0.24 |
| 686 | 0.17 | 0.35 | 0.50 | 5.62 | 0.952 | 1.74 | 0.85 | 0.12 | 0.04 |
| 687 | 0.24 | 0.40 | 0.97 | 12.92 | 0.675 | 1.16 | 0.48 | 0.06 | 0.23 |
| 688 | 0.17 | 0.23 | 0.96 | 8.12 | 0.651 | 0.38 | 0.23 | 0.38 | 0.18 |
| 689 | 0.20 | 0.07 | 0.31 | 13.99 | 0.707 | 2.13 | 0.91 | 0.04 | 0.08 |
| 690 | 0.28 | 0.20 | 0.51 | 5.39 | 0.677 | 0.89 | 0.39 | 0.41 | 0.02 |
| 691 | 0.22 | 0.48 | 0.99 | 15.95 | 0.884 | 2.69 | 0.96 | 0.44 | 0.07 |
| 692 | 0.12 | 0.78 | 0.46 | 5.78 | 0.681 | 2.08 | 0.50 | 0.04 | 0.09 |
| 693 | 0.07 | 0.21 | 0.38 | 11.85 | 0.914 | 0.24 | 0.35 | 0.13 | 0.14 |
| 694 | 0.03 | 0.20 | 0.22 | 6.02 | 0.414 | 3.17 | 0.81 | 0.14 | 0.07 |
| 695 | 0.10 | 0.23 | 0.64 | 12.12 | 0.513 | 2.09 | 0.75 | 0.45 | 0.20 |
| 696 | 0.08 | 0.17 | 0.72 | 14.91 | 0.043 | 3.03 | 0.98 | 0.03 | 0.14 |
| 697 | 0.08 | 0.28 | 0.72 | 5.86 | 0.342 | 0.53 | 0.86 | 0.49 | 0.19 |

TABLE 24-1-continued

STEEL OF INVENTION (Mass. %)

| No. | C | Si | Mn | Cr | Mo | W | V | Nb | N |
|---|---|---|---|---|---|---|---|---|---|
| 698 | 0.18 | 0.43 | 0.91 | 8.83 | 0.252 | 0.64 | 0.22 | 0.30 | 0.08 |
| 699 | 0.05 | 0.50 | 0.36 | 8.64 | 0.098 | 1.13 | 0.86 | 0.10 | 0.02 |
| 700 | 0.22 | 0.73 | 0.53 | 9.51 | 0.714 | 1.50 | 0.17 | 0.06 | 0.08 |

TABLE 24-2

STEEL OF INVENTION (Mass. %)

| No. | Ti | Zr | Ta | Hf | Co | Ni | Cu |
|---|---|---|---|---|---|---|---|
| 671 | 0.585 | 0.375 | 1.370 | — | 2.11 | 3.79 | 1.36 |
| 672 | 1.672 | 1.328 | 1.207 | — | 2.69 | 3.25 | 1.53 |
| 673 | — | — | — | 1.975 | 1.41 | 4.13 | 0.77 |
| 674 | — | — | — | 1.491 | 2.36 | 0.92 | 0.61 |
| 675 | — | — | — | 0.211 | 2.28 | 4.76 | 1.62 |
| 676 | — | — | — | 0.808 | 0.37 | 0.46 | 1.70 |
| 677 | — | — | — | 0.951 | 3.09 | 4.04 | 0.58 |
| 678 | — | — | — | 0.321 | 2.40 | 0.32 | 0.64 |
| 679 | 0.907 | — | — | 0.578 | 4.75 | 2.92 | 1.60 |
| 680 | 1.795 | — | — | 1.402 | 2.14 | 3.85 | 1.38 |
| 681 | 0.320 | — | — | 0.487 | 3.42 | 4.74 | 1.46 |
| 682 | 1.134 | — | — | 1.480 | 2.97 | 4.79 | 0.66 |
| 683 | 0.888 | — | — | 1.045 | 2.37 | 0.76 | 1.37 |
| 684 | 1.317 | — | — | 1.871 | 0.88 | 3.93 | 1.50 |
| 685 | — | 0.402 | — | 1.643 | 4.94 | 3.92 | 1.67 |
| 686 | — | 0.344 | — | 1.999 | 4.09 | 4.66 | 0.65 |
| 687 | — | 1.828 | — | 1.636 | 2.38 | 3.08 | 0.89 |
| 688 | — | 1.534 | — | 1.224 | 1.44 | 0.72 | 0.27 |
| 689 | — | 0.116 | — | 0.414 | 2.81 | 3.94 | 0.28 |
| 690 | — | 0.232 | — | 0.888 | 0.98 | 4.86 | 0.65 |
| 691 | — | — | 0.816 | 1.329 | 4.74 | 2.62 | 1.96 |
| 692 | — | — | 1.278 | 1.395 | 3.65 | 1.26 | 1.24 |
| 693 | — | — | 0.685 | 1.771 | 4.21 | 2.40 | 1.79 |
| 694 | — | — | 1.689 | 1.116 | 3.20 | 2.85 | 1.50 |
| 695 | — | — | 0.985 | 0.118 | 2.21 | 4.22 | 0.99 |
| 696 | — | — | 1.222 | 1.416 | 0.44 | 0.87 | 1.75 |
| 697 | — | 1.047 | 0.086 | 1.724 | 4.36 | 4.11 | 0.80 |
| 698 | — | 1.789 | 1.247 | 1.695 | 1.16 | 1.09 | 0.54 |
| 699 | — | 1.128 | 1.370 | 1.991 | 4.41 | 3.02 | 0.67 |
| 700 | — | 1.750 | 0.152 | 1.312 | 3.81 | 1.97 | 0.90 |

TABLE 24-3

STEEL OF INVENTION (Mass. %)

| No. | P | S | O | D-CRS | HAZCRS | M % |
|---|---|---|---|---|---|---|
| 671 | 0.0028 | 0.005 | 0.011 | 3 | 135 | 31 |
| 672 | 0.0178 | 0.008 | 0.009 | 6 | 168 | 43 |
| 673 | 0.0078 | 0.001 | 0.017 | 6 | 146 | 29 |
| 674 | 0.0281 | 0.005 | 0.013 | 0 | 173 | 17 |
| 675 | 0.0285 | 0.004 | 0.013 | 4 | 175 | 15 |
| 676 | 0.0042 | 0.006 | 0.014 | 2 | 156 | 19 |
| 677 | 0.0250 | 0.001 | 0.013 | 1 | 144 | 15 |
| 678 | 0.0261 | 0.001 | 0.015 | 5 | 141 | 7 |
| 679 | 0.0179 | 0.004 | 0.019 | 6 | 175 | 21 |
| 680 | 0.0253 | 0.010 | 0.010 | 6 | 148 | 32 |
| 681 | 0.0135 | 0.006 | 0.016 | 5 | 139 | 11 |
| 682 | 0.0221 | 0.001 | 0.004 | 3 | 150 | 26 |
| 683 | 0.0017 | 0.003 | 0.018 | 5 | 158 | 22 |
| 684 | 0.0220 | 0.005 | 0.008 | 6 | 168 | 33 |
| 685 | 0.0186 | 0.006 | 0.009 | 5 | 156 | 22 |
| 686 | 0.0158 | 0.009 | 0.007 | 5 | 150 | 23 |
| 687 | 0.0245 | 0.008 | 0.001 | 1 | 152 | 38 |
| 688 | 0.0244 | 0.002 | 0.006 | 2 | 141 | 31 |
| 689 | 0.0252 | 0.006 | 0.009 | 4 | 169 | 16 |
| 690 | 0.0077 | 0.002 | 0.017 | 2 | 165 | 21 |

TABLE 24-3-continued

STEEL OF INVENTION (Mass. %)

| No. | P | S | O | D-CRS | HAZCRS | M % |
|---|---|---|---|---|---|---|
| 691 | 0.0262 | 0.006 | 0.007 | 5 | 155 | 28 |
| 692 | 0.0165 | 0.008 | 0.015 | 6 | 167 | 26 |
| 693 | 0.0184 | 0.001 | 0.008 | 6 | 155 | 29 |
| 694 | 0.0120 | 0.007 | 0.013 | 1 | 170 | 27 |
| 695 | 0.0221 | 0.002 | 0.007 | 7 | 167 | 16 |
| 696 | 0.0291 | 0.002 | 0.006 | 2 | 146 | 27 |
| 697 | 0.0281 | 0.010 | 0.016 | 6 | 137 | 35 |
| 698 | 0.0141 | 0.002 | 0.015 | 4 | 167 | 48 |
| 699 | 0.0269 | 0.004 | 0.010 | 6 | 163 | 39 |
| 700 | 0.0172 | 0.006 | 0.017 | 5 | 154 | 37 |

D-CRS: Difference between the creep rupture strength at 600° C. for 100,000 hours estimated by linear extrapolation of a base steel and that of a weld heat-affected zone (MPa)

HAZCRS: Creep rupture strength of a weld zone at 600° C. for 100,000 hours estimated by linear extrapolation (MPa)

M %: Value of (Ti % + Zr % + Ta % + Hf %) in M of $M_{23}C_6$ type carbides in a weld heat-affected zone

TABLE 25-1

STEEL OF INVENTION (Mass. %)

| No. | C | Si | Mn | Cr | Mo | W | V | Nb | N |
|---|---|---|---|---|---|---|---|---|---|
| 701 | 0.21 | 0.24 | 0.91 | 9.56 | 0.450 | 2.84 | 0.43 | 0.35 | 0.10 |
| 702 | 0.11 | 0.45 | 0.54 | 6.45 | 0.127 | 2.97 | 0.52 | 0.39 | 0.17 |
| 703 | 0.04 | 0.06 | 0.91 | 17.65 | 0.088 | 2.98 | 0.27 | 0.11 | 0.12 |
| 704 | 0.07 | 0.50 | 0.68 | 15.12 | 0.185 | 2.36 | 0.99 | 0.40 | 0.15 |
| 705 | 0.02 | 0.09 | 0.92 | 9.65 | 0.220 | 0.56 | 0.55 | 0.45 | 0.11 |
| 706 | 0.28 | 0.26 | 0.70 | 5.48 | 0.547 | 1.95 | 0.26 | 0.42 | 0.08 |
| 707 | 0.08 | 0.10 | 0.29 | 13.64 | 0.508 | 2.73 | 0.47 | 0.23 | 0.13 |
| 708 | 0.08 | 0.26 | 0.36 | 6.01 | 0.935 | 2.36 | 1.00 | 0.30 | 0.24 |
| 709 | 0.25 | 0.61 | 0.78 | 6.28 | 0.160 | 0.27 | 0.21 | 0.29 | 0.23 |
| 710 | 0.25 | 0.25 | 0.61 | 6.03 | 0.523 | 0.90 | 0.42 | 0.13 | 0.19 |
| 711 | 0.02 | 0.23 | 0.93 | 9.59 | 0.862 | 2.06 | 0.48 | 0.23 | 0.08 |
| 712 | 0.26 | 0.79 | 0.39 | 8.10 | 0.500 | 1.49 | 0.20 | 0.50 | 0.09 |
| 713 | 0.03 | 0.64 | 0.88 | 12.65 | 0.286 | 2.04 | 0.92 | 0.38 | 0.08 |
| 714 | 0.01 | 0.05 | 0.66 | 8.10 | 0.055 | 3.13 | 0.02 | 0.27 | 0.13 |
| 715 | 0.02 | 0.05 | 0.39 | 5.22 | 0.632 | 0.88 | 0.28 | 0.10 | 0.18 |
| 716 | 0.30 | 0.53 | 0.76 | 8.47 | 0.369 | 3.08 | 0.07 | 0.02 | 0.08 |
| 717 | 0.07 | 0.17 | 0.42 | 9.12 | 0.586 | 0.88 | 0.70 | 0.21 | 0.16 |
| 718 | 0.30 | 0.03 | 0.45 | 11.69 | 0.139 | 2.02 | 0.04 | 0.34 | 0.02 |
| 719 | 0.22 | 0.37 | 0.31 | 13.79 | 0.332 | 0.94 | 0.87 | 0.08 | 0.20 |
| 720 | 0.07 | 0.65 | 0.66 | 13.50 | 0.034 | 2.15 | 0.11 | 0.09 | 0.09 |

TABLE 25-2

STEEL OF INVENTION (Mass. %)

| No. | Ti | Zr | Ta | Hf | Co | Ni | Cu |
|---|---|---|---|---|---|---|---|
| 701 | — | 1.320 | 1.239 | 1.310 | 3.31 | 1.89 | 1.83 |
| 702 | — | 1.487 | 0.298 | 1.641 | 2.09 | 2.01 | 0.47 |
| 703 | 1.220 | — | 0.025 | 1.004 | 4.23 | 3.95 | 1.02 |
| 704 | 1.510 | — | 0.055 | 0.054 | 1.70 | 4.49 | 1.37 |
| 705 | 1.549 | — | 1.089 | 1.455 | 0.90 | 0.46 | 0.35 |
| 706 | 1.018 | — | 0.804 | 0.923 | 1.13 | 0.73 | 1.26 |
| 707 | 1.560 | — | 1.858 | 0.093 | 1.51 | 2.03 | 1.99 |
| 708 | 0.886 | — | 1.929 | 0.641 | 3.71 | 3.61 | 0.46 |
| 709 | 0.631 | 1.371 | — | 1.234 | 2.11 | 2.30 | 1.77 |
| 710 | 1.504 | 0.654 | — | 0.556 | 0.72 | 4.48 | 1.13 |
| 711 | 1.160 | 0.598 | — | 0.273 | 3.54 | 4.56 | 0.92 |
| 712 | 1.235 | 1.864 | — | 1.048 | 0.22 | 1.76 | 1.77 |
| 713 | 1.457 | 1.158 | — | 1.581 | 4.39 | 4.95 | 1.59 |
| 714 | 0.470 | 0.131 | — | 1.527 | 0.82 | 1.28 | 0.97 |
| 715 | 0.946 | 0.427 | 0.199 | 0.537 | 0.68 | 4.31 | 1.40 |
| 716 | 0.571 | 0.776 | 0.577 | 1.322 | 0.90 | 1.37 | 0.81 |

TABLE 25-2-continued

STEEL OF INVENTION

| No. | Ti | Zr | Ta | Hf | Co | Ni | (Mass. %) Cu |
|---|---|---|---|---|---|---|---|
| 717 | 1.005 | 1.793 | 1.990 | 0.532 | 3.01 | 3.62 | 0.71 |
| 718 | 0.923 | 1.196 | 1.157 | 1.843 | 1.45 | 0.69 | 1.69 |
| 719 | 0.972 | 1.619 | 0.713 | 1.907 | 2.57 | 3.69 | 0.72 |
| 720 | 1.877 | 1.728 | 0.321 | 1.400 | 0.80 | 4.72 | 0.25 |

TABLE 25-3

STEEL OF INVENTION

| No. | P | S | O | D-CRS | HAZCRS | (Mass. %) M % |
|---|---|---|---|---|---|---|
| 701 | 0.0096 | 0.010 | 0.003 | 6 | 166 | 39 |
| 702 | 0.0291 | 0.010 | 0.004 | 3 | 179 | 32 |
| 703 | 0.0261 | 0.009 | 0.007 | 2 | 169 | 31 |
| 704 | 0.0253 | 0.006 | 0.009 | 5 | 164 | 21 |
| 705 | 0.0221 | 0.005 | 0.007 | 5 | 167 | 40 |
| 706 | 0.0117 | 0.002 | 0.017 | 3 | 131 | 34 |
| 707 | 0.0040 | 0.007 | 0.007 | 6 | 134 | 41 |
| 708 | 0.0088 | 0.008 | 0.003 | 5 | 152 | 35 |
| 709 | 0.0064 | 0.004 | 0.010 | 6 | 165 | 38 |
| 710 | 0.0220 | 0.007 | 0.008 | 4 | 149 | 32 |
| 711 | 0.0205 | 0.002 | 0.001 | 3 | 133 | 26 |
| 712 | 0.0270 | 0.001 | 0.016 | 4 | 144 | 36 |
| 713 | 0.0220 | 0.003 | 0.012 | 6 | 159 | 42 |
| 714 | 0.0151 | 0.002 | 0.013 | 4 | 158 | 29 |
| 715 | 0.0162 | 0.004 | 0.017 | 5 | 166 | 29 |
| 716 | 0.0208 | 0.009 | 0.002 | 7 | 138 | 30 |
| 717 | 0.0240 | 0.007 | 0.002 | 2 | 176 | 52 |
| 718 | 0.0208 | 0.008 | 0.006 | 2 | 157 | 46 |
| 719 | 0.0206 | 0.004 | 0.018 | 0 | 159 | 46 |
| 720 | 0.0044 | 0.009 | 0.017 | 2 | 161 | 52 |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

TABLE 26-1

COMPARATIVE STEEL

| | C | Si | Mn | Cr | Mo | W | V | Nb | N | Ti | Zr | Ta | Hf | (Mass. %) Co |
|---|---|---|---|---|---|---|---|---|---|---|---|---|---|---|
| 721 | 0.096 | 0.637 | 0.307 | 13.8 | 0.32 | 2.21 | 0.540 | 0.144 | 0.026 | 1.974 | — | 0.797 | — | — |
| 722 | 0.063 | 0.070 | 0.862 | 17.3 | 0.04 | 0.52 | 0.205 | 0.011 | 0.022 | – | 1.546 | — | — | 0.67 |
| 723 | 0.025 | 0.520 | 0.599 | 10.8 | 0.95 | 1.57 | 0.684 | 0.150 | 0.217 | — | 0.002 | — | — | — |
| 724 | 0.072 | 0.339 | 0.461 | 8.0 | 0.94 | 2.50 | 0.538 | 0.211 | 0.194 | — | — | — | — | 4.29 |
| 725 | 0.077 | 0.187 | 0.497 | 12.4 | 0.27 | 3.22 | 0.913 | 0.286 | 0.222 | 2.243 | 0.252 | — | 0.001 | 2.95 |
| 726 | 0.012 | 0.016 | 0.994 | 14.6 | 0.60 | 2.15 | 0.099 | 0.061 | 0.170 | — | 3.105 | — | — | 1.86 |
| 727 | 0.117 | 0.032 | 0.495 | 6.2 | 0.39 | 0.33 | 0.372 | 0.035 | 0.175 | — | — | 2.007 | — | — |
| 728 | 0.109 | 0.195 | 0.328 | 16.2 | 0.74 | 0.69 | 0.534 | 0.060 | 0.090 | — | — | 1.559 | 3.511 | 4.15 |
| 729 | 0.276 | 0.777 | 0.640 | 13.3 | 0.01 | 2.61 | 0.811 | 0.253 | 0.016 | 1.938 | — | 1.287 | — | — |
| 730 | 0.066 | 0.013 | 0.265 | 5.0 | 0.16 | 3.00 | 0.480 | 0.229 | 0.131 | — | 1.535 | — | 0.180 | 1.56 |

TABLE 26-2

COMPARATIVE STEEL (Mass. %)

| | Ni | Cu | P | S | O | D-CRS | HAZCRS | M % | Addition time of Ti, Zr, Ta and Hf |
|---|---|---|---|---|---|---|---|---|---|
| 721 | 4.76 | — | 0.015 | 0.004 | 0.006 | 42 | 84 | 0 | During melting step |
| 722 | — | — | 0.014 | 0.009 | 0.006 | 77 | 105 | 1 | During melting step |
| 723 | — | 1.24 | 0.009 | 0.001 | 0.010 | 81 | 77 | 2 | During refining step, 10 min. before tapping |
| 724 | — | 1.57 | 0.008 | 0.008 | 0.013 | 42 | 80 | 0 | During refining step, 10 min. before tapping |
| 725 | — | — | 0.022 | 0.04 | 0.14 | 54 | 91 | 71 | During refining step, 10 min. before tapping |
| 726 | — | 1.52 | 0.024 | 0.003 | 0.011 | 25 | 85 | 84 | During refining step, 10 min. before tapping |
| 727 | 0.90 | 1.97 | 0.023 | 0.001 | 0.008 | 40 | 93 | 90 | During refining step, 10 min. before tapping |
| 728 | 2.23 | — | 0.017 | 0.002 | 0.016 | 39 | 106 | 68 | During refining step, 10 min. before tapping |
| 729 | — | — | 0.016 | 0.003 | 0.001 | 29 | 100 | 2 | During refining step, 10 min. before tapping |
| 730 | 3.56 | 1.65 | 0.012 | 0.003 | 0.006 | 36 | 98 | 2 | During refining step, 10 min. before tapping |

D-CRS: Difference between the creep rupture strength at 600° C. for 100,000 hours estimated by linear extrapolation of a base steel and that of a weld heat-affected zone (MPa)
HAZCRS: Creep rupture strength of a weld zone at 600° C. for 100,000 hours estimated by linear extrapolation (MPa)
M %: Value of (Ti % + Zr % + Ta % + Hf %) in M of $M_{23}C_6$ type carbides in a weld heat-affected zone

POSSIBILITY OF UTILIZATION IN THE INDUSTRY

As described above in detail, the present invention provides a martensitic heat-resisting steel excellent in HAZ-softening resistance and exhibiting a high creep strength at high temperature of at least 550° C. The present invention can, therefore, provide materials at low cost which can withstand operation conditions at high temperature and high pressure in thermal power plant boilers, etc. Accordingly, the present invention extremely contributes to the development of the industry.

We claim:

1. A martensitic heat-resisting steel having a tempered martensite structure and excellent in HAZ-softening resistance consisting essentially of, in terms of % by mass, 0.01 to 0.30% of C, 0.02 to 0.80% of Si, 0.20 to 1.00% of Mn, 5.00 to 18.00% of Cr, 0.005 to 1.00% of Mo, 0.20 to 3.50% of W, 0.02 to 1.00% of V, 0.01 to 0.50% of Nb, 0.01 to 0.25% of N, up to 0.030% of P, up to 0.010% of S, up to 0.020% of O, at least one element selected from the group consisting of Ti, Zr, Ta and Hf in an amount of 0.005 to 2.0% for each of the elements, and the balance Fe and unavoidable impurities, the volume of (Ti %+Zr %+Ta %+Hf %) in the metal component M of $M_{23}C_6$ type carbides precipitated in the tempered martensite structure of the steel being from 5 to 65%.

2. The martensitic heat-resisting steel according to claim 1, wherein said steel further consists essentially of, in terms of % by mass, at least one element selected from the group consisting of Co, Ni and Cu in an amount of 0.1 to 5.0% for Co or Ni, and 0.1 to 2.0% for Cu.

3. A process for producing a martensitic heat-resisting steel excellent in HAZ-softening resistance, comprising the steps of adding at least one element selected from the group consisting of Ti, Zr, Ta and Hf in an amount of 0.005 to 2.0% for each of the elements, in terms of % by mass, to a molten steel consisting essentially of 0.01 to 0.30% of C, 0.02 to 0.80% of Si, 0.20 to 1.00% of Mn, 5.00 to 18.00% of Cr, 0.005 to 1.00% of Mo, 0.20 to 3.50% of W, 0.02 to 1.00% of V, 0.01 to 0.50% of Nb, 0.01 to 0.25% of N, up to 0.030% of P, up to 0.010% of S, up to 0.020% of O, and the balance Fe and unavoidable impurities, during the period from 10 minutes before completion of refining to completion of refining, casting said molten steel, hot working the resulting casting, solution treating the hot worked product thus obtained, subjecting said hot worked product having been solution treated to cooling stop at a temperature from 950° to 1,000° C. in the course of cooling said hot worked product from the solution treating temperature to room temperature, holding said hot worked product at the temperature for 5 to 60 minutes, and tempering said worked product.

4. The process for producing a martensitic heat-resisting steel according to claim 3, wherein said molten steel further consisting essentially of, in terms of % by mass, at least one element selected from the group consisting of Co, Ni and Cu in an amount of 0.1 to 5.0% for Co or Ni, and 0.1 to 2.0% for Cu.

5. The process for producing a martensitic heat-resisting steel according to claim 3, wherein said hot working is rolling for producing a plate product and a tube product.

6. The process for producing a martensitic heat-resisting steel according to claim 3, wherein said hot working is forging.

* * * * *

UNITED STATES PATENT AND TRADEMARK OFFICE

CERTIFICATE OF CORRECTION

PATENT NO. : 5,650,024

DATED : July 22, 1997

INVENTOR(S) : Yasushi Hasegawa, et. al.

It is certified that error appears in the above-identified patent and that said Letters Patent is hereby corrected as shown below:

Column 5, line 18, change "K" to --W--.

Column 14, line 19 (Table 2-1-continued), change "0.08" to --0.98--.

Column 16, line 51 (Table 3-3), change "0.004" to --0.005--.

Column 18, line 88 (Table 4-2-continued), change "0.394" to --0.395--

Column 19, line 51 (Table 5-2), change "1.014" to --1.015--.

Column 19, line 10 (Table 5-1), change "0.05" to --0.06--.

Column 24, line 65 (Table 8-2), change "0.76" to --0.765--.

Column 27, line 34 (Table 10-1), change "0.43" to --0.54--.

Column 29, line 36 (Table 11-1), change "0.75" to --0,74--.

Column 31, line 27 (Table 12-2), change "3.243" to --3.24--.

UNITED STATES PATENT AND TRADEMARK OFFICE

CERTIFICATE OF CORRECTION

PATENT NO. : 5,650,024

DATED : July 22, 1997

INVENTOR(S) : Yasushi Hasegawa, et. al.

It is certified that error appears in the above-identified patent and that said Letters Patent is hereby corrected as shown below:

Column 31, line 32 (Table 12-2), change "0.44" to --0.444--.

Column 33, line 50 (Table 13-3), change "5" to --4--.

Column 34, line 13 (Table 14-1), change "0.76" to --0.75--.

Column 36, line 18 (Table 15-2), change "0.848" to --1.848--.

Column 37, line 35 (Table 16-1), change "0.436" to --0.46--.

Column 39, line 19 (Table 17-1), change "0.94" to --0.95--.

Column 40, line 11 (Table 17-3), change "5" to --6--.

Column 40, line 27 (Table 17-3), change "2" to --3--.

Column 41, line 54 (Table 18-3), change "0.0233" to --0.0223--.

Column 45, line 61 (Table 21-1), change "90.00" to --9.00--.

Column 49, line 13 (Table 23-1), change "51.0" to --5.10--.

Column 50, line 60 (Table 24-1), change "13.99" to --14.99--.

UNITED STATES PATENT AND TRADEMARK OFFICE

CERTIFICATE OF CORRECTION

PATENT NO. : 5,650,024

DATED : July 22, 1997

INVENTOR(S) : Yasushi Hasegawa, et. al.

It is certified that error appears in the above-identified patent and that said Letters Patent is hereby corrected as shown below:

Column 51, line 57 (Table 24-3), change "5" to --6--.

Column 53, line 55 (Table 26-1), change "0.180" to --0.170--.

Column 55, line 12 (Table 26-2), change "0.04 0.14" to --0.004 0.014--.

Signed and Sealed this

Twenty-second Day of September, 1998

*Attest:*

Bruce Lehman

BRUCE LEHMAN

*Attesting Officer*

*Commissioner of Patents and Trademarks*